US011478035B2

(12) United States Patent
Waters

(10) Patent No.: US 11,478,035 B2
(45) Date of Patent: Oct. 25, 2022

(54) LIGHTED HEADGEAR AND ACCESSORIES THEREFOR

(71) Applicant: Michael Waters, Aspen, CO (US)

(72) Inventor: Michael Waters, Aspen, CO (US)

( * ) Notice: Subject to any disclaimer, the term of this patent is extended or adjusted under 35 U.S.C. 154(b) by 0 days.

(21) Appl. No.: 16/934,746

(22) Filed: Jul. 21, 2020

(65) Prior Publication Data

US 2020/0345094 A1 Nov. 5, 2020

Related U.S. Application Data

(63) Continuation of application No. 16/182,329, filed on Nov. 6, 2018, now Pat. No. 10,716,350, which is a (Continued)

(51) Int. Cl.

| | |
|---|---|
| ***A42B 1/244*** | (2021.01) |
| ***A42B 1/0182*** | (2021.01) |
| ***B65D 43/02*** | (2006.01) |
| ***H01H 13/02*** | (2006.01) |
| ***A42B 3/04*** | (2006.01) |
| ***F21L 4/08*** | (2006.01) |
| ***F21V 5/04*** | (2006.01) |

(Continued)

(52) U.S. Cl.

CPC ..... *A42B 1/244* (2013.01); *A42B 1/0182* (2021.01); *A42B 3/044* (2013.01); *B65D 43/02* (2013.01); *F21L 4/08* (2013.01); *F21V 5/04* (2013.01); *F21V 23/04* (2013.01); *F21V 33/0008* (2013.01); *H01H 13/02* (2013.01)

(58) Field of Classification Search

CPC ..... A42B 1/244; A42B 1/0182; A42B 3/044; B65D 43/02; F21L 4/08; F21V 5/04; F21V 23/04; F21V 33/0008; H01H 13/02

See application file for complete search history.

(56) References Cited

U.S. PATENT DOCUMENTS

| | | | |
|---|---|---|---|
| 645,984 | A | 3/1900 | Tournier |
| 909,742 | A | 1/1909 | Borchert |

(Continued)

FOREIGN PATENT DOCUMENTS

| | | |
|---|---|---|
| AU | 1178576 | 9/1977 |
| AU | 6310994 | 11/1994 |

(Continued)

OTHER PUBLICATIONS

'Initial Non-Infringement, Invalidity and Unenforceability, Contentions' with Exhibit A, Exhibits B-1 and B-2, and Exhibits C-1 through C7, *Waters Industries, Inc.* v. *Outdoor Cap Co., Inc.*, United States District Court for the Northern District of Illinois, Case No. 1:13-cv-07191,263 pages (Dec. 18, 2013).

(Continued)

*Primary Examiner* — Bao Q Truong

(74) *Attorney, Agent, or Firm* — Fitch, Even, Tabin & Flannery LLP

(57) ABSTRACT

Lighted headgear are provided that include removable self-contained light modules. The self-contained light modules can include a housing that contains one or more light sources and a rechargeable power source. The housing may include a protruding engagement portion for removably securing the self-contained light module to a cap portion of the lighted headgear.

6 Claims, 51 Drawing Sheets

Related U.S. Application Data continuation of application No. 14/716,614, filed on May 19, 2015, now Pat. No. 10,117,476, which is a continuation of application No. 13/695,417, filed as application No. PCT/US2011/034686 on Apr. 29, 2011, now abandoned.

(60) Provisional application No. 61/330,185, filed on Apr. 30, 2010.

(51) Int. Cl.
*F21V 23/04* (2006.01)
*F21V 33/00* (2006.01)

(56) References Cited

U.S. PATENT DOCUMENTS

| | | | |
|---|---|---|---|
| 1,098,628 | A | 6/1914 | Hyman |
| 1,109,415 | A | 9/1914 | Harris |
| 1,261,824 | A | 1/1918 | La Vine |
| 1,255,265 | A | 2/1918 | Zachara |
| 1,323,822 | A | 12/1919 | Bramming |
| D58,302 | S | 7/1921 | Bartholomew |
| 1,438,586 | A | 12/1922 | Eaton |
| 1,448,353 | A | 3/1923 | Barany |
| 1,475,653 | A | 11/1923 | Rosenberg |
| 1,572,210 | A | 2/1926 | Kolibas |
| 1,615,067 | A | 1/1927 | Boerman |
| 1,744,777 | A | 1/1930 | Lundgren |
| 1,749,998 | A | 3/1930 | Collins |
| 1,879,512 | A | 9/1932 | Rotea |
| 1,883,756 | A | 10/1932 | Bloom |
| D114,980 | S | 1/1939 | Wengen |
| 2,196,543 | A | 4/1940 | Anderson |
| 2,373,553 | A | 10/1942 | Fetterman |
| D137,375 | S | 2/1944 | Heit |
| 2,369,829 | A | 2/1945 | Johnson |
| 2,461,254 | A | 2/1949 | Bassett |
| 2,473,394 | A | 6/1949 | Scott |
| 2,531,585 | A | 11/1950 | Pope |
| 2,540,435 | A | 2/1951 | Ferguson |
| 2,552,764 | A | 5/1951 | Bedford, Jr. |
| 2,567,046 | A | 9/1951 | Anderson |
| 2,591,112 | A | 4/1952 | Zwierzynski |
| 2,638,532 | A | 5/1953 | Brady |
| 2,640,980 | A | 6/1953 | Prupis |
| 2,705,751 | A | 4/1955 | Harris |
| 2,730,720 | A | 1/1956 | Saunders |
| 2,788,439 | A | 4/1957 | Hesse |
| 2,904,670 | A | 9/1959 | Calmes |
| 2,966,580 | A | 12/1960 | Taylor |
| 2,978,696 | A | 4/1961 | Keller |
| 3,008,040 | A | 11/1961 | Moore |
| 3,032,647 | A | 5/1962 | Wansky |
| 3,040,881 | A | 6/1962 | McNeill |
| 3,057,992 | A | 10/1962 | Baker |
| 3,060,308 | A | 10/1962 | Fortuna |
| 3,123,208 | A | 3/1964 | Barnum |
| 3,184,058 | A | 5/1965 | Crowther |
| 3,201,771 | A | 8/1965 | Proulx |
| D207,919 | S | 6/1967 | Fai |
| 3,350,552 | A | 10/1967 | Lawrence |
| 3,358,137 | A | 12/1967 | Sinclair |
| 3,447,164 | A | 6/1969 | Greenhouse |
| D215,751 | S | 10/1969 | Castellano |
| 3,491,374 | A | 1/1970 | Frangos |
| 3,535,282 | A | 10/1970 | Mallory |
| 3,537,909 | A | 11/1970 | Horton |
| 3,602,759 | A | 8/1971 | Evans |
| 3,634,676 | A | 1/1972 | Castellano |
| 3,647,059 | A | 3/1972 | Humphreys |
| 3,666,901 | A | 5/1972 | Weinhart |
| 3,683,168 | A | 8/1972 | Tatje |
| 3,740,545 | A | 6/1973 | Franklin |
| 3,749,902 | A | 7/1973 | Drew |
| 3,769,663 | A | 11/1973 | Perl |
| D229,975 | S | 1/1974 | Klugmann |
| 3,793,517 | A | 2/1974 | Carlini |
| 3,845,389 | A | 10/1974 | Phillips |
| 3,947,676 | A | 3/1976 | Battilana |
| 3,963,917 | A | 6/1976 | Romano |
| 4,005,776 | A | 2/1977 | Seeley |
| 4,011,600 | A | 3/1977 | Malk |
| 4,053,688 | A | 10/1977 | Perkins |
| 4,092,704 | A | 5/1978 | Malm |
| 4,176,932 | A | 12/1979 | Young et al. |
| 4,186,429 | A | 1/1980 | Johnston |
| 4,210,952 | A | 7/1980 | Ressmeyer |
| 4,231,079 | A | 10/1980 | Heminover |
| 4,254,451 | A | 3/1981 | Cochran, Jr. |
| 4,268,894 | A | 5/1981 | Bartunek |
| 4,270,227 | A | 6/1981 | Wolfe |
| 4,283,127 | A | 8/1981 | Rosenwinkel et al. |
| 4,298,913 | A | 11/1981 | Lozar |
| 4,317,162 | A | 2/1982 | Richards et al. |
| 4,332,007 | A | 5/1982 | Gibstein et al. |
| 4,364,107 | A | 12/1982 | Wieczorek |
| 4,392,183 | A | 7/1983 | Ostlund et al. |
| 4,398,237 | A | 8/1983 | Doyel |
| 4,406,040 | A | 9/1983 | Cannone |
| 4,425,531 | A | 1/1984 | Holmes |
| D272,733 | S | 2/1984 | Cosmos |
| 4,430,532 | A | 2/1984 | Matsumoto |
| 4,442,478 | A | 4/1984 | Stansbury |
| 4,462,064 | A | 7/1984 | Schweitzer |
| 4,470,263 | A | 9/1984 | Lehovec |
| 4,483,021 | A | 11/1984 | McCall |
| 4,516,157 | A | 5/1985 | Campbell |
| 4,521,831 | A | 6/1985 | Thayer |
| 4,541,698 | A | 9/1985 | Lerner |
| 4,551,857 | A | 11/1985 | Galvin |
| 4,553,851 | A | 11/1985 | Matsumoto |
| 4,559,516 | A | 12/1985 | Schott |
| 4,570,206 | A | 2/1986 | Deutsch |
| 4,602,191 | A | 7/1986 | Davila |
| 4,604,760 | A | 8/1986 | Coin |
| 4,616,297 | A | 10/1986 | Liu |
| 4,631,644 | A | 12/1986 | Dannhauer |
| 4,638,410 | A | 1/1987 | Barker |
| 4,641,647 | A | 2/1987 | Behan |
| 4,642,817 | A | 2/1987 | Ferstenfeld |
| 4,665,568 | A | 5/1987 | Stutes |
| 4,667,274 | A | 5/1987 | Daniel |
| 4,669,610 | A | 6/1987 | Lindsey |
| 4,680,815 | A | 7/1987 | Hirsch |
| 4,774,643 | A | 9/1988 | McGinnis et al. |
| 4,794,496 | A | 12/1988 | Lanes |
| 4,817,212 | A | 4/1989 | Benoit |
| 4,822,160 | A | 4/1989 | Tsai |
| 4,822,161 | A | 4/1989 | Jimmy |
| 4,827,384 | A | 5/1989 | VonSchlemmer |
| 4,829,285 | A | 5/1989 | Brand et al. |
| 4,872,218 | A | 10/1989 | Holt |
| 4,875,147 | A | 10/1989 | Auer |
| 4,884,067 | A | 11/1989 | Nordholm et al. |
| 4,901,210 | A | 2/1990 | Hanabusa |
| 4,901,211 | A | 2/1990 | Shen |
| 4,902,119 | A | 2/1990 | Porsche |
| 4,904,078 | A | 2/1990 | Gorike |
| 4,920,466 | A | 4/1990 | Liu |
| 4,945,458 | A | 7/1990 | Batts et al. |
| 4,951,068 | A | 8/1990 | Ichikawa |
| 4,959,760 | A | 9/1990 | Wu |
| 4,963,045 | A | 10/1990 | Willcox |
| 4,969,069 | A | 11/1990 | Eichost |
| 4,991,068 | A | 2/1991 | Mickey |
| 4,998,187 | A | 3/1991 | Herrick |
| 5,003,640 | A | 4/1991 | Pizzacar |
| D316,932 | S | 5/1991 | Escher, Jr. |
| 5,039,829 | A | 8/1991 | Brucksch |
| 5,060,814 | A | 10/1991 | Oglesbee |
| 5,068,771 | A | 11/1991 | Savage, Jr. |
| 5,070,436 | A | 12/1991 | Alexander et al. |
| 5,088,127 | A | 2/1992 | Thornock |

(56) References Cited

U.S. PATENT DOCUMENTS 5,111,366 A 5/1992 Rife
5,113,325 A 5/1992 Eisenbraun
5,117,510 A 6/1992 Broussard et al.
5,122,943 A 6/1992 Pugh
5,138,538 A 8/1992 Sperling
5,140,116 A 8/1992 Schmitt-Walter
5,140,220 A 8/1992 Hasegawa
5,143,443 A 9/1992 Madsen
5,158,356 A 10/1992 Guthrie
5,163,420 A 11/1992 VanDerBel
5,164,749 A 11/1992 Shelton
5,165,789 A 11/1992 Womack
5,183,326 A 2/1993 Case
5,189,512 A 2/1993 Cameron et al.
5,193,220 A 3/1993 Ichinohe
5,193,347 A 3/1993 Apisdorf
5,207,500 A 5/1993 Rios et al.
5,218,385 A 6/1993 Lii
5,224,772 A 7/1993 Fustos
5,230,558 A 7/1993 Jong
5,238,344 A 8/1993 Nagayama
5,245,516 A 9/1993 de Haas et al.
5,249,675 A 10/1993 Strauss
D343,470 S 1/1994 Yuen
5,278,734 A 1/1994 Ferber
D349,123 S 7/1994 Cooley
5,329,637 A 7/1994 Walker
5,331,333 A 7/1994 Tagawa et al.
5,331,357 A 7/1994 Cooley et al.
5,353,205 A 10/1994 Hudak
5,357,409 A 10/1994 Glatt
5,363,291 A 11/1994 Steiner
5,367,345 A 11/1994 da Silva
5,404,593 A 4/1995 Kronenberger
5,408,393 A 4/1995 Becker
5,410,746 A 4/1995 Gelber
5,412,545 A 5/1995 Rising
5,418,565 A 5/1995 Smith
5,423,419 A 6/1995 Wentz
5,425,620 A 6/1995 Stroud
5,438,698 A 8/1995 Burton et al.
5,452,190 A 9/1995 Priesemuth
5,460,346 A 10/1995 Hirsch
5,463,538 A 10/1995 Womack
5,467,992 A 11/1995 Harkness
5,485,358 A 1/1996 Chien
5,488,361 A 1/1996 Perry
5,503,637 A 4/1996 Kyricos
5,508,900 A 4/1996 Norman
5,510,961 A 4/1996 Peng
5,541,767 A 7/1996 Murphy et al.
5,541,816 A 7/1996 Miserendino
5,542,627 A 8/1996 Crenshaw
5,546,099 A 8/1996 Quint et al.
5,564,128 A 10/1996 Richardson
5,567,038 A 10/1996 Lary
D375,372 S 11/1996 Allen
5,575,554 A 11/1996 Guritz
5,601,358 A 2/1997 Chien
5,606,743 A 2/1997 Vogt et al.
5,608,808 A 3/1997 da Silva
5,610,678 A 3/1997 Tsuboi et al.
5,644,189 A 7/1997 Busby
5,655,374 A 8/1997 Santilli
D383,754 S 9/1997 Yuen
D383,863 S 9/1997 Yuen
5,667,291 A 9/1997 Caplan
5,667,292 A 9/1997 Sabalvaro, Jr.
5,676,449 A 10/1997 Newsome
5,677,079 A 10/1997 DeZorzi
5,680,718 A 10/1997 Ratcliffe
5,688,039 A 11/1997 Johnson
D388,113 S 12/1997 Feinbloom
5,692,244 A 12/1997 Johnson
5,708,449 A 1/1998 Heacock
5,709,464 A 1/1998 Tseng
5,718,335 A 2/1998 Boudreaux
5,722,762 A 3/1998 Soil
5,730,290 A 3/1998 Futo
5,741,060 A 4/1998 Johnson
5,743,621 A 4/1998 Mantha
5,758,947 A 6/1998 Glatt
5,774,338 A 6/1998 Wessling, III
5,786,665 A 7/1998 Ohtsuki et al.
5,800,278 A 9/1998 Varriano
5,806,961 A 9/1998 Dalton et al.
5,822,636 A 10/1998 Cho
5,829,063 A 11/1998 Cheng
5,829,860 A 11/1998 Lawther et al.
5,836,673 A 11/1998 Lo
5,845,778 A 12/1998 Hickey, Jr.
5,845,987 A 12/1998 Painter
5,857,220 A 1/1999 Erny
5,865,333 A 2/1999 Wolfe
5,871,271 A 2/1999 Chien
D407,187 S 3/1999 Makki
5,876,241 A 3/1999 Frantz
5,893,631 A 4/1999 Padden
5,894,604 A 4/1999 Crabb
5,911,494 A * 6/1999 Lary ..... A42B 1/244 362/106
5,918,966 A 7/1999 Arnold
5,920,910 A 7/1999 Calvo
5,921,674 A 7/1999 Koczi
5,922,489 A 7/1999 Adachi
5,931,693 A 8/1999 Yamazaki
5,946,071 A 8/1999 Feldman
5,982,969 A 11/1999 Sugiyama
5,997,165 A 12/1999 Lehrer
6,005,536 A 12/1999 Beadles et al.
6,007,212 A 12/1999 Chan
6,007,213 A 12/1999 Baumgartner
6,009,563 A 1/2000 Swanson
6,012,822 A 1/2000 Robinson
6,012,827 A 1/2000 Caplan et al.
D420,035 S 2/2000 Hartman
D420,207 S 2/2000 Barton
6,021,525 A 2/2000 Mertins
6,023,788 A 2/2000 McCallum
6,028,627 A 2/2000 Helmsderfer
6,032,291 A 3/2000 Asenguah
6,032,293 A 3/2000 Makki
6,056,413 A 5/2000 Urso
D428,431 S 7/2000 Jordan
6,086,214 A 7/2000 Ridge
6,087,037 A 7/2000 Rieder
6,088,053 A 7/2000 Hammack
6,094,749 A 8/2000 Proctor
6,113,243 A 9/2000 Saul
6,113,244 A 9/2000 Baumgartner
6,116,745 A 9/2000 Yei
6,124,056 A 9/2000 Kimura
6,126,294 A 10/2000 Koyama
6,167,570 B1 1/2001 Su
6,168,286 B1 * 1/2001 Duffy ..... A42B 1/242 362/105
6,172,657 B1 1/2001 Kamakura et al.
6,174,075 B1 1/2001 Fuwausa
6,176,601 B1 1/2001 Nester
6,206,543 B1 3/2001 Henry
6,236,007 B1 5/2001 Ho
6,237,147 B1 5/2001 Brockman
6,240,566 B1 6/2001 Scantlin
6,244,721 B1 6/2001 Rodriguez
6,250,769 B1 6/2001 Kirk
D445,928 S 7/2001 Sharrah
6,256,795 B1 7/2001 Habel
D446,324 S 8/2001 Lynch
6,290,368 B1 9/2001 Lehrer
6,299,323 B1 10/2001 Yu et al.
6,302,570 B1 10/2001 Petell et al.
6,306,538 B1 10/2001 Saitoh
6,307,526 B1 10/2001 Mann
6,311,350 B1 11/2001 Kaiserman

(56) References Cited

U.S. PATENT DOCUMENTS 6,311,837 B1 11/2001 Blaustein et al.
6,320,822 B1 11/2001 Okeya et al.
6,325,521 B1 12/2001 Gregg
6,328,454 B1 12/2001 Davis
6,340,234 B1 1/2002 Brown, Jr.
6,345,716 B1 2/2002 Chapman
6,347,410 B1 2/2002 Lee
6,363,537 B1 4/2002 Park
6,366,344 B1 4/2002 Lach
6,367,949 B1 4/2002 Pederson
D457,670 S 5/2002 Allen
6,382,407 B1 5/2002 Chao
6,386,701 B1 5/2002 Khulusi
6,390,640 B1 5/2002 Wong et al.
6,398,386 B1 6/2002 Huang
6,416,199 B1 7/2002 Heine
6,431,904 B1 8/2002 Berelsman
6,439,738 B1 8/2002 Matthews et al.
6,442,764 B1 9/2002 Badillo
6,457,838 B1 10/2002 Dugmore et al.
6,461,015 B1 10/2002 Welch
6,461,025 B1 10/2002 Payne
6,474,830 B1 11/2002 Hansen
6,476,391 B1 11/2002 Zhang
6,497,493 B1 12/2002 Theisen
D469,198 S 1/2003 Olson
6,504,099 B2 1/2003 Huang
6,523,973 B2 2/2003 Galli
6,530,672 B2 3/2003 Galli
6,538,567 B2 3/2003 Stewart
D473,890 S 4/2003 Waters
6,549,231 B1 4/2003 Matsui
6,553,570 B1 4/2003 Flynn
6,554,444 B2 4/2003 Shimada et al.
6,578,982 B1 6/2003 Lynch
D477,432 S 7/2003 Parsons
6,598,991 B2 7/2003 Altman
6,604,837 B2 8/2003 Sandberg
6,612,695 B2 9/2003 Waters
6,612,696 B2 9/2003 Waters
6,616,293 B2 9/2003 Mickey
6,634,031 B1 10/2003 Schlapkohl
6,642,667 B2 11/2003 Avis
D483,928 S 12/2003 Mansell
6,659,618 B2 12/2003 Waters
D484,905 S 1/2004 Waters
6,679,615 B2 1/2004 Spearing
6,704,044 B1 3/2004 Foster
6,709,142 B2 3/2004 Gyori
6,713,956 B2 3/2004 Hsing Chen et al.
6,715,309 B1 4/2004 Junkins
6,719,437 B2 4/2004 Lary
6,721,962 B1 4/2004 Polaire
D489,165 S 5/2004 Waters
6,733,150 B1 5/2004 Hanley
6,749,166 B2 6/2004 Valentine et al.
6,760,925 B1 7/2004 Maxwell
6,764,194 B1 7/2004 Cooper
6,802,636 B1 10/2004 Bailey, Jr.
6,808,284 B1 10/2004 Chao
6,811,441 B2 11/2004 Simpson
6,817,711 B2 11/2004 Schubert
6,830,357 B2 12/2004 Lopez
D501,266 S 1/2005 Harris, Jr
6,837,590 B2 1/2005 Marston
6,857,739 B1 2/2005 Watson
6,860,628 B2 3/2005 Robertson
6,863,416 B2 3/2005 Waters
6,865,285 B1 * 3/2005 Villa-Aleman ..... G06V 40/13 362/103
6,880,989 B2 4/2005 Sotome
6,908,208 B1 6/2005 Hyde
D507,368 S 7/2005 Waters
D507,369 S 7/2005 Waters
6,918,678 B2 7/2005 McClanahan
6,923,322 B2 8/2005 Lenker
6,929,375 B2 8/2005 Satomi
6,929,878 B2 8/2005 Chen et al.
6,932,216 B2 8/2005 Blaustein
6,935,761 B2 8/2005 Vanderschuit
6,941,583 B2 9/2005 Yan
6,966,668 B2 11/2005 Cugini
6,969,178 B2 11/2005 Zuloff
6,977,776 B2 12/2005 Volkenandt et al.
6,993,803 B2 2/2006 Chan
6,994,445 B1 2/2006 Pomes
6,997,552 B1 2/2006 Hung
7,000,841 B2 2/2006 Becker
7,003,353 B1 2/2006 Parkhouse
7,004,439 B1 2/2006 Taylor
7,004,582 B2 2/2006 Jannard et al.
7,008,074 B1 3/2006 Halm
7,021,790 B2 4/2006 Parsons
D520,460 S 5/2006 Wadsworth
7,052,154 B2 5/2006 Vanderschuit
7,055,179 B2 6/2006 Warner et al.
7,086,749 B1 8/2006 Hanley
7,094,981 B2 8/2006 Sorrentino et al.
7,104,670 B2 9/2006 Waters
7,105,939 B2 9/2006 Bednyak
7,111,956 B2 9/2006 Brown
7,114,823 B2 10/2006 McCullough et al.
7,118,241 B2 10/2006 Sohn
7,118,262 B2 10/2006 Negley
7,128,434 B1 10/2006 Nally
7,143,451 B2 12/2006 Lundgren
7,147,324 B2 12/2006 Jannard et al.
7,147,338 B2 12/2006 Gregg
7,150,526 B2 12/2006 Jannard et al.
7,163,309 B2 1/2007 Sohn
7,182,478 B2 2/2007 Marston
7,186,159 B1 3/2007 Baxter
7,192,151 B2 3/2007 Clupper
7,209,652 B2 4/2007 Uenaka
7,213,917 B2 5/2007 Jannard et al.
7,216,973 B2 5/2007 Jannard et al.
7,234,831 B1 6/2007 Hanley
7,226,180 B2 7/2007 Sung
7,255,437 B2 8/2007 Howell et al.
7,264,350 B2 9/2007 Jannard et al.
D553,177 S 10/2007 Chen
7,278,734 B2 10/2007 Jannard et al.
7,281,826 B2 10/2007 Huang
7,318,654 B2 1/2008 McClanahan
7,331,064 B1 2/2008 Quintal
D566,044 S 4/2008 D'Arco
D568,922 S 5/2008 Anderl
7,369,174 B2 5/2008 Olita
7,377,664 B2 5/2008 Waters
7,377,666 B1 5/2008 Tyler
7,427,149 B2 * 9/2008 Sohn ..... F21S 9/037 362/106
7,431,472 B2 10/2008 Becker
7,438,409 B2 10/2008 Jordan
7,457,536 B2 11/2008 Hamada et al.
7,461,764 B2 12/2008 Thompson
7,466,040 B2 12/2008 Bruwer
7,470,022 B2 12/2008 Lerner
7,506,992 B2 3/2009 Carter
D591,675 S 5/2009 Waters
7,562,979 B2 7/2009 Waters
7,576,800 B2 8/2009 Swain
D600,208 S 9/2009 Waters
D600,738 S 9/2009 Su
7,598,928 B1 10/2009 Buskop
7,607,775 B2 10/2009 Hermanson et al.
7,609,295 B2 10/2009 Aridome
7,611,255 B1 11/2009 Lagassey
7,621,000 B1 11/2009 Fulton
D605,381 S 12/2009 Mastrantonio
7,661,818 B2 2/2010 Waters
D611,086 S 3/2010 Meng-Suen
7,677,751 B2 3/2010 Kinsman
7,699,486 B1 4/2010 Beiner

(56) References Cited

U.S. PATENT DOCUMENTS

D617,826 S 6/2010 Waters
7,753,547 B2 7/2010 Waters
7,755,219 B2 7/2010 Bruwer
7,784,960 B2 8/2010 Lahtinen
7,862,979 B2 1/2011 Waters
7,934,846 B1 5/2011 Schwanz
7,938,553 B1 5/2011 Beiner
7,942,543 B2 5/2011 Ritter
8,002,437 B2 8/2011 Sohn
8,075,153 B2 12/2011 Werner
8,141,395 B2 3/2012 Dillavou
8,157,403 B2 4/2012 Lau
D659,351 S 5/2012 Benkendorfer
8,277,069 B2 10/2012 Zuloff
8,333,485 B2 12/2012 Waters
8,364,220 B2 1/2013 Sandmore
8,388,164 B2 3/2013 Waters
8,491,145 B2 7/2013 Waters
8,550,651 B2 10/2013 Waters
8,698,027 B2 4/2014 Anderst
8,757,831 B2 6/2014 Waters
8,757,931 B2 6/2014 Puttmann
8,769,723 B1 7/2014 Ilges et al.
8,774,420 B2 7/2014 Belafonte et al.
8,813,268 B1 8/2014 Fitzgerald et al.
8,919,984 B1 12/2014 Fitzgerald
8,950,012 B2 2/2015 Ilges et al.
9,057,500 B2 6/2015 Opolka
D734,925 S 7/2015 Waters
9,101,174 B2 8/2015 Waters
9,526,287 B2 12/2016 Waters
9,609,902 B2 4/2017 Waters
9,872,530 B2 1/2018 Waters
10,117,476 B2 11/2018 Waters
10,159,294 B2 12/2018 Waters
2001/0024365 A1 9/2001 Aknine
2002/0027777 A1 3/2002 Takasu
2002/0129989 A1 9/2002 Parsons
2002/0131275 A1 9/2002 Yamamoto et al.
2002/0159250 A1 10/2002 Kuo
2002/0163800 A1 11/2002 Hansen
2002/0186557 A1 12/2002 Lary et al.
2002/0187806 A1 12/2002 Jang
2003/0079387 A1 5/2003 Derose
2003/0086053 A1 5/2003 Waters
2003/0086054 A1 5/2003 Waters
2003/0106918 A1 6/2003 Hung
2003/0122958 A1 7/2003 Olita
2003/0151910 A1 8/2003 Marston
2003/0169207 A1 9/2003 Beigel
2003/0189824 A1 10/2003 Meeder et al.
2003/0206269 A1 11/2003 Waters
2003/0231489 A1* 12/2003 Hsiao ..... F21V 21/096 362/106
2004/0001150 A1 1/2004 Schindler, II et al.
2004/0008157 A1 1/2004 Brubaker
2004/0085745 A1 5/2004 Yoshihara
2004/0128737 A1 7/2004 Gesten
2004/0141312 A1 7/2004 Henning
2004/0141316 A1 7/2004 Twardawski
2004/0165109 A1 8/2004 Lee
2004/0222638 A1 11/2004 Bednyak
2004/0240067 A1 12/2004 Marusi et al.
2004/0240204 A1 12/2004 Russ et al.
2004/0252487 A1 12/2004 McCullough
2004/0264173 A1 12/2004 Vanderschuit
2004/0264176 A1 12/2004 Vanderschuit
2005/0001433 A1 1/2005 Seelin
2005/0035925 A1 2/2005 Ostromek et al.
2005/0047116 A1 3/2005 Gagne
2005/0066422 A1 3/2005 Yan
2005/0072458 A1 4/2005 Goldstein
2005/0078473 A1 4/2005 Zuloff
2005/0083676 A1 4/2005 VanderSchuit
2005/0099799 A1 5/2005 Cugini et al.
2005/0105285 A1 5/2005 Maden
2005/0161313 A1 7/2005 Sorrentino
2005/0174753 A1* 8/2005 Cao ..... F21V 29/74 362/106
2005/0204490 A1 9/2005 Kemp et al.
2005/0211187 A1 9/2005 Harman et al.
2005/0211574 A1 9/2005 Reeve
2005/0213340 A1 9/2005 Suzuki
2005/0219837 A1 10/2005 Brown
2005/0226433 A1 10/2005 McClanahan
2005/0237479 A1 10/2005 Rose
2005/0248932 A1 11/2005 Waters
2005/0254238 A1 11/2005 Parker et al.
2005/0265015 A1 12/2005 Salazar
2006/0012974 A1 1/2006 Su
2006/0012975 A1 1/2006 Huttner et al.
2006/0037125 A1 2/2006 McDowell
2006/0091784 A1 5/2006 Conner et al.
2006/0092621 A1 5/2006 Lai
2006/0093264 A1 5/2006 Tabuchi
2006/0107952 A1 5/2006 Schlosser
2006/0125624 A1 6/2006 Ostrovsky
2006/0126323 A1 6/2006 Pomes
2006/0138440 A1 6/2006 Jyo
2006/0141828 A1 6/2006 Dean
2006/0157569 A1 7/2006 Becker
2006/0158895 A1 7/2006 Brands et al.
2006/0165160 A1 7/2006 Winningstad
2006/0198122 A1 9/2006 Senter
2006/0212994 A1 9/2006 Proctor
2006/0215393 A1 9/2006 VanderSchuit
2006/0232955 A1 10/2006 Labine
2006/0238995 A1 10/2006 Wang
2006/0239018 A1 10/2006 Jardin
2006/0263677 A1 11/2006 Tsai
2006/0285315 A1 12/2006 Tufenkjian
2006/0286443 A1 12/2006 Huang
2006/0291193 A1 12/2006 Hill
2007/0003826 A1 1/2007 Hsu
2007/0013865 A1 1/2007 Joradn
2007/0030442 A1 2/2007 Howell et al.
2007/0048598 A1 3/2007 Huang
2007/0053179 A1 3/2007 Pang
2007/0058361 A1 3/2007 Sevilla
2007/0064413 A1 3/2007 Slater
2007/0072655 A1 3/2007 Cascone
2007/0074752 A1 4/2007 Shau
2007/0086182 A1 4/2007 Kelly
2007/0097668 A1 5/2007 Choi
2007/0127250 A1 6/2007 Waters
2007/0140675 A1 6/2007 Yanagi
2007/0145746 A1 6/2007 Biamonte
2007/0153500 A1 7/2007 Waters
2007/0153537 A1 7/2007 Scott et al.
2007/0154029 A1 7/2007 Werner
2007/0159810 A1* 7/2007 Kim ..... F21V 21/0885 362/105
2007/0159823 A1 7/2007 Ho
2007/0171628 A1 7/2007 Seade
2007/0189003 A1 8/2007 Daley
2007/0206373 A1 9/2007 Whiteside et al.
2007/0236649 A1 10/2007 Lin
2007/0236915 A1 10/2007 Chen
2007/0236916 A1 10/2007 Hsu
2008/0049963 A1 2/2008 Mann et al.
2008/0068559 A1 3/2008 Howell
2008/0069391 A1 3/2008 Steyn et al.
2008/0130272 A1 6/2008 Waters
2008/0152482 A1 6/2008 Patel
2008/0186705 A1 8/2008 Liu
2008/0263750 A1 10/2008 Chen
2008/0266839 A1 10/2008 Claypool
2009/0010474 A1 1/2009 Ouryouji
2009/0126076 A1 5/2009 Ochoa
2009/0147503 A1 6/2009 Bennett
2009/0148149 A1 6/2009 Chishima
2009/0193566 A1 8/2009 Waters
2009/0213323 A1 8/2009 Mermanson
2009/0268936 A1 10/2009 Goldberg et al.

(56) References Cited

U.S. PATENT DOCUMENTS

| | | | |
|---|---|---|---|
| 2009/0323317 | A1 | 12/2009 | Spartano |
| 2010/0024091 | A1 | 2/2010 | Mehtab et al. |
| 2010/0095431 | A1 | 4/2010 | Liao |
| 2010/0134761 | A1 | 6/2010 | Johns et al. |
| 2010/0182563 | A1 | 7/2010 | Waters |
| 2010/0207540 | A1 | 8/2010 | Walton |
| 2010/0214767 | A1 | 8/2010 | Waters |
| 2010/0242155 | A1 | 9/2010 | Carullo |
| 2010/0289433 | A1 | 11/2010 | Lau |
| 2010/0307931 | A1 | 12/2010 | Waters |
| 2010/0313335 | A1 | 12/2010 | Waters |
| 2011/0013135 | A1 | 1/2011 | Waters |
| 2011/0075095 | A1 | 3/2011 | Waters |
| 2011/0122601 | A1 | 5/2011 | Waters |
| 2011/0187989 | A1 | 8/2011 | Waters |
| 2011/0210685 | A1 | 9/2011 | Liao |
| 2011/0211156 | A1 | 9/2011 | Beiner |
| 2011/0228211 | A1 | 9/2011 | Waters |
| 2011/0242799 | A1 | 10/2011 | Dyer |
| 2012/0014095 | A2 | 1/2012 | Waters |
| 2012/0098465 | A1 | 4/2012 | Rothschild |
| 2013/0025612 | A1 | 1/2013 | Hunter |
| 2013/0033852 | A1 | 2/2013 | Liao |
| 2013/0111651 | A1 | 5/2013 | Waters |
| 2013/0192961 | A1 | 8/2013 | Waters |
| 2013/0198935 | A1 | 8/2013 | Waters |
| 2014/0049947 | A1 | 2/2014 | Lombard et al. |
| 2014/0101827 | A1 | 4/2014 | Dennis |
| 2014/0173807 | A1 | 6/2014 | Waters |
| 2014/0237706 | A1 | 8/2014 | O'Conner |
| 2014/0268683 | A1 | 9/2014 | Waters |
| 2014/0268684 | A1 | 9/2014 | Waters |
| 2014/0270685 | A1 | 9/2014 | Letke |
| 2015/0036324 | A1 | 2/2015 | Fitzgerald |
| 2015/0063777 | A1 | 3/2015 | Letke |
| 2015/0358515 | A1 | 12/2015 | Resnick |
| 2016/0337745 | A1 | 11/2016 | Adams |
| 2019/0178477 | A1 | 6/2019 | Ross |

FOREIGN PATENT DOCUMENTS

| | | | |
|---|---|---|---|
| AU | 199940150 | | 2/2000 |
| AU | 199959545 | | 3/2000 |
| AU | 2002100976 | | 6/2003 |
| AU | 2003100277 | | 7/2003 |
| AU | 2003248016 | | 11/2004 |
| CA | 2029772 | | 5/1991 |
| CA | 2198625 | | 2/1997 |
| CA | 2184336 | | 5/1997 |
| CA | 2406450 | | 11/2001 |
| CA | 2466175 | A1 | 5/2003 |
| CA | 2608746 | A1 | 11/2006 |
| CA | 2610073 | A1 | 5/2008 |
| CN | 86208973 | | 10/1987 |
| CN | 2173427 | | 8/1994 |
| CN | 2239167 | | 11/1996 |
| CN | 2423761 | | 3/2001 |
| CN | 2433836 | | 6/2001 |
| CN | 2458892 | | 11/2001 |
| CN | 2508592 | | 9/2002 |
| CN | 2544551 | | 4/2003 |
| CN | 1462597 | | 12/2003 |
| CN | 1603677 | A | 4/2005 |
| CN | 101950091 | A | 1/2011 |
| CN | 301445845 | S | 1/2011 |
| CN | 201796205 | U | 4/2011 |
| DE | 3043007 | | 6/1982 |
| DE | 8230583 | | 9/1983 |
| DE | 9410886 | | 9/1994 |
| DE | 29808222 | | 11/1998 |
| DE | 19837151 | | 4/2000 |
| DE | 20007738 | | 9/2000 |
| DE | 29915607 | | 9/2000 |
| DE | 20017922 | | 2/2001 |
| DE | 20020515 | | 8/2001 |
| DE | 20101380 | | 8/2001 |
| DE | 20106261 | | 9/2001 |
| DE | 20111815 | | 11/2001 |
| DE | 10046295 | | 3/2002 |
| DE | 20117740 | | 4/2002 |
| DE | 20201557 | | 5/2002 |
| DE | 20200058 | | 6/2002 |
| DE | 10103591 | | 8/2002 |
| DE | 20110124 | | 8/2002 |
| DE | 10057388 | | 9/2002 |
| DE | 20209115 | | 10/2002 |
| DE | 20210806 | | 10/2002 |
| DE | 10216152 | | 12/2002 |
| DE | 20209611 | | 1/2003 |
| DE | 20313629 | | 12/2003 |
| DE | 10330589 | | 1/2004 |
| DE | 20319297 | | 2/2004 |
| DE | 20318860 | | 4/2004 |
| DE | 20318949 | | 4/2004 |
| DE | 202004004960 | | 9/2005 |
| DE | 102007006860 | A1 | 8/2007 |
| EP | 1072204 | | 1/2001 |
| EP | 1374707 | | 1/2004 |
| EP | 1451633 | | 9/2004 |
| EP | 2290433 | A1 | 3/2011 |
| EP | 2299311 | A1 | 3/2011 |
| EP | 2350734 | A1 | 8/2011 |
| FR | 1221782 | | 6/1960 |
| FR | 2798721 | | 3/2001 |
| FR | 2824709 | | 11/2002 |
| FR | 2829365 | | 3/2003 |
| FR | 2833068 | | 6/2003 |
| FR | 2833069 | | 6/2003 |
| GB | 2268043 | | 1/1994 |
| GB | 2272073 | A | 5/1994 |
| GB | 2316293 | | 2/1998 |
| GB | 2358575 | | 8/2001 |
| GB | 2363314 | | 12/2001 |
| GB | 2374401 | | 10/2002 |
| GB | 2378117 | | 2/2003 |
| GB | 2378118 | | 2/2003 |
| GB | 2388298 | | 11/2003 |
| JP | S61006304 | | 1/1986 |
| JP | 4289602 | | 10/1992 |
| JP | H08027610 | A | 1/1996 |
| JP | H08298004 | A | 11/1996 |
| JP | H09209210 | A | 8/1997 |
| JP | H09296319 | A | 11/1997 |
| JP | H1039407 | | 2/1998 |
| JP | H10081275 | A | 3/1998 |
| JP | H10331019 | A | 12/1998 |
| JP | 2001131818 | A | 5/2001 |
| JP | 3084061 | | 2/2002 |
| JP | 3090973 | | 1/2003 |
| JP | 2004207580 | | 7/2004 |
| JP | 2004346470 | | 12/2004 |
| JP | 2005216832 | A | 8/2005 |
| JP | 2006097156 | A | 4/2006 |
| JP | 2007119980 | | 5/2007 |
| JP | 2008542558 | | 11/2008 |
| KR | 200164075 | | 2/2000 |
| KR | 200168822 | Y1 | 2/2000 |
| KR | 200168826 | | 2/2000 |
| KR | 200260980 | | 1/2002 |
| KR | 20020065405 | | 8/2002 |
| KR | 200331201 | | 10/2003 |
| TW | 241462 | | 2/1995 |
| TW | 275188 | | 5/1996 |
| TW | 286489 | | 9/1996 |
| TW | 324234 | | 1/1998 |
| TW | 329607 | | 4/1998 |
| TW | 386364 | | 4/2000 |
| WO | 9402043 | | 2/1994 |
| WO | 9704434 | | 2/1997 |
| WO | 0113033 | | 2/2001 |
| WO | 0177575 | | 10/2001 |
| WO | 0244611 | | 6/2002 |
| WO | 02062165 | | 8/2002 |
| WO | 02074398 | | 9/2002 |

(56) References Cited

FOREIGN PATENT DOCUMENTS

| | | | |
|---|---|---|---|
| WO | 02077520 | | 10/2002 |
| WO | 2003040808 | A2 | 5/2003 |
| WO | 03047377 | | 6/2003 |
| WO | 03083811 | | 10/2003 |
| WO | 2004000054 | | 12/2003 |
| WO | 2004064555 | | 5/2004 |
| WO | 2004103104 | | 12/2004 |
| WO | 2005002378 | | 1/2005 |
| WO | 2005005882 | | 1/2005 |
| WO | 2005038337 | | 4/2005 |
| WO | 2005096856 | | 10/2005 |
| WO | 2005098314 | | 10/2005 |
| WO | 2006037845 | | 4/2006 |
| WO | 2006124928 | | 11/2006 |
| WO | 2007073047 | | 6/2007 |
| WO | 2007073219 | | 6/2007 |
| WO | 2007089236 | | 8/2007 |
| WO | 2007093348 | | 8/2007 |
| WO | 2007112338 | | 10/2007 |
| WO | 2008011750 | | 1/2008 |
| WO | 2009079656 | A2 | 6/2009 |
| WO | 2010099504 | | 9/2010 |
| WO | 2011041591 | A1 | 4/2011 |
| WO | 2011100471 | A1 | 8/2011 |
| WO | 2011137400 | | 11/2011 |
| WO | 2011137406 | | 11/2011 |
| WO | 2013096895 | | 6/2013 |
| WO | 2013096904 | | 6/2013 |
| ZA | 20043826 | A | 9/2005 |

OTHER PUBLICATIONS

'Panther Vision Power Beanie—Available at Bunnings Warehouse,' screenshot of a video posted to Youtube on Jun. 16, 2014. Retrieved from the Internet on Mar. 9, 2015. URL: https://www.youtube.com/watch?v=ZOWodRoEuvc. (1 page).

'Waters Industries' Answer to Defendant's Amended Counterclaims', *Waters Industries, Inc.* v. *Outdoor Cap Co., Inc.*, United States District Court for the Northern District of Illinois, Case No. 1:13-cv-07191, 12 pages (Document No. 38, Dec. 18, 2013).

"4 LED Lighted Fleece Beanie; POWERCAP," article posted on-line to WISE-SHOP.ca. Added to the businesses catalog on Nov. 6, 2013. Retrieved from the Internet on Jun. 17, 2014. URL: http://www.wise-shop.ca/product_info.php?products_id=489.

"Answer to Complaint, Counter claims",filed by Lilian Vernon Corporation, *Waters Industries, Inc.* v. *Sweet Baby, Inc.* dba AJ Morgan et al., United States District Court for the Northern District of Illinois, Case No. 1:09-cv-07595, 15 pages (Docket No. 28, Feb. 4, 2010).

"Answer to Complaint, Counterclaims", filed by Sweet Baby, Inc. dba AJ Morgan, *Waters Industries, Inc.* v. *Sweet Baby, Inc.* dba AJ Morgan et al., United States District Court for the Northern District of Illinois, Case No. 1:09-cv-07595, 15 pages (Docket No. 27, Feb. 4, 2010).

"Complaint" with Exhibit A through D, *Waters Industries, Inc.* v. *JJI International, Inc., et al.*, United States District Court for the Northern District of Illinois, Case No. 1:11-cv-03791, 73 pages (Document No. 1, Jun. 3, 2011).

"Complaint", *Waters Industries, Inc.* v. *Kikkerland Design, Inc.*, United States District Court for the Northern District of Illinois, Case No. 1:10-cv-04076, 21 pages (Docket No. 1, Jun. 30, 2010).

"Complaint", *Waters Industries, Inc.* v. *Mr. Christmas Incorporated, et al.*, United States District Court for the Northern District of Illinois, Case No. 1:09-cv-07577, 38 pages (Docket No. 1, Dec. 7, 2009).

"Complaint", *Waters Industries, Inc.* v. *Sweet Baby, Inc.* dba AJ Morgan et al., United States District Court for the Northern District of Illinois, Case No. 1:09-cv-07595, 78 pages (Docket No. 1, Dec. 7, 2009).

"Complaint", *Waters Industries, Inc.* v. *The Gerson Company*, United States District Court for the Northern District of Illinois, Case No. 1:10-cv-01865,71 pages (Docket No. 1, Mar. 24, 2010).

"Defendants'Answer and Counterclaim" and "Responses to Specific Allegations", *Waters Industries, Inc.* v. *JJI International, Inc. and Stein Mart, Inc.*, United States District Court for the Northern District of Illinois, Case No. 1:11-cv-03791, 16 pages (Document No. 15, Jun. 28, 2011).

"Defendants' Initial Non-lnfringement and Invalidity Contentions" with Appendix A though G, *Waters Industries, Inc.* v. *JJI International, Inc. and Stein Mart, Inc.*, United States District Court for the Northern District of Illinois, Case No. 1:11-cv-03791, 78 pages (Aug. 9, 2011).

"Kikkerland Design, Inc.'s Answer to Complaint, Affirmative Defenses and Counterclaim", *Waters Industries, Inc.*v. *Kikkerland Design, Inc.*,United States District Court for the Northern District of Illinois, Case No. 1:10-cv-04076, 12 pages (Docket No. 17, Aug. 6, 2010).

"Panther Vision Powercap LED Lighted Beanie," article posted on-line and available for sale at Dick's Sporting Goods with reviews posted as early as Nov. 14, 2014. Retrieved from the Internet on Mar. 9, 2015. URL: http://www.dickssportinggoods.com/product/index.jsp?productId=52376526. (4 pages).

"Plaintiffs Initial Infringement Contentions Under Local Patent Rule 2.2" with Appendix A through F,*Waters Industries, Inc.* v. *JJI International, Inc. and Stein Mart, Inc.*, United States District Court for the Northern District of Illinois, Case No. 1:11-cv-03791, 44 pages (Jul. 26, 2011).

"Plaintiffs Initial Response to Invalidity Contentions Under Local Patent Rule 2.5" with Appendix A and B, *Waters Industries, Inc.* v. *JJI International, Inc. and Stein Mart, Inc.*, United States District Court for the Northern District of Illinois, Case No. 1:11-cv-03791, 29 pages (Aug. 23, 2011).

"Powercap Beanie," article posted on-line to Panther Vision. Publication date unknown. Retrieved from the Internet on Mar. 9, 2015. URL: http://www.panther-vision-promotional-products.com/Prod-18-1-96-10/powercap-trad e-beanie.htm. (2 pages).

"Answer and Counterclaim of Defendant Outdoor Cap Co., Inc.," *Waters Industries, Inc.* v. *Outdoor Cap Co., Inc.*, United States District Court for the Northern District of Illinois, Case No. 1:13-cv-07191, 11 pages (Document No. 13, Oct. 30, 2013).

"Complaint", *Waters Industries, Inc.* v. *Totes Isotoner Corporation, et al.*, United States District Court for the Northern District of Illinois, Case No. 1:10-cv-04487 (Docket No. 1, Jul. 19, 2010) (26 pages).

"Declaratory Judgment Complaint" with Exhibit A and Exhibit B, *Waters Industries, Inc.* v. *Outdoor Cap Co., Inc.*, United States District Court for the Northern District of Illinois, Case No. 4:13-cv-00665-CVE-FHM, 52 pages (Document No. 2, Oct. 8, 2013).

"First Amended Answer and Counterclaim of Defendant Outdoor Cap Co., Inc." with Exhibit A through G, *Waters Industries, Inc.* v. *Outdoor Cap Co., Inc.*, United States District Court for the Northern District of Illinois, Case No. 1:13-cv-07191, 201 pages (Document No. 34, Dec. 11, 2013).

"Plaintiff's Complaint" with Exhibit A, *Waters Industries, Inc.* v. *Outdoor Cap Co., Inc.*, United States District Court for the Northern District of Illinois, Case No. 1:13-cv-07191, 7 pages (Document No. 1, Oct. 8, 2013).

"Plaintiff's First Amended Complaint" with Exhibit A and Exhibit B, *Waters Industries, Inc.* v. *Outdoor Cap Co., Inc.*, United States District Court for the Northern District of Illinois, Case No. 4:13-cv-00665-CVE-FHM, 51 pages (Document No. 11, Oct. 10, 2013).

"Plaintiff's Initial Infringement Contentions Under Local Patent Rule 2.2" with Appendix A, Figures 1-5, and Exhibits 1-3, *Waters Industries, Inc.* v. *Outdoor Cap Co., Inc.*, United States District Court for the Northern District of Illinois, Case No. 1:13-cv-07191, 58 pages (Nov. 27, 2013).

"Waters Industries' Answer to Defendant's Counterclaims," *Waters Industries, Inc.* v. *Outdoor Cap Co., Inc.*, United States District Court for the Northern District of Illinois, Case No. 1:13-cv-07191, 5 pages (Document No. 28, Nov. 20, 2013).

Docket report of *Waters Industries, Inc.* v. *Kikkerland Design, Inc.*, United States District Court for the Northern District of Illinois, Case No. 1:10-cv-04076, filed Jun. 30, 2010, 4 pages.

(56) References Cited

OTHER PUBLICATIONS

Docket report of *Waters Industries, Inc.* v. *Mr. Christmas Incorporated, et al.*, United States District Court for the Northern District of Illinois, Case No. 1:09-cv-07577, filed Dec. 7, 2009, 5 pages.
Docket report of *Waters Industries, Inc.* v. *Outdoor Cap Co., Inc.*, United States District Court for the Northern District of Oklahoma, Case No. 4:13-cv-00665-CVE-FHM, filed Oct. 8, 2013 (7 pages).
Docket report of *Waters Industries, Inc.* v. *Sweet Baby, Inc.* dba AJ Morgan et al., United States District Court for the Northern District of Illinois, Case No. 1:09-cv-07595, filed Dec. 7, 2009, 7 pages.
Docket report of *Waters Industries, Inc.* v. *The Gerson Company*, United States District Court for the Northern District of Illinois, Case No. 1:10-cv-01865, filed Mar. 24, 2010, 3 pages.
Docket report of *Waters Industries, Inc.* v. *Totes Isotoner Corporation, et al.*, United States District Court for the Northern District of Illinois, Case No. 1:10-cv-04487 filed Jul. 19, 2010 (4 pages).
Extended European search report issued in the related European Application No. 08 86 2753.4 dated Dec. 7, 2012 (7 pages).
Extended European search report issued in the related European Application No. 10 18 1592.6 dated Jan. 31, 2011 (7 pages).
Extended European search report issued in the related European Application No. 10 18 1593.4 dated Feb. 1, 2011 (8 pages).
International Search Report from the International Bureau of WIPO issued in the related International Application No. PCT/US02/35665, dated Jun. 27, 2003, 1 page.
Notification Concerning Transmittal of International Preliminary Report on Patentability and the Written Opinion of the International Searching Authority from the International Bureau of WIPO for International Application No. PCT/US2013/076689, dated Jul. 2, 2015, 7 pages.
Notification of Transmittal of the International Search Report and the Written Opinion of the International Searching Authority, or the Declaration from the International Bureau of WIPO for International Application No. PCT/US2008/087542 dated May 4, 2009, 12 pages.
Notification of Transmittal of the International Search Report and the Written Opinion of the International Searching Authority, or the Declaration from the International Bureau of WIPO for International Application No. PCT/US2010/025689 dated May 4, 2010, 14 pages.
Notification of Transmittal of the International Search Report and the Written Opinion of the International Searching Authority, or the Declaration from the International Bureau of WIPO for International Application No. PCT/US2010/050978, dated Dec. 3, 2010, 16 pages.
Notification of Transmittal of the International Search Report and the Written Opinion of the International Searching Authority, or the Declaration from the International Bureau of WIPO for International Application No. PCT/US2011/024400, dated Apr. 29, 2011, 13 pages.
Notification of Transmittal of the International Search Report and the Written Opinion of the International Searching Authority, or the Declaration from the International Bureau of WIPO for International Application No. PCT/US2011/034686 dated Aug. 1, 2011, 16 pages.
Notification of Transmittal of the International Search Report and the Written Opinion of the International Searching Authority, or the Declaration from the International Bureau of WIPO for International Application No. PCT/US2011/051596, dated Jan. 18, 2012, 9 pages.
Notification of Transmittal of the International Search Report and the Written Opinion of the International Searching Authority, or the Declaration from the International Bureau of WIPO for International Application No. PCT/US2014/028613, dated Sep. 19, 2014, 13 pages.
Notification of Transmittal of the International Search Report and the Written Opinion of the International Searching Authority, or the Declaration from the International Bureau of WIPO for International Application No. PCT/US2014/028945 dated Jul. 31, 2014, 9 pages.
Notification of Transmittal of the International Search Report and the Written Opinion of the International Searching Authority, or the Declaration from the International Bureau of WIPO for related International Application No. PCT/US2011/034695 dated Oct. 28, 2011, 12 pages.
Office Action issued in related Canadian Application No. 2,466,175 dated Sep. 22, 2010 (3 pages).
Office Action issued in related European Application No. 02 778 755.5 dated Feb. 20, 2007 (7 pages).
Office Action issued in related Japanese Application No. 2010-539834 dated Mar. 19, 2013, with English translation (10 pages).
Patent Examination Report issued in related Australian Application No. 2008338320 dated Nov. 1, 2012 (5 pages).
Supplementary European search report issued in the related European Application No. 02 77 8755 dated Jan. 19, 2005 (2 pages).
Written Opinion of the International Searching Authority and International Search Report from the International Bureau of WIPO for International Application No. PCT/US2006/018968, dated Oct. 16, 2006, 12 pages.
Written Opinion of the International Searching Authority and International Search Report from the International Bureau of WIPO for International Application No. PCT/US2008/087542, dated May 4, 2009, 12 pages.

* cited by examiner

LIGHTED HEADGEAR AND ACCESSORIES THEREFOR

CROSS-REFERENCE TO RELATED APPLICATIONS

This application is a continuation of U.S. application Ser. No. 16/182,329, filed Nov. 6, 2018, which is a continuation of U.S. application Ser. No. 14/716,614, filed May 19, 2015, now U.S. Pat. No. 10,117,476, which is a continuation of U.S. application Ser. No. 13/695,417, filed Nov. 16, 2012, which is a National Stage Entry of PCT/US2011/034686, filed Apr. 29, 2011, which claims the benefit of U.S. application No. 61/330,185, filed Apr. 30, 2010, which are all hereby incorporated by reference herein in their entirety.

FIELD OF THE INVENTION

The field relates to hands-free lighting devices and, in particular, to lighted headgear and accessories therefor.

BACKGROUND OF THE INVENTION

Often an individual desires a light source focused to illuminate an area while performing a task or a light source directed in a general outward direction for visibility. Holding a flashlight is an option, but such lighting devices are often cumbersome and may detract from the task being completed because the flashlight must be held. As a result, hands-free lighting is often used because the individual desiring illumination does not need to hold the light source. Common types of hand-free lighting include light sources mounted to headgear or eyeglasses.

Lighted headgear may include illumination sources mounted to hats. Often the light source is oriented outwardly in such a manner so that the wearer can be seen by others or oriented downward to provide light forwardly of the wearer so as to illuminate an area in the wearer's field of view. Applicant's U.S. Pat. No. 6,659,618 provides one example of such lighted hats. Often, the light source is one or more LEDs. Such LED lighted headgear, which may include LEDs mounted to a typical baseball-style cap, are convenient for hands-free lighting in a number of recreational activities, such as camping, hunting, fishing, jogging, or the like.

DETAILED DESCRIPTION OF THE PREFERRED EMBODIMENTS

In general, the lighted hats or other headgear described herein include a variety of different illumination sources, which are preferably LEDs, mounted on different locations on the hat. To energize these illumination sources, a variety of different power assemblies are also disclosed that employ varying mechanisms to generate energy. For instance, the power generators may use traditional batteries or renewable energy, such as solar, wind, or kinetic energy, to generate electrical power that ultimately energizes the variety of light sources that may be included on the disclosed hats. Examples of power generators may be those described in co-pending application Ser. No. 11/941,558, which is incorporated herein by reference in its entirety. While the following description and illustrations may describe a specific power assembly and illumination source with a specific hat and lighting configuration, the various components described herein may be included in any of the hat embodiments. In addition, while the preferred headgear is a baseball-type cap, the power assemblies and illumination sources may also be mounted to any suitable headgear, such as visors, helmets, caps, hats, headbands, sweatband, hoods, clothing, or the like.

Figure 1:
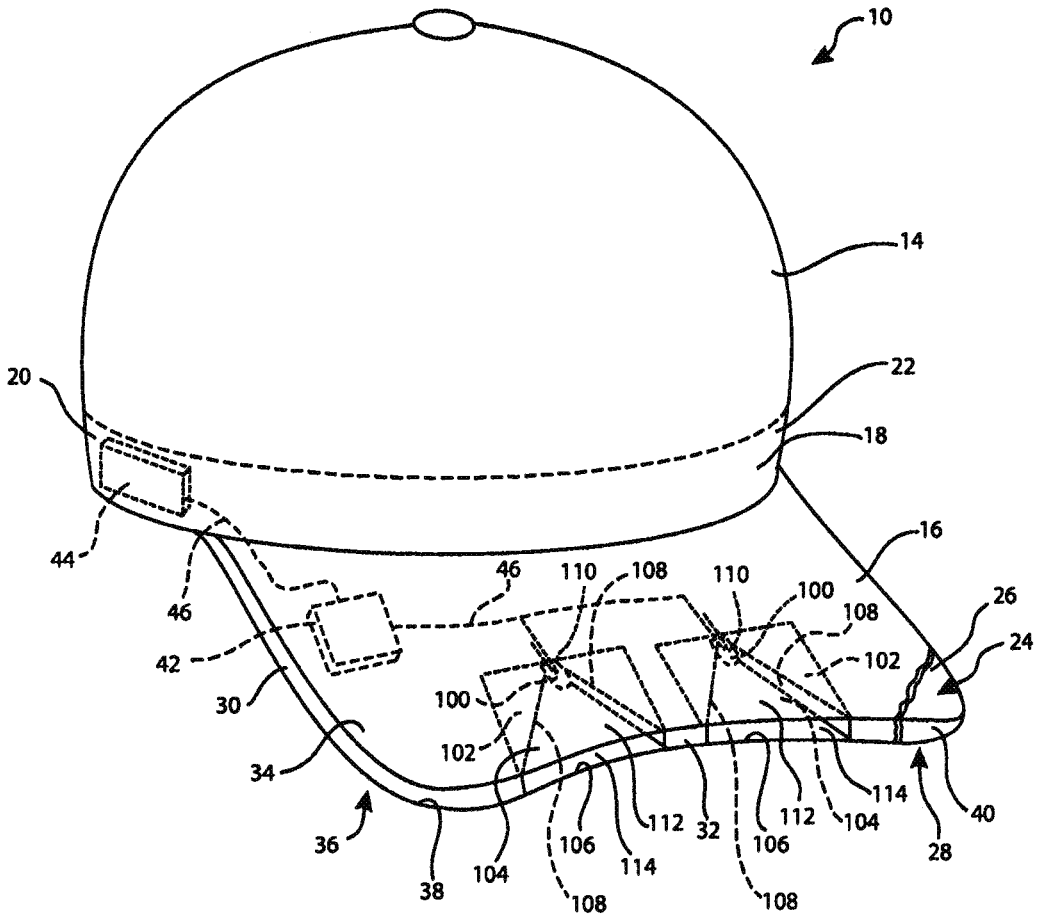
FIG. 1 is a perspective view of a lighted hat having a pair of LEDs recessed in a brim with cut-out portions in the brim forwardly of the LEDs to provide illumination in a forward direction.

As described herein, the lighted headgear is described as an exemplary lighted hat 10 such as that illustrated in FIG. 1 as a baseball-type cap having a crown 14 and a brim 16 projecting forwardly from a lower, forward edge 18 of the crown 14. In some forms, the hat 10 may further include a hat band 20 disposed around a lower edge portion 22 of the inside of the hat 10. The hat band 20 may be composed of an elastic and/or wicking material to conform the crown 14 more closely to a wearer's head and/or wick moisture away from the wearer's head.

Referring now to more details of an exemplary hat, the brim 16 includes an upper major surface 26, a lower major surface 28 and a brim insert 24 having side edges 30 and a front edge 32. An upper and lower covering 34, 36, such as a fabric covering, may be disposed across the upper and lower major surfaces 26, 28 of the brim insert. The upper and lower coverings 34, 36 may be joined together, such as by stitching, adhesive, or the like, at a perimeter edge 38 of the brim 16 with narrow piping material or other fabric material 40. The hat 10 may further include a switch 42, including, for example, a pushbutton switch, a slide switch, a rotary switch, or the like, disposed on a portion of the hat 10, such as one of the upper or lower major surfaces 26, 28, upper or lower covering portions 34, 36, the perimeter edge 38, or on other portions of the crown 14. The hat 10 may also include a power source 44, which is illustrated as a battery pack stored in the hat band 20 of the crown 14. The power source 44 may also be located in other portions of the hat. Electrical connections 46 span between the power source 44, the switch 42, and other lighted hat components, such as light sources, to provide power thereto.

Figure 2:
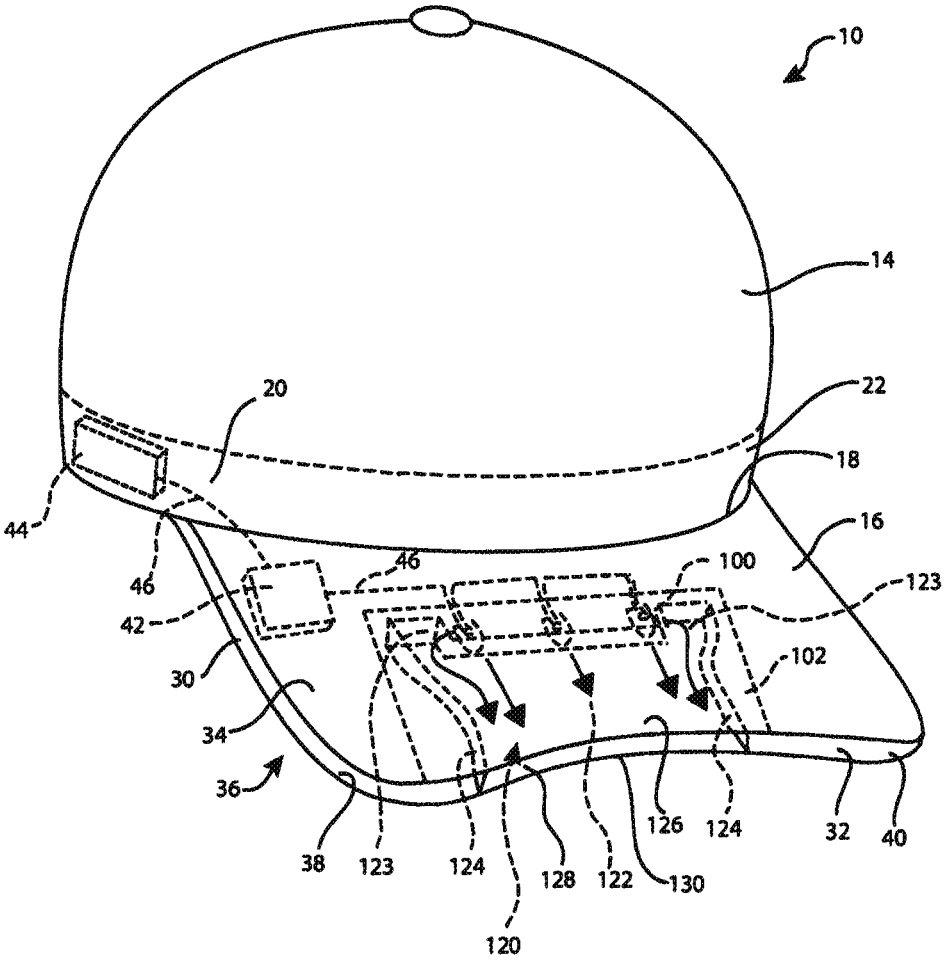
FIG. 2 is a perspective view of a lighted hat having a plurality of LEDs recessed in a brim with light transmissive material forwardly thereof to provide illumination in a forward direction.
Figure 3:
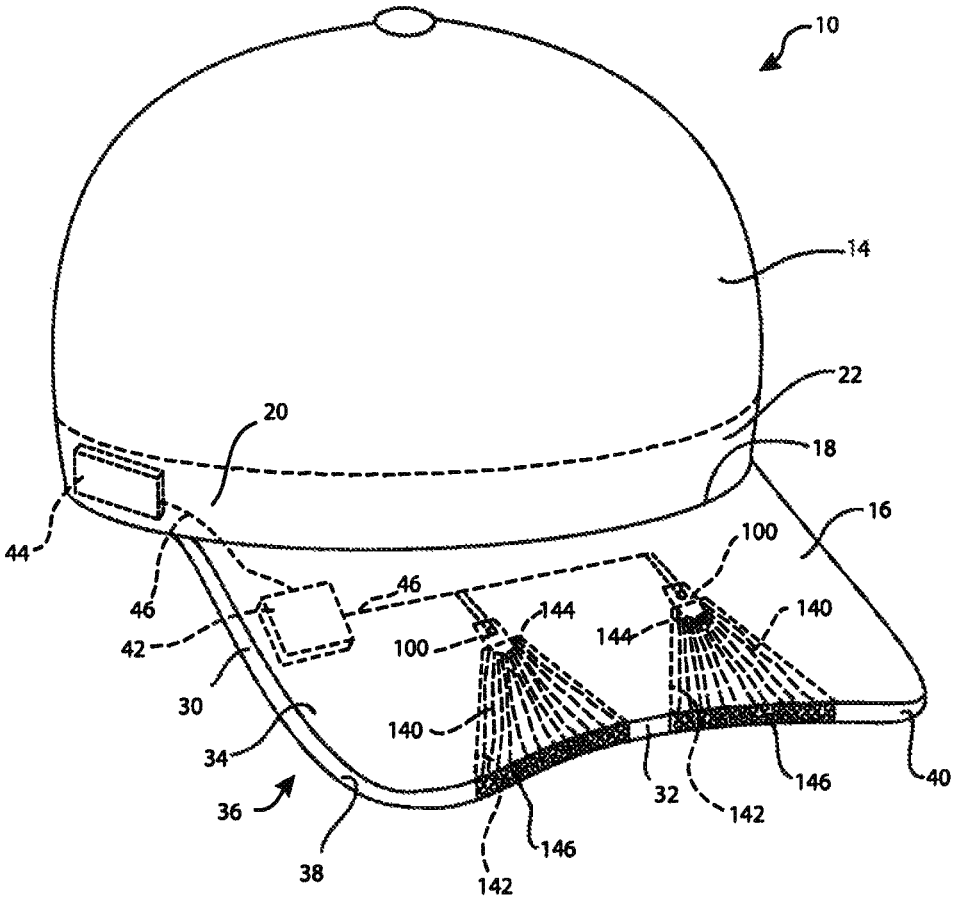
FIG. 3 is a perspective view of a lighted hat having a pair of LEDs recessed in a brim with fiber optics forwardly thereof to provide illumination in a forward direction.

Referring now to FIGS. 1-3, in this approach of the lighted hats 10, one or more light sources 100 may be recessed into the brim 16 and spaced from the perimeter edge 38 while generally aligned to direct light forwardly towards the front edge 32 of the lighted hat 10 to project light forwardly of a wearer. As illustrated, the light sources 100 are LEDs disposed at least partially between the upper and lower major surfaces 26, 28 of the brim insert 24. The upper and lower covering portions 34, 36 can then be disposed above and below the light sources 100 to conceal the light sources 100 from view, which preserves the appearance of traditional hat brims. By one approach, the upper and lower covering portions 34, 36 can include thicker portions 102 (see FIGS. 1 and 2) configured to at least partially cover areas adjacent and over the light sources 100, so that light emitted from the light sources 100 substantially does not shine through the covering portions 34, 36 to conceal the presence of the light sources 100 and/or prevent stray light from shining through the fabric of the covering portions 34, 36 into the eyes of a wearer of the lighted hat, from causing unsightly lighted portions of the upper or lower covering portions 34, 36, and/or from causing a glare if a wearer of the lighted hat is also wearing glasses. The thicker portions 102 may further be composed of or include a heat sink material, such as aluminum, tin, or other conductive material, so that heat generated by the light sources 100 can be dissipated across a larger area of the brim 16.

In one form, the light sources 100 include a pair of LEDs and are recessed from the front edge 32 of the brim 16 in a brim cavity. In this form and as shown in FIG. 1, the brim insert 24 includes a cavity that may be in the form of generally triangular shaped cut-out portions 104. In one form, the cavity is defined by generally rectangular shape forward openings 106 within the front edge 32 and side walls 108 extending away from the front edge 32 and inclined or tapering inwardly to an apex 110 where the light sources 100 are disposed. The cut-out portions 104 may extend from the lower major surface 26 to the upper major surface 28, or extend entirely through the brim insert 24. By one approach, the side walls 108 can include a reflective coating or material disposed thereon to reflect light forwardly, which may maximize the amount of the light shining forwardly of the wearer. The reflective coating or material can further be disposed on upper and/or lower surfaces 112, 114 of the cut-out portions 104, whether the upper and lower surfaces 112, 114 are the upper and lower covering portions 34, 36 or a portion of the brim insert 24. The light sources 100 are then electrically connected to the switch 42 and/or the power source 44 to be powered and/or controlled thereby. So configured, the light sources 100 are concealed from view and the lighted hat 10 maintains the appearance of a traditional hat while also providing lighting forwardly of a wearer.

In FIG. 2 another form of a lighted hat is shown. In this approach, the light sources 100 include one or more, and preferably three, LEDs recessed from the front edge 32 of the brim 16. In this form, the brim insert 24 includes a cavity or cut-out portion 120 having a light transmissive material or portion 122 disposed therein. The light transmissive material or portion 122 may be a light pipe or light cavity lined with a reflective material that focuses or combines the light emitted by the LEDs 100 while also minimizing loss of light along its length so that a maximum amount of light projected from the recessed light sources 100 is projected forwardly of the lighted hat 10. The light transmissive material or portion may also be a light conducting material that transports light therethrough similar to fiber optic cables. The light transmissive material may be constructed of silica glass, fluoride glass, phosphates, and/or other light transporting materials. The light material 122 is disposed forwardly of the light sources 100 and may include side portions 123 disposed laterally adjacent the LEDs 100 to redirect or transmit through substantially all of the light emitted from the light sources 100. Sides 124 and/or top and bottom surfaces 126, 128 of the light pipe 122 may include a reflective coating or material disposed thereon to reflect light forwardly out of an opening 130 of the light pipe 122 disposed in the front edge 32 of the brim 16. The light pipe 122 may be disposed between the upper and lower major surfaces 26, 28, may extend from one of the upper or lower major surfaces 26, 28, or may extend entirely through the brim insert 24. The light sources 100 are electrically connected to the switch 42 and/or the power source 44 to be powered and/or controlled thereby. So configured, the light sources 100 are concealed from view and the lighted hat 10 maintains the appearance of a traditional hat while also providing lighting forwardly of a wearer.

In FIG. 3 another form of lighted hat is illustrated. In this form, the light sources 100 include a pair of LEDs recessed from the front edge 32 of the brim 16. In this form, one or a plurality of optical fibers 140 are disposed between the light sources 100 and the front edge 32 of the brim 16 to transport light emitted from the light sources 100 and project the light forwardly of the lighted hat 10. The optical fibers can include a core, a cladding layer, and a buffer coating layer. The core can be composed of silica, or other suitable materials, such as fluorozirconate, fluoroaluminate, and chalcogenide glasses. The cladding layer has a lower refractive index that traps light in the core through total internal reflection. The buffer protects the cladding from moisture and physical damage. The cladding and buffer coating may be UV-cured urethane acrylate composite materials. Two or more coating layers may also be utilized. By one approach, the brim insert 24 can include a cavity 142, which is shown as an exemplary generally triangular shaped cut-out portion, configured to house the optical fibers 140 therein. By another approach, the optical fibers 140 may be fed through tunnels in the brim insert 24, be supported on the brim, or be embedded therein. The optical fibers 140 have a first end 144 adjacent the light sources 100 and a second end 146 adjacent the front edge 32 of the brim 16, where the second ends 146 are preferably spaced along a predetermined length of the front edge 32 of the brim so as to project light to a range of areas forwardly of the lighted hat 10. By one approach, a portion of or all of the second ends 146 of the optical fibers 140 may further be housed within the brim 16 canted at an angle relative to the brim longitudinal axis B so as to project light to an area forwardly and downwardly of the brim 16, such as to a reading or working area of a wearer of the lighted hat 10. The light sources 100 are electrically connected to the switch 42 and/or the power source 44 to be powered and/or controlled thereby. So configured, the light sources 100 are concealed from view and the lighted hat 10 maintains the appearance of a traditional hat while also providing lighting forwardly of a wearer.

Figure 4:
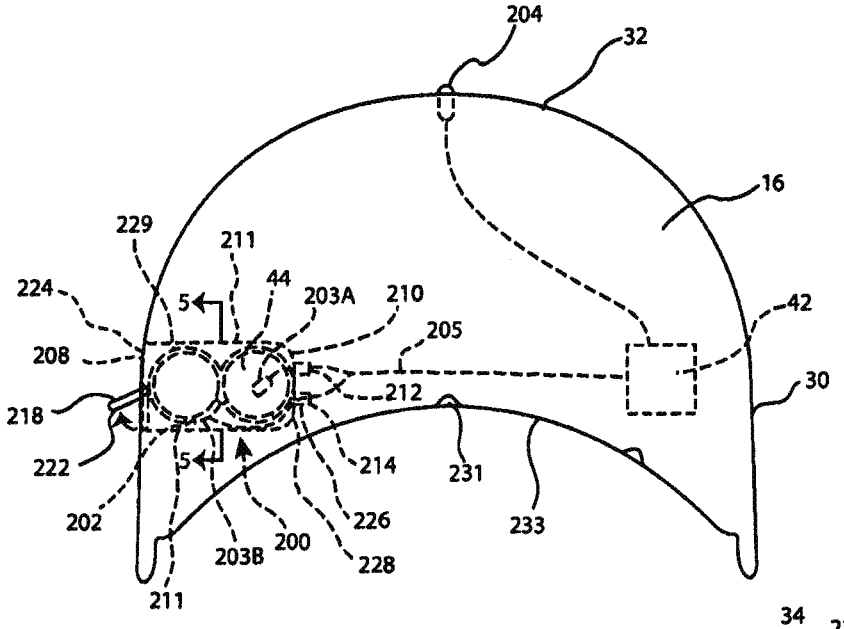
FIG. 4 is a top plan view of a brim for a lighted hat having a power module received therein.
Figure 5A:
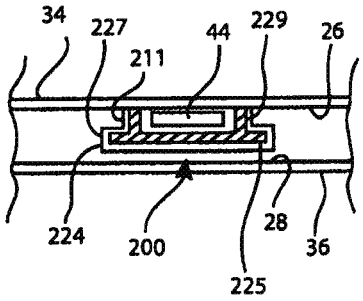
FIG. 5A is a cross-sectional side view of a portion of a brim showing an alternative power module within the brim.
Figure 5:
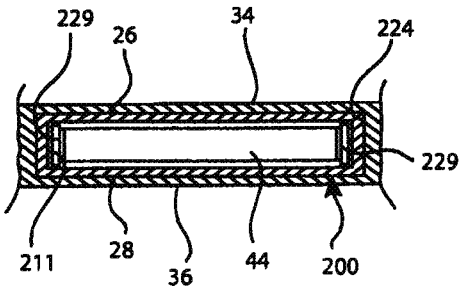
FIG. 5 is a cross-sectional view of a portion of the brim of FIG. 4 taken along the line 5-5 showing the power module within the brim.
Figure 4A:
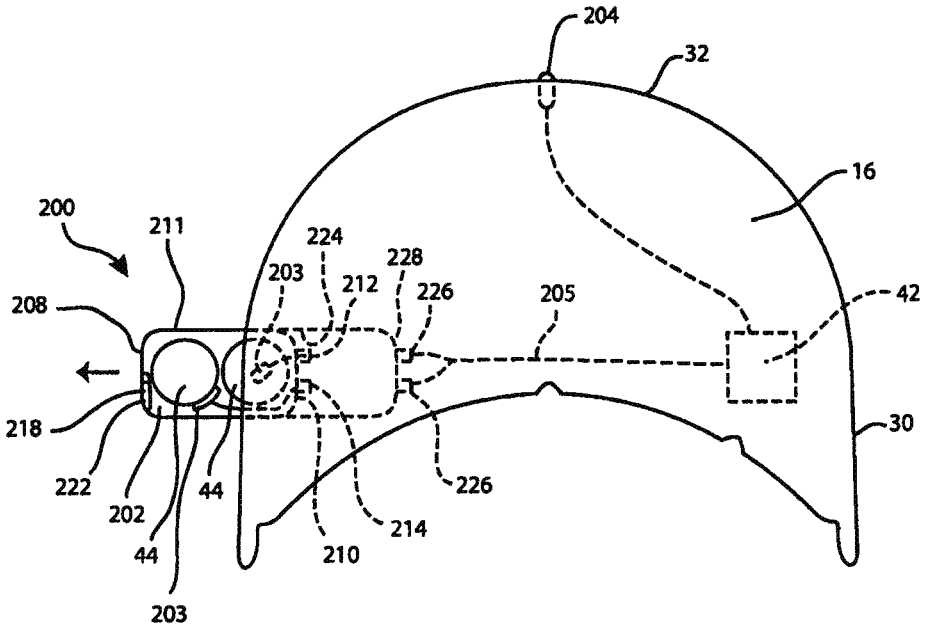
FIG. 4A is a top plan view of the brim of FIG. 4 showing the power module in a partially removed state.

Referring now to FIGS. 4, 4A, and 5, a power module 200 is illustrated for the lighted hat 10. The power module 200 includes a compact housing 202 configured to house the power source 44 therein, such as one or more coin-cell batteries. The batteries can be oriented in the housing 202 in a longitudinal side-by-side relation, a stacked relation, or an overlapping relation. The power module further includes a pair of contacts 203 (i.e. 203A and 203B) configured to contact the power source 44 to transfer energy therefrom along electrical connections 205. The power module 200 is configured to be housed at least partially within the brim 16 in a movable relation thereto, such that the light module 200 can be manipulated to a position to replace the batteries.

In one form as illustrated in FIGS. 4 and 4A, the power module 200 is a sliding drawer system disposed in the brim 16 through one of the edges 30, 32, and preferably one of the side edges 30. The module 200 is slidable between a stored or use configuration as shown in FIG. 4 and a removed configuration as shown in FIG. 4A. FIG. 4A shows the module 200 being slidably removed from the brim 16. The module 200 of this form includes a drawer housing 202 sized to hold or having pockets therein to receive a pair of side-by-side coin cell batteries configured to provide power to a light source 204, such as disposed in the front edge 32 of the brim 16, through the switch 42, which controls the power to the light source 204. The module 200 includes the drawer 202 having a first end 208 and a second end 210 connected by side edges 211. The first end 208 is configured to be disposed at the side edge 30, or alternatively, the front edge 32, of the brim 16 and the second end 210 configured to be inserted into a cavity formed in the brim 16. The second end 210 may further include a plug 212 having a pair of prongs 214 configured to plug into the brim in order to electrically connect the power source 44 to electrical connections 205 in the brim 16 connected to the light source 204 and the switch 42.

The first end 208 of the module 200 may include a latching mechanism 218 thereon configured to secure the module 200 into the brim 16. As illustrated, the power module 200 is disposed generally perpendicular to the side edge 30 of the brim 16, however, the power module 200 can also be disposed at an angle to the edges 30, 32 of the brim 16. As illustrated, the latching mechanism 218 includes a pivotable lever 222 configured to pivot to a latching position relative to the brim 16, so that the module 200 is locked to the brim 16; however, other latching mechanisms can also be utilized, such as a tongue-and-groove or snap-fit mechanisms.

The brim 16 of this form includes a cavity or cut-out portion 224 sized to receive the module or drawer 200 therein. The cut-out portion 224 may be disposed between the upper and lower major surfaces 26, 28 of the brim 16 as shown in FIG. 5, may extend inwardly to the brim from one of the upper or lower major surfaces 26, 28 as shown in FIG. 5A, or may extend entirely through the brim insert 24. In the form where the cutout extends entirely through the brim insert 24, the module 200 may include outwardly projecting rims extending at least partially between the first and second ends 208, 210 configured to restrict movement of the module 200 in a vertical direction. The cut-out portion 224 includes cavities 226 at a distal end 228 thereof configured to receive the prongs 214 of the plug 212 therein. As shown in FIG. 5, the cut-out portion 224 is preferably sized to tightly receive the module 200 therein so that the batteries 44 can be reliably constrained in a vertical direction and held in electrical contact with the face contact 203A. Similarly, the module 200 may include a wall or bay 229 to at least partially encircle the batteries 44 to constrain the batteries 44 in a horizontal direction and hold the battery against the sidewall contact 203B. In one form as illustrated in FIG. 5A, the module 200 may further include an outwardly projecting slide or flange 225 that can be received within side portions 227 of the recess 224. By inserting the flange 225 into the side portions 227, the module is vertically constrained within the brim 16.

This configuration advantageously provides a concealed battery compartment in the brim to power the lighted hat 10, which can include, for example, the LED 204 mounted to the front edge 32 of the brim 16 connected to the switch 42. Additional or alternative LEDs could be mounted to the upper or lower major surfaces 26, 28 of the brim 16 or along other portions of the front edge 32 or the side edges 30 of the brim 16.

By one approach, the brim 16 of FIGS. 4 and 4A can be a separate component for the lighted hat 10. The brim can include a locator notch 231 along a rear edge 233 of the brim 16. The locator notch 231 can then be utilized to correctly position the brim 16 on the crown 14 of the hat 10, such as by a corresponding protuberance provided on the forward, lower edge 18 of the crown 14. When the protuberance seats within the locator notch 231 a person assembling the hat 10 will know that the brim 16 is correctly positioned on the circumference of the hat 10. Similarly, a wire notch 235 can also or alternatively be provided on the rear edge 233 of the brim 16. The wire notch 235 can act as a wire relief, allowing wires or other electrical conduits or components to pass between the upper and lower major surfaces 26, 28 of the brim 16 adjacent the crown 14 rather than requiring a separate opening or bore within the brim 16.

Figure 6:
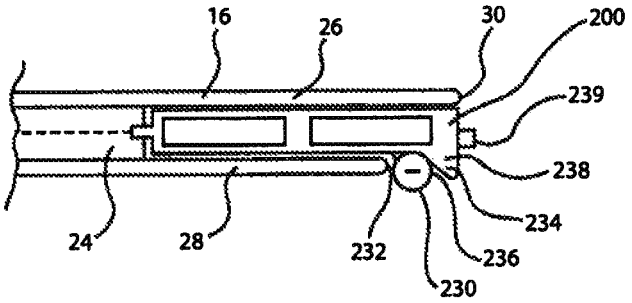
FIG. 6 is a cross-sectional side view of a brim for a lighted hat having a power module therein with a light source mounted to a bottom surface thereof to provide illumination in a forward direction.
Figure 7:
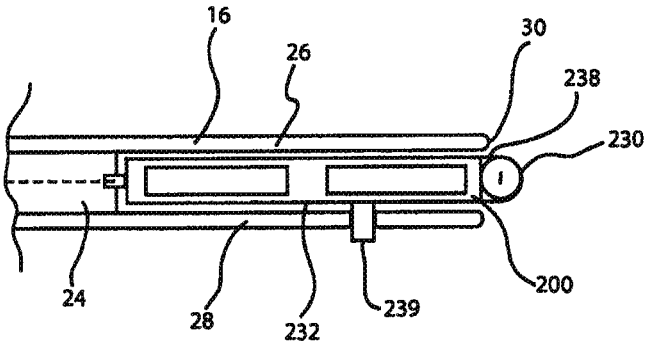
FIG. 7 is a cross-sectional side view of a brim for a lighted hat having a power module therein with a light source mounted to an outer edge outside surface thereof to provide illumination in a forward direction.
Figure 8:
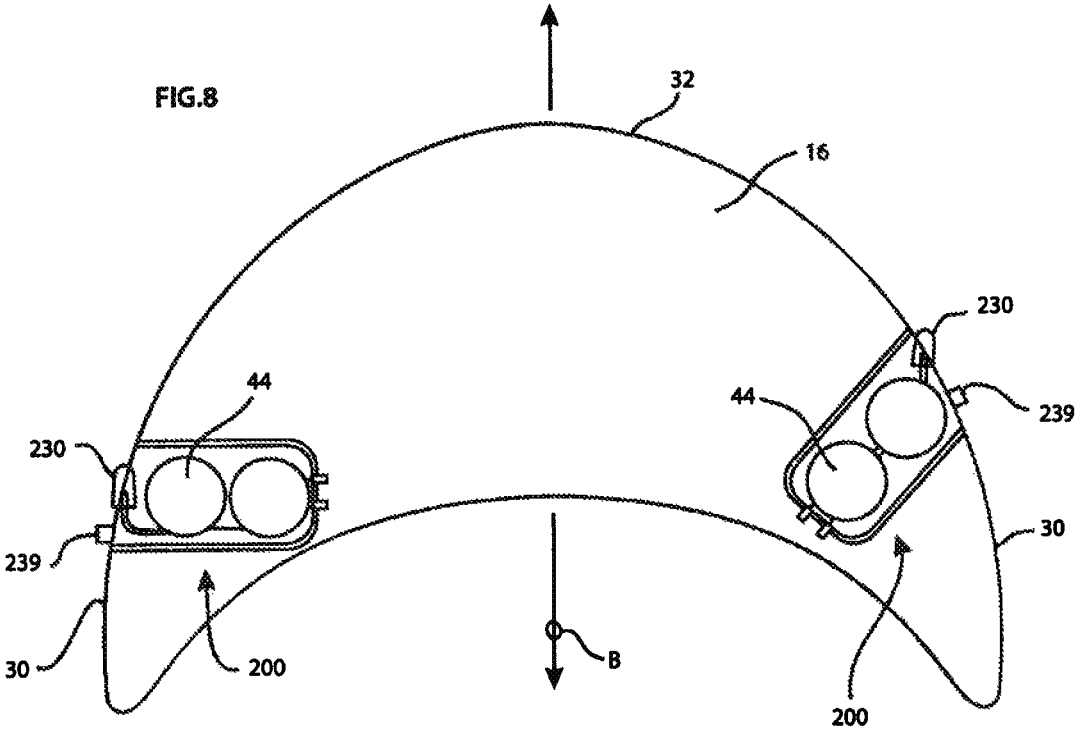
FIG. 8 is a top plan view of a brim for a lighted hat having two configurations for a lighted power module to be received within the brim.
Figure 9:
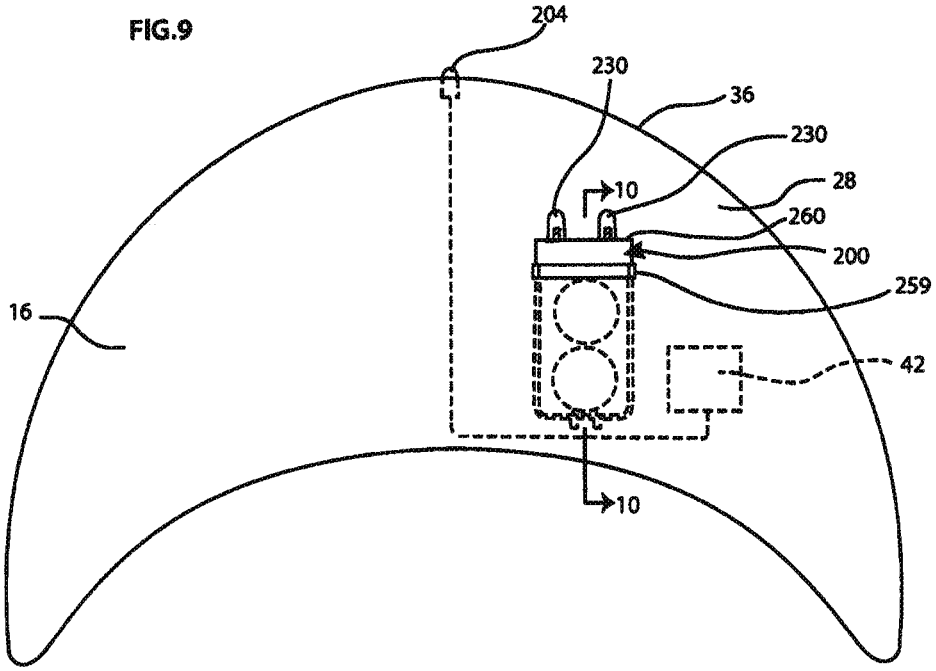
FIG. 9 is a bottom plan view of a brim for a lighted hat having a lighted power module received through a bottom surface thereof to provide illumination in a forward direction.

Alternative power modules 200 are shown in FIGS. 6-8. In these embodiments, the power modules 200 may be self-contained units that further include one or more light sources 230 attached thereto. By one approach, the light source 230 is mounted to a bottom surface 232 of the module adjacent an outer portion 238 of the power module 200 as shown in FIG. 6. The power module 200 in this approach can further include a downwardly projecting lip 234, which can be utilized to shield outwardly projecting stray light and/or protect an outer surface 236 of the light source 230. By another approach as shown in FIG. 7, the light source 230 is mounted to the outer portion 238 of the power module 200. The light source 230 can also be mounted so that it projects outwardly from the brim edge 30, 32 or can alternatively be mounted between the upper and lower major surfaces 26, 28 of the brim 16, which would require a cut-out portion in the brim insert 24 forward of the light source 230. FIG. 8 illustrates the power module 200 in both a generally perpendicular orientation to the brim axis B and an angled orientation to the brim axis B. The light source 230 may be mounted to the either on the outer surface 236 or the bottom surface 232 of the power module in either orientation to project light forwardly of the lighted hat 10.

The light sources 230 of the power modules 200 of the forms illustrated in FIGS. 6-8 can also be controlled by a switch 239. The switch may be a slide switch, rotary switch, a push button switch, or the like. By one approach, the switch 239 can be mounted to the outer or bottom surface 238, 232 and electrically connected to the power source 44 and the light source 230 as shown in FIGS. 6 and 7. By another approach, a separate switch 42 mounted to an adjacent portion of the brim 16 can be electrically connected to the power source 44 in the power module 200 and the light source 230 to control electricity provided to the light source 230, an example of which is shown in FIG. 4.

Figure 10:
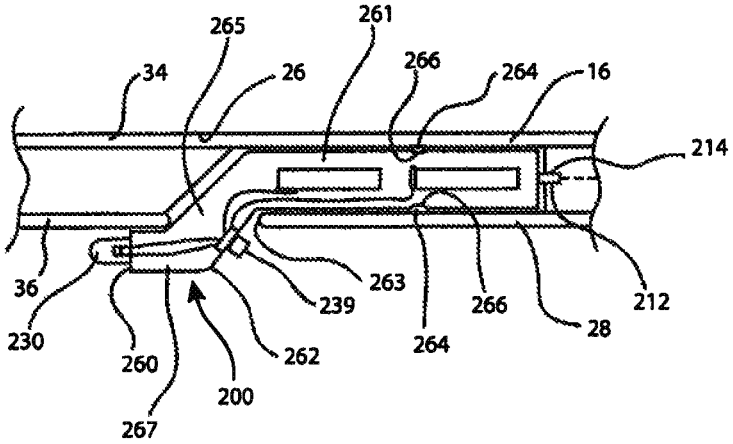
FIG. 10 is a cross-sectional side view of the lighted power module of FIG. 9 taken along the line 10-10.
Figure 10A:
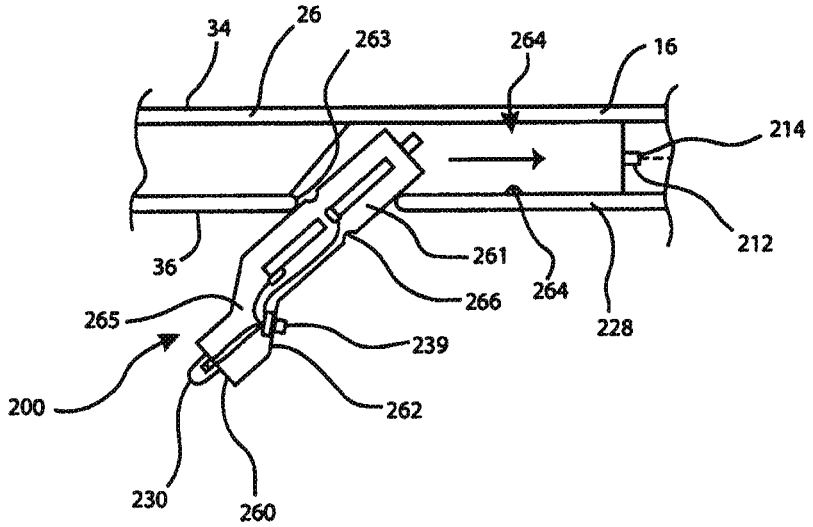
FIG. 10A is a cross-section side view of the lighted power module of FIG. 10 showing the lighted power module in a partially removed state.

By another approach, the module 200 can be mounted to the brim 16 through the upper or lower major surfaces 26, 28 thereof. As shown in FIGS. 10,10A, the module 200 is removably inserted through an opening 263 in the lower major surface 28 of the brim 16. In this form, the module 200 includes a brim portion 261 configured to house the power source 44, a downwardly projecting intermediate portion 265 that projects through the opening 259, and a forwardly direct end portion 267. The intermediate portion 265 is shown as inclined to the brim axis B, but can be generally perpendicular to the brim axis B. Additionally, the intermediate portion 265 may include arcuate transitions with the brim portion 261 and the end portion 267.

In this form, the module 200 includes two light sources 230 on a forward surface 260 thereof to direct light forwardly of the lighted hat 10. As discussed above, the module 200 may include the attached switch 239, may include the separate switch 42, or both.

In this form, the attached switch 239 can be mounted to a downwardly depending wall 262, which advantageously avoids putting the switch into a wearer's field of view while still providing easy access to manipulate the switch 239 with a finger or thumb. In the form where the module 200 provides power to other components, the module 200 can include the plug 212 with the prongs 214. Additionally, the lighted hat 10 can include additional light sources 204 mounted to the brim edge 30, 32, upper and/or lower major surfaces 26, 28 of the brim 16, or a combination thereof.

In order to insert the module 200 of this form into the brim 16, the brim 16 lower major surface 28 includes the opening 263 therein where the brim insert 24 is removed from the opening 263. The module 200 can then be inserted and removed from the opening 263 as needed, such as to replace batteries, utilize the module 200 as a hand held light source, or the like. In order to secure the module 200 within the brim 16, the brim 16 can further include one or more inwardly projecting protrusions or detents 264 configured to sit within recesses 266 provided on the module 200. Alternatively, the recesses could be provided on the brim 16 and the module 200 could include the protrusions. The protrusions/detents provide a tactile indication of a properly received module.

Figure 11:
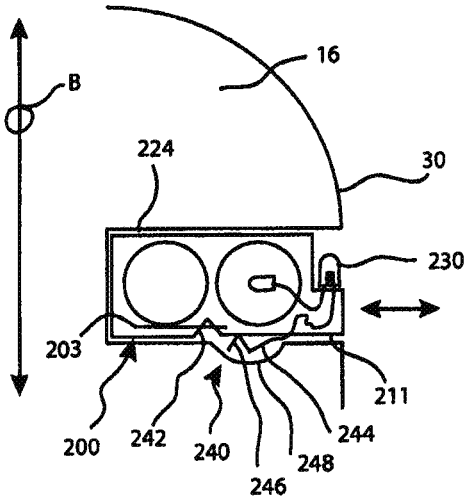
FIG. 11 is a fragmentary sectional top plan view of a brim for a lighted hat having a lighted power module received therein with a slide contact mechanism in a first position with the power module in an off condition.
Figure 12:
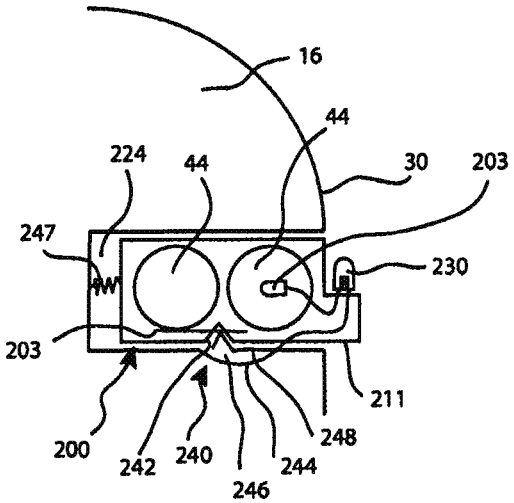
FIG. 12 is a fragmentary sectional top plan view of the brim of FIG. 11 showing the lighted power module and the slide contact mechanism in a second position with the power module in an on condition.

In yet another embodiment, illustrated in FIGS. 11-12, the power module 200 may further include a push button mechanism, slide contact, or the like, so that the entire power module 200 itself can be manipulated to energize/de-energize the light source 230 rather than utilizing a separate switch either on the hat or module. In one form, the entire power module 200 is a slide switch mechanism 240. In this form, the entire power module 200 is configured to shift or slide relative to the hat brim 16, such as in a direction generally transverse to the brim axis B, from a stored or closed position where the module 200 is concealed within the brim 16 (FIG. 11) to an open or use position where the light source 230 is positioned outwardly of the brim edge 30, 32 to shine light forwardly of the lighted hat 10 (FIG. 12). So configured, shifting the module 200 to the use position energizes the light source 230.

To establish an electrical circuit with the push button module, the module 200 may include a notch or recess 242 on the side edge 211 thereof and one of the electrical contacts 203 is exposed within the area created by the module notch 242. A biased secondary electrical contact 244, which is biased inwardly generally toward the module 200, is mounted to the brim 16 along an inner edge of the cut-out portion 224 of the brim 16. The secondary contact 244 is electrically connected to the light source 230, such as with wires connected to a lead of the light source 230. The secondary contact 244 includes a protuberance or protrusion 246 that is generally complementary to the notch 242. When the entire module 200 is slid or otherwise translated to the use position, the secondary contact 244 slides along the edge 211 of the module until reaching the notch 242 at which point the inward biasing force of the secondary contact 244 forces the protrusion 246 into the notch 242 to electrically contact the contact 203. This completes the circuit to between the power source 44 and the light source 230 and turns on the light source 230 (the other lead of the light source is electrically connected to one of the batteries 44, at 203). When the module 200 is in the closed position, the protrusion 246 contacts one of the side edges 211 of the module 200, so the cut-out portion 224 of the brim 16 is expanded to include a bay or depression 248 configured to house the secondary contact 244 therein (FIG. 12). So configured, a user of the lighted hat 10 can slide the module 200 outwardly until the secondary contact 244 enters the notch 242 to complete the circuit, which can also generally secure the module 200 in place. As this lateral position, the light source 230 is exposed outwardly of the side edge 30 of the brim 16 and is thus positioned to project light forwardly of the lighted hat 10. So that the entire module 200 may function as a push button switch, a biasing member or spring 247 may be employed in the brim cavity 224.

An alternative to the slide switch mechanism 240 utilizing the secondary contact 244 can utilize a pushbutton mechanism. In this form, the module 200 would be configured to translate between the use the configuration and the stored configuration. The pushbutton mechanism is configured to complete a circuit between the power source 44 and the light source 230 when the module 200 is pushed and translates out to the use configuration. When a user desires to turn off the light source 230, pushing the module 200 back into the brim 16 to the stored configuration actuates the pushbutton mechanism to disconnect the circuit to stop power flow to the light source 230.

Figure 13:
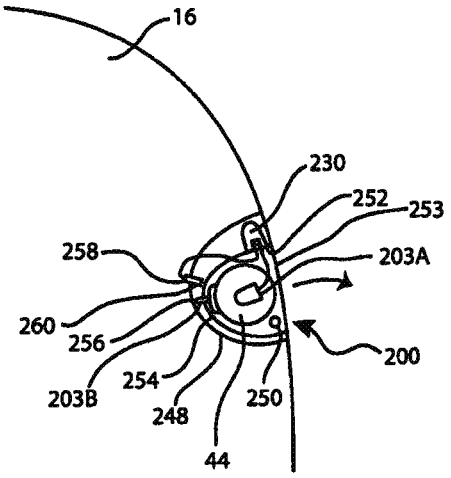
FIG. 13 is a fragmentary view of a brim for a lighted hat having a lighted power module rotably received therein in a first rotary position with the LED in a stowed and off configuration.
Figure 14:
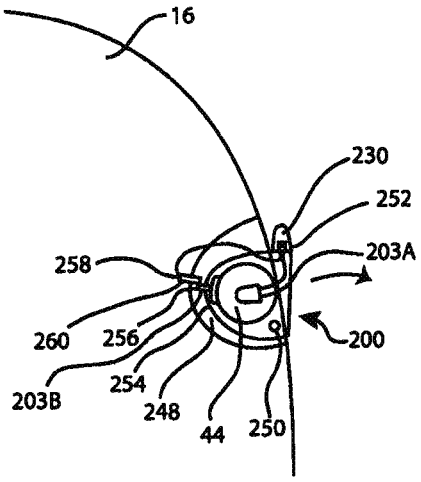
FIG. 14 is a fragmentary sectional top plan view of the brim of FIG. 13 showing the lighted power module in a second rotary position with the LED in a use configuration.

In yet another form illustrated in FIGS. 13-14, the power module 200 can be rotatable or pivotable between the stored position where the module 200 is concealed within a bay or recess 248 in the brim 16, such as in the brim insert 24 (FIG. 13), and the use position where the module is pivoted so that the light source is configured to project light forwardly of the lighted hat 10 (FIG. 14). Rotation or turning of the power module 200 energizes and de-energizes the light source 230. In this form, the power module is mounted to the brim 16 in a pivotable relation by a pin or pivot point 250. The module 200 is sized and configured to store the power source 44 therein, such as a coin cell battery or a pair of coin cell batteries in a side-by-side, overlapping, or stacked relation.

The light source 230 may be mounted to a forward edge 252 of the module 200 to shine light forwardly of the lighted hat 10 when pivoted to the use position of FIG. 14. As shown, one of the contacts 203A is electrically connected directly to the light source 230, such as through wiring or the like 253. The other contact 203B is a movable electrical contact that projects or extends from an interior edge 254 of the module 200 to form an abutment contact 256. The light source 230 is also connected to a stationary or secondary contact 258 mounted to the brim 16. The secondary contact 258 projects into the bay 248 to provide a stop surface 260 that is configured to intersect the path of the abutment contact 256 of the module 200 as the module 200 is rotated to the use position. When the module 200 is pivoted to the use configuration of FIG. 14, the abutment contact 256 of the hat brim 16 engages or is in touching relation to the secondary contact 258 on the module so that an electrical circuit is completed between the power source 44 and the light source 230 so that the light source 230 is energized to shine light forwardly of the lighted hat 10. The pivot 250 may further include a locking mechanism configured to releasably lock the module 200 in the use configuration so that the module 200 stays in the use configuration rather than be able to freely rotate. As with the prior embodiment, a biasing mechanism may be employed to help aid in shifting the module between the stowed and use configurations.

Figure 15:
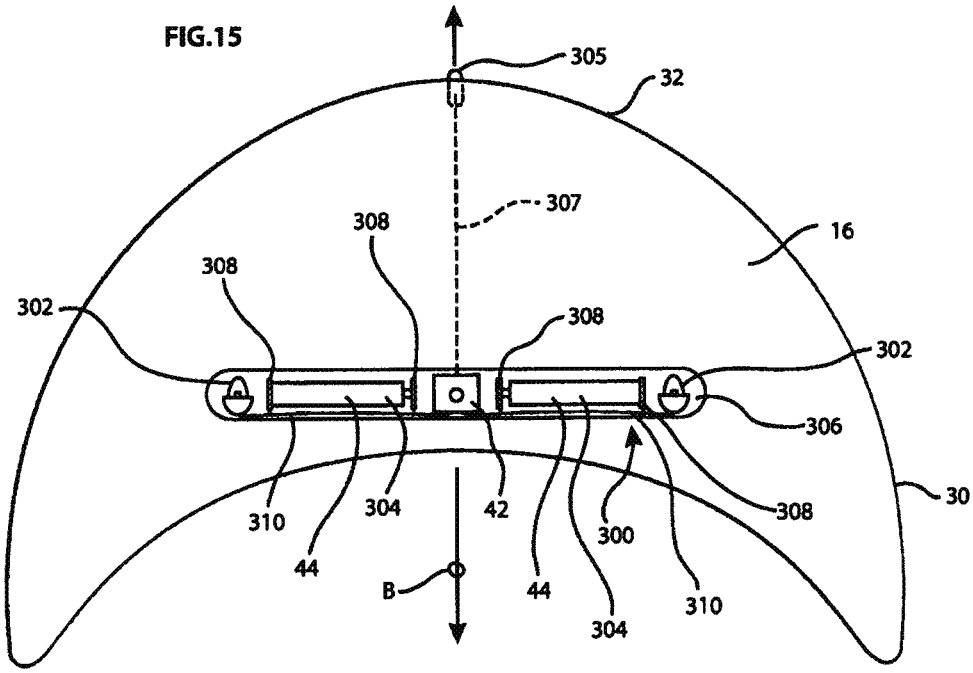
FIG. 15 is a top plan view of a brim for a lighted hat showing a pair of light sources, a power source, and a switch received within a brim compartment.
Figure 16:
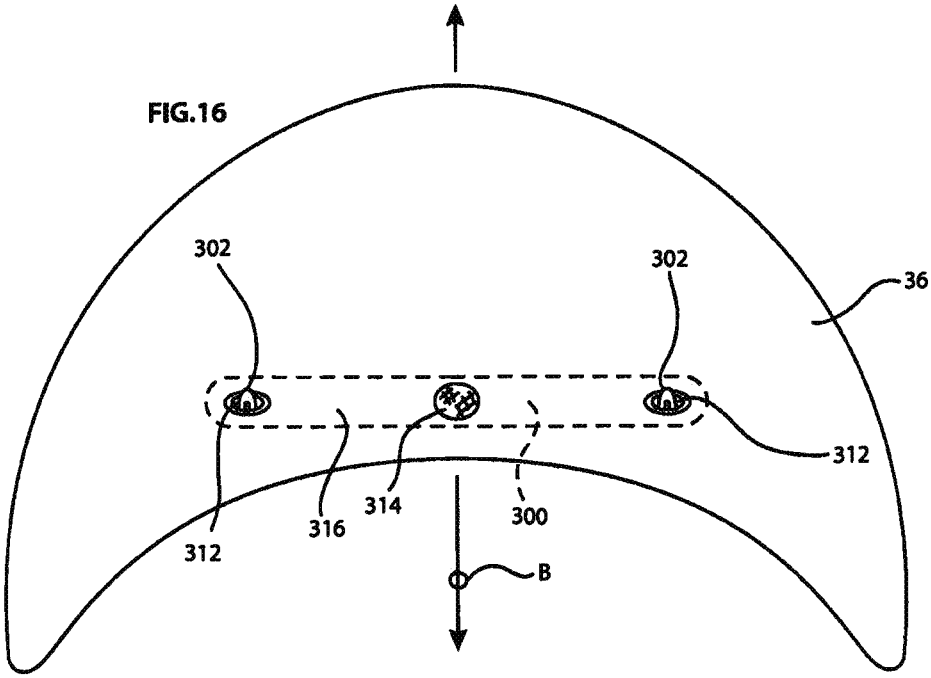
FIG. 16 is a top plan view of the brim of FIG. 15 showing the compartment covered by fabric with openings for the light sources and an indicator portion for the switch.
Figure 17:
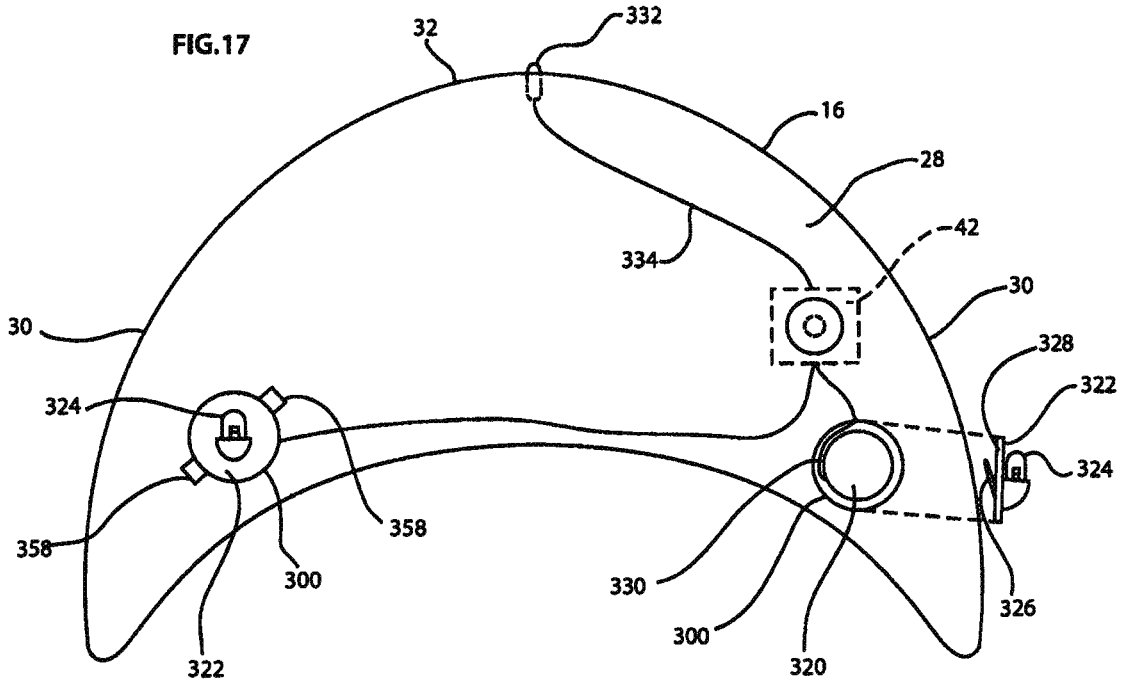
FIG. 17 is a top plan view of a brim for a lighted hat showing a pair of battery compartments having lighted covers.

Turning now to FIGS. 15-17, a brim battery compartment 300 having one or more light sources 302 associated therewith is shown. The light sources 302 can be mounted within the battery compartment 300 as shown in FIG. 15 or offset from the compartment, such as below the battery compartment as shown in FIG. 17 to direct light generally forwardly of the lighted hat 10. In the form illustrated in FIG. 15, the battery compartment 300 extends generally transverse to the brim axis B. In this form, the battery compartment 300 is an elongate cavity in the brim 16 sized to house the power source 44, such as a pair of cylindrical AAA batteries 304, the switch 42, and two light sources 302 therein; however, any combination of these components is also contemplated. The battery compartment 300 can further be electrically connected to a light source 305 disposed on the edge 30, 32 of the brim 16 by wires 307 or other electronic components as described herein. In the illustrated from, the switch 42 is located intermediate of the light sources 302 and intermediate of the two batteries 304 to be positioned generally along the brim axis B.

The battery compartment 300 includes a cavity, recess, or other cut-out portion 306 in the brim insert 24. The batteries 304 are inserted into the compartment 300 to extend between opposing contacts 308, which in turn are electrically connected to the light sources 302 and the switch 42 by wires 310. By one approach, as illustrated in FIG. 16, the battery compartment 300 is covered by brim material 316, such as the lower fabric covering 36 to conceal the battery compartment 300 from view. Alternatively, the battery compartment 300 can include a generally rigid removable cover. The material 316 includes openings 312 therein through which the one or more light sources 302 can extend to project light generally forwardly and/or downwardly of the brim 16. Stitching or embroidery can be included therearound to strengthen the openings 312. The material 316 can further include an indicator or locator portion 314 disposed over the switch 42, which can be embroidery, stitching, a sewed or adhered portion, a thicker portion of the material, or the like, to provide a wearer of the lighted hat 10 with an easily identifiable location of the switch 42. As shown, the light sources 302 project through the openings 312 to project light forwardly of the lighted hat 10. The light sources 302 can additionally be canted downward with respect to the brim axis B to project light to a viewing or working area within a range of manipulation for the wearer's hands.

Another form of the battery compartment 300 is shown in FIG. 17. In this form, the lighted hat 10 includes two separate battery compartments 300, each configured to house a coin cell battery 320 or two or more coin cell batteries 320 in an overlapping, stacked relation. Each battery compartment 300 includes a removable cover member 322 which secures to the compartment 300 by snap-fit, threads, friction, detents, or the like. Advantageously, the cover member 322 includes a light source 324 mounted thereto so that securing the cover 322 to the brim 16 secures the light source 324 to the brim 16. The cover member 322 is preferably removable so that the batteries 320 can be replaced. As shown, the cover includes a contact 326 on a bottom surface 328 thereof to electrically engage a major surface of the battery, which works in combination with a contact 330 provided in the compartment 300 (such as the contact 330 at least partially encircling an outer periphery of the compartment) to engage both contacts of the batteries. The compartment can be self-contained such that attaching the cover member 322 completes the circuit and energizes the light source 324. Alternatively, the switch device 42 may be wired to the one of the contacts 328, 330 through the compartment 300, so that operation of the switch device 42 can complete a circuit between the switch 42, the battery 320, and the light source 324. Additional light sources 332 can also be disposed on the brim edge 30, 32, upper and lower major surfaces 26, 28 of the brim 16, or a combination thereof. These additional light sources 332 are electrically connected to the switch 42, such as by wires 334. The compartment may be on either the upper or lower major surfaces 26, 28 of the brim 16.

Figure 17A:
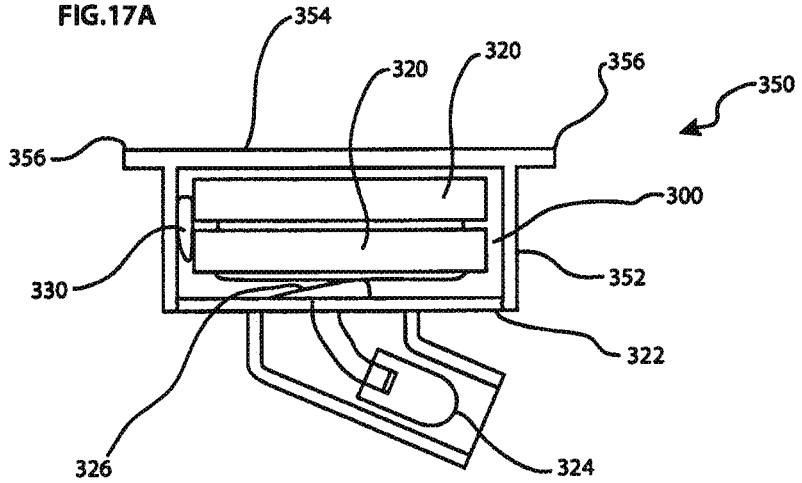
FIG. 17A is a cross-sectional view of an alternative battery compartment for mounting to a brim of a hat.
Figure 18:
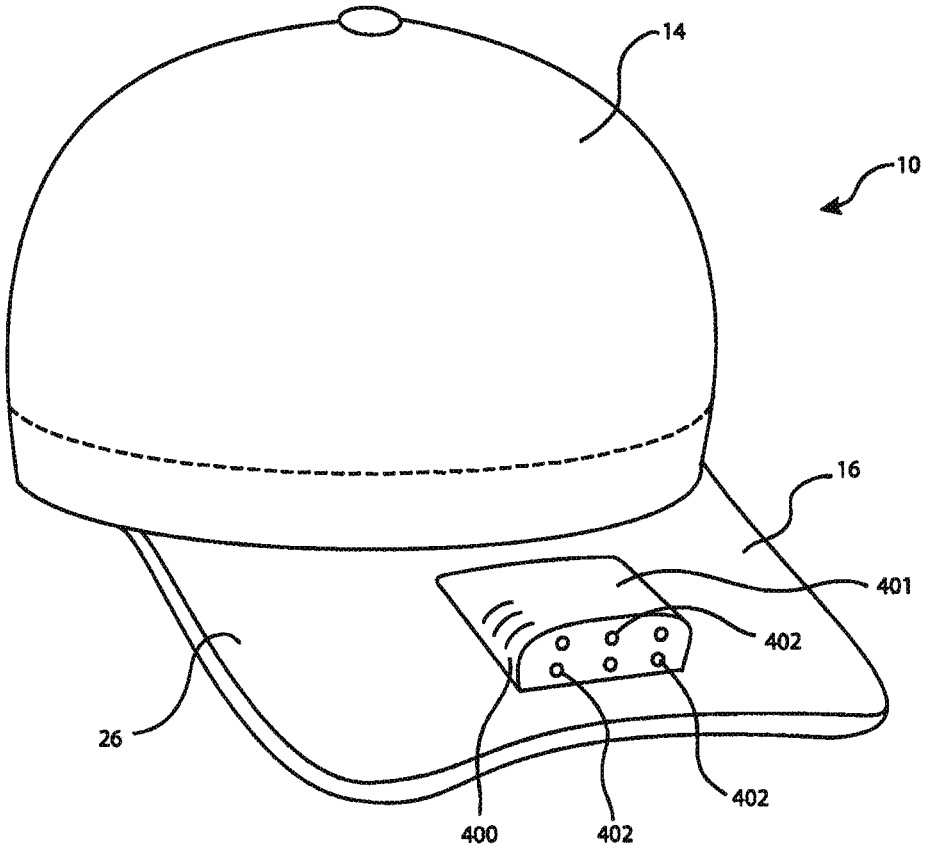
FIG. 18 is a perspective view of a lighted hat having a light module mounted to a brim thereof.

An alternative compartment is illustrated in FIG. 17A. In this form, the compartment 300 includes a separate battery compartment 350 from the brim 16 having an annular sidewall 352 and a bottom wall 354. The annular sidewall 352 and the bottom wall 354 create a cavity therein to receive one or more coin-cell batteries 320. The compartment 350 may further include outwardly projecting tabs or protrusions 356. With such structure, the compartment 350 can advantageously be secured to the brim 16 by inserting the tabs 356 into corresponding notch recesses 358 in the brim 16 and turned to lock the tabs 356 within the brim, and therefore the compartment 350 to the brim 16. In a preferred form, the battery component 350, and the batteries 320 therein, are at least partially received in the brim recess 306 to conceal the component 350 from view. As illustrated, the tabs 356 extend from the bottom wall 354, but the tabs 356 can also project outwardly along sidewall 352 at any desired height. Additionally, the tabs 356 can be utilized to similarly lock the cover 322 to the brim 16 in the form described above.

Referring now to FIGS. 18-22, the lighted hat 10 may also include a self-contained light module 400. The self-contained light module 400 is a self-contained housing that includes all components to energize a light source and is configured to attach to the brim 16 or other portion of the hat. The self-contained light module 400 includes a housing 401 with one or more light sources 402 therein, and preferably four or more light sources. The light sources can be arranged in any pattern, including arranged in a column and row orientation, arranged in offset rows, arranged in a generally circular or oval pattern, or the like. Further, the light sources may include a variety of colors, including for example, white, red, and green. The self-contained light module 400 further includes a power source 404, such as AAA, AA, or coin cell batteries. The light sources 402 and the batteries 404 are electrically connected to a switch 406 through contacts 408 and wires 410. The switch 406 can be a pushbutton switch, a slide switch, a rotary switch, or the like.

Figure 19:
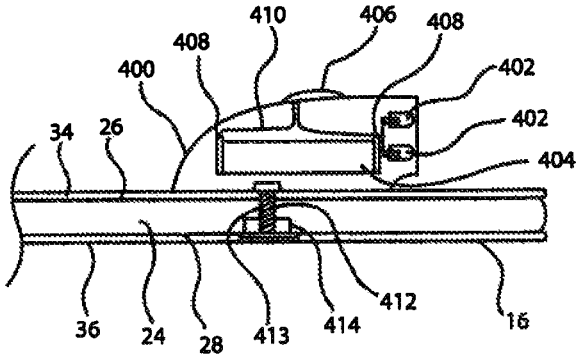
FIG. 19 is a cross-sectional side view of the lighted hat of FIG. 18 showing the light module connected by a screw and nut to a shape-retentive brim member.
Figure 20:
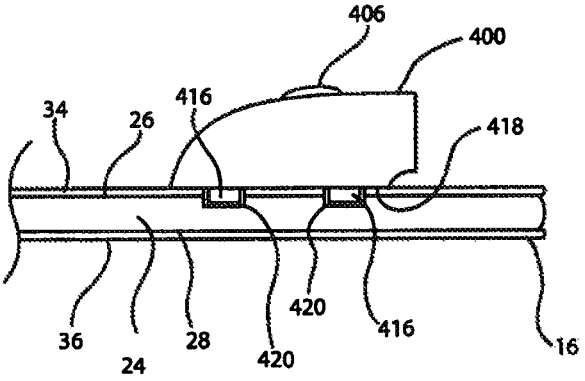
FIG. 20 is a cross-sectional side view of the lighted hat of FIG. 18 showing the light module connected by a magnet received within a cavity in the brim.

As shown, the self-contained light module 400 may be mounted to the upper major surface 26 of the brim 16, however, the self-contained light module 400 could also be mounted to the lower major surface 28 of the brim 16 or the crown 14. By one approach as shown in FIG. 19, the self-contained light module 400 can be attached to the brim 16 utilizing a fastener 412. In one example, the fastener 412 may be a screw or bolt 413 in combination with a nut 414 attached to the brim 16. Specifically, the screw 412 can be attached to the self-contained light module 400 so that it does not rotate relative thereto. Similarly, the nut 414 can be secured within the brim insert 24 or to the lower major surface 28 of the brim 16 so that the nut 414 does not rotate relative to the brim 16. So configured, the self-contained light module 400 can be releasably secured to the brim 16 by rotating the self-contained light module 400 to secure the screw 412 into the nut 414. The nut 414 may be received in a countersunk hole 415 so that it remains flush with the underside of the brim 16.

By another approach, the fastener 412 may be a magnet 416. In this approach, the self-contained light module 400 has one or more magnets 416 attached to a bottom surface 418 thereof. The magnets 416 can be a generally cylindrical post as shown, but can be flat plates. The posts can alternatively be rectangular, triangular, or other suitable shapes. The magnets 416 can be attached to the self-contained light module 400 using a suitable adhesive, snap-fit structure, screws, fasteners, and other securing mechanisms. The brim 16 further includes metal receptacles, such as bays 420, in a substantially similar pattern as the magnets 416 are disposed on the headlamp. The bays 420 alternatively could be relatively flat or may be magnets configured to attach to the magnets 416 of the module 400. The bays 420 are secured to the brim insert 24 through the upper covering 34 using a suitable adhesive, hook structure, ultrasonic welding, hardware, or the like. So configured, the magnets 416 on the self-contained light module 400 releasably secure to the bays 420 in the brim 16 and the self-contained light module 400 is positioned to shine light forwardly of a wearer of the lighted hat 10. Alternatively, the fastener 412 can be a snap-fit structure, such as posts and receptacles, tongue-and-groove, or the like.

Figure 21:
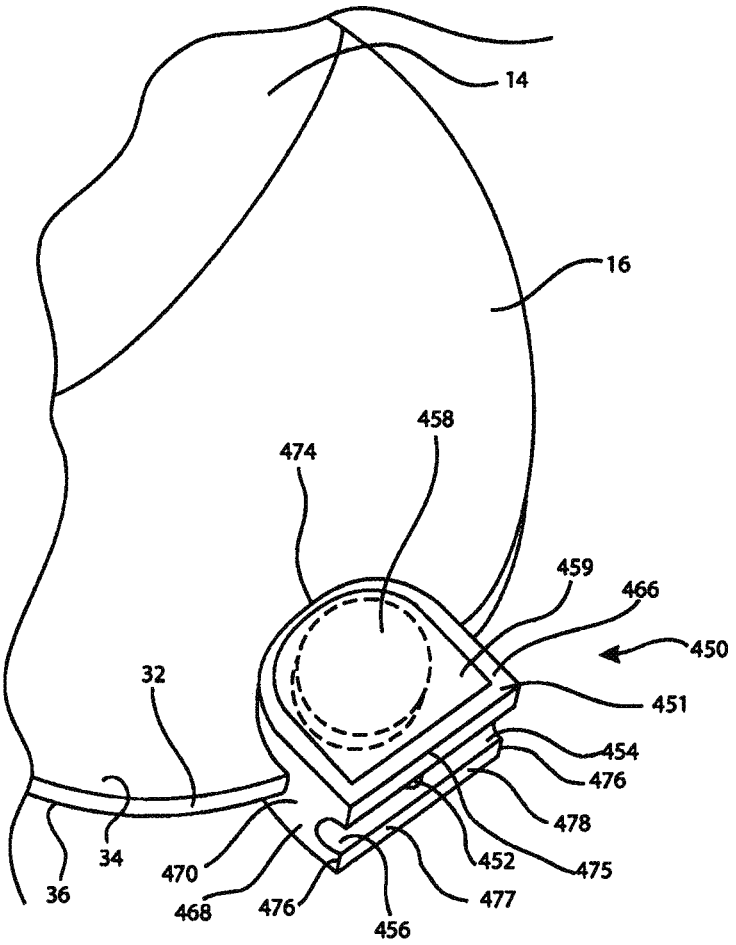
FIG. 21 is a perspective view of a clip-on light module secured to a brim of a hat.
Figure 22:
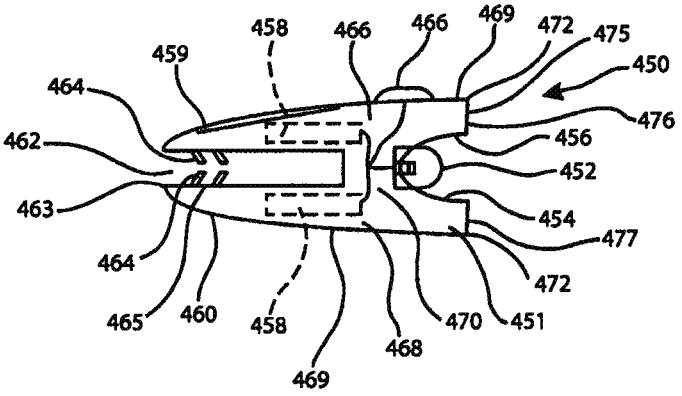
FIG. 22 is a side elevation view of the clip-on light module of FIG. 21.

In another form, a self-contained, clip-on light module 450 is shown in FIGS. 21-22 that includes all components to energize a light source in a housing 451 or module that is configured to slide or clip-on to a hat brim (FIG. 21) or other portion of a hat. As shown in FIG. 21, the housing 451 includes an integral slide clip mechanism with spaced upper and lower portions 466, 468 connected by a transverse neck portion 470 to define a gap or mouth 462 therebetween that is sized to receive the brim 16 therein. The slide clip will be discussed more below. Outer surfaces 469 of the upper and lower portions 466, 468 taper inwardly as they travel from top and bottom front edges 472 to a rear edge 474. As illustrated, the rear edge 474 is generally rounded; however, the rear edge 474 could take other suitable shapes, such as pointed, or generally perpendicular to the brim axis B. The top and bottom front edges 472 combine with side front edges 476 to form a generally rectangular forward surface 478. The edges, 472, 476 could alternatively include one or more arcuate segments.

The clip-on light module 450 of this form includes the housing 451 sized to house one or more light sources 452 therein on a front edge thereof. The light sources 452 are disposed adjacent the forward surface 478 and preferably disposed within a forwardly directed recess 454 or laterally extending concave cavity formed in the forward surface 478. In the illustrated form, the recess 454 extends the width of the clip-on light module 450 in a lateral direction and is generally rounded inwardly to the module 450. By another approach, the recess 454 could be hemi-spherical, could include walls generally parallel to the brim axis B, or other suitably shaped depressions, with the light source 452 disposed therein. The recess 454 may further include a reflective coating or layer 456 configured to direct stray or incident light emitted from the light source 452 forwardly of the clip-on light module 450. By positioning the light source 452 in the cavity 454, upper and lower flanges 475, 477 of the module 450 extend beyond the light source 452 to provide protection or function as an opaque blinder to block or reduce stray light.

The clip-on light module 450 can further include one or more batteries 458 disposed therein, such as coin cell batteries. As shown, one or both of the top and bottom portions 466, 468 can include an internal cavity or cut-out therein sized to house a battery 458 therein, so that batteries 458 are disposed on both sides of the neck portion 470 and therefore both sides of the brim 16 when the module 450 is attached to the brim 16. The clip-on light module 450 can further include one or more removable or slidable doors 459 configured to provide a user access to the batteries 458. One door is shown, but it will be appreciated that a second door 459 may be provided to access the second battery.

A rearward portion 460 of the clip-on light module 450 includes the mouth 462 disposed between the top and bottom portions 466, 468 adjacent the neck portion 470. The mouth 462 is configured to slidably receive the brim 16 therein. An interior surface 463 of the mouth 462 has a brim fastener 465 designed to secure the module 450 to the brim 16, such as the upper and lower coverings 34, 36. In the illustrated form, the brim fastener 465 includes brim-engaging teeth 464 projecting from the interior surface 463 generally angled toward the forwardly directed recess 454. Alternatively, the top and bottom portions 466, 468 can be biased toward each other, the neck portion 470 can include a spring or the like, or similar structure so that the top and bottom portions 466, 468 can clamp onto the brim 16. The interior surface 463 could further include a rough portion to increase the friction of the module 450. The clip-on light module 450 may further include a switch 466 mounted thereto and configured to control power to the light source 452 from the batteries 458. The switch 466 may be a pushbutton switch, a slide switch, a rotary switch, or the like. Alternatively, the switch may be provided in the mouth 462 so that the lights are automatically energized when the brim is slidably inserted into the mouth 462.

So configured, the module 450 can be secured to the brim 450, the switch 466 can be actuated by a user's finger and the module 450 can conveniently illuminate an area forward of the user. Advantageously, the configuration of the module 450 allows it to be reversible or attached to the brim 16 with the top and bottom portions 466, 468 oriented in either an upward or downward direction. This disposes the switch 466 above or below the brim 16 as desired by the user. Additionally, by one approach, the light source 452 can be canted at an angled relative to the brim axis B. Altering the orientation the module 450 in this form, can advantageously provide light to different areas forwardly of the user as desired.

Figure 23:
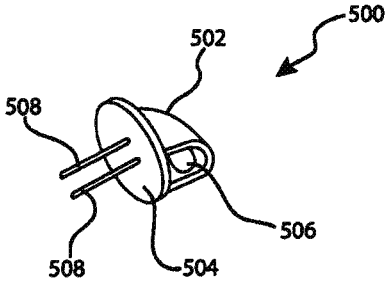
FIG. 23 is a bottom perspective view of a light module for use on lighted headgear.
Figure 24:
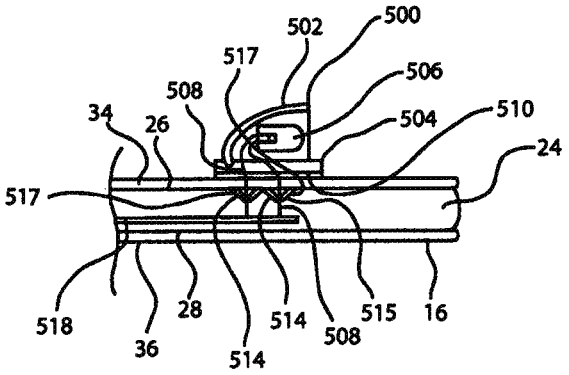
FIG. 24 is a cross-sectional side view of a brim for a lighted hat having the light module of FIG. 23 mounted thereto.
Figure 25:
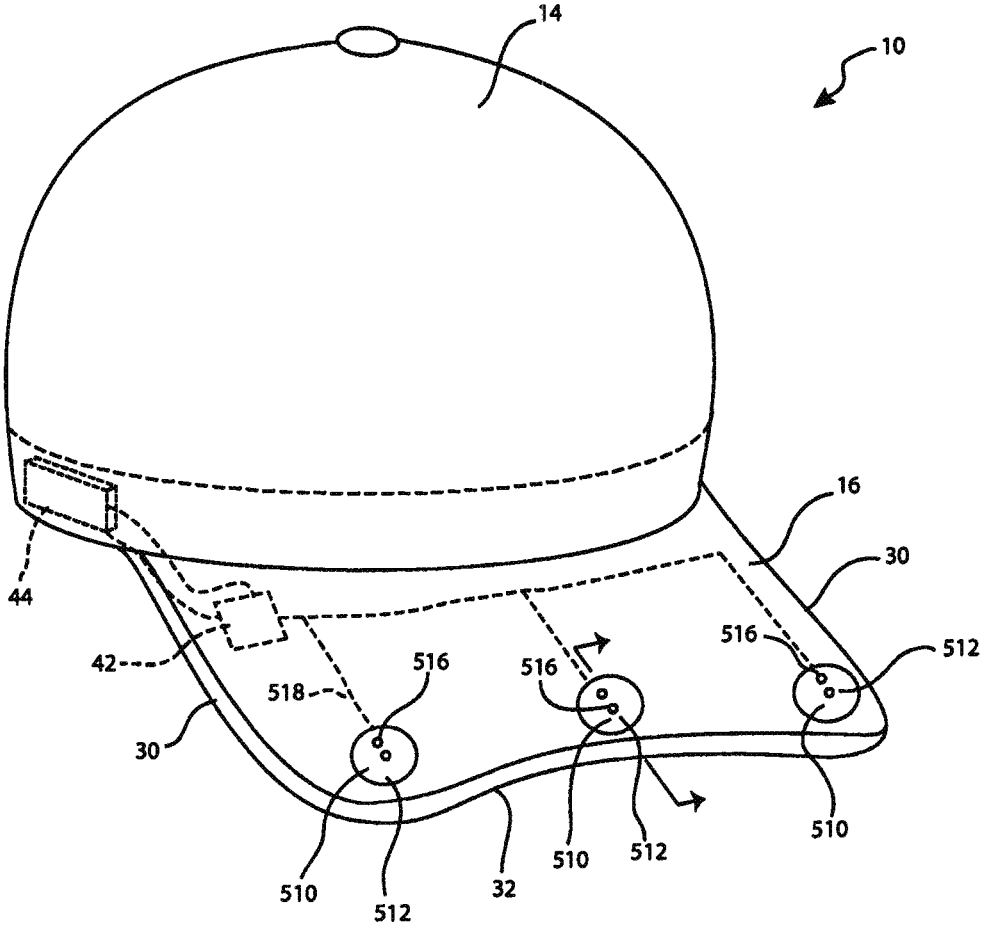
FIG. 25 is a perspective view of a lighted hat having reception portions or mounting bases on a brim thereof configured to receive the light module of FIG. 24.

Turning now to FIGS. 23-25, a light hood 500 configured to be inserted into the brim 16 or other portion of the lighted hat 10 is illustrated. In this form, the light hood 500 includes a hood portion 502 connected to a base portion 504. The hood portion 502 is sized to receive one or more light sources 506 therein with leads 508 of the light sources 506 projecting through the base portion 504 of the light hood 500. So configured, the light hood 500 is configured to be attached or mounted to the lighted hat 10 to provide illumination forwardly of a wearer.

The lighted hat 10 of this form is configured to receive one or more of the light modules 500, as shown in FIGS. 24 and 25. In this approach, the brim 16 of the lighted hat 10 includes a light hood reception portion or mounting base 510 disposed on the upper covering 34 or upper major surface 26 thereof (or the lower surface). To mount the module 500 to the hat 10, the leads 508 of the module 500 are inserted into the brim 16, through the reception portion 510, upper covering 34, and/or the upper major surface 26 of the brim insert 24. Preferably, the leads 508 are inserted sufficiently so that the hood base portion 504 rests against the hat brim reception portion 510. Advantageously, each brim module reception portion 510 may include a sealing layer 512, such as a rubberized layer, that is configured to seal around the leads 508 of the light hood 500 after it has been inserted into the brim 16 (see FIG. 25). The brim module reception portion 510 can be sized to generally match the size and shape of the base 504 of the light hood 500 or can alternatively can larger or smaller than the base 504, as long as the module reception portion 510 is large enough to receive the leads 508 of the light source 506 therein.

The brim 16 may further include a clamping mechanism 514 disposed therein under the module reception portion 510 to receive and secure the leads 508 of the light source 506 as the leads are inserted into the brim 16. The clamping mechanism 514 can be disposed within or on the brim insert 24. The clamping mechanism 514 may include opposing fingers 517 that are biased toward a central opening 515 that the lead 508 can be forced through. Preferably, the fingers 517 are formed from a resilient material that tightly holds the leads 508 between the opposing fingers 517 after it is forced through the opening 515 so that the light hood 500 is securely attached to the brim 16. The fingers 517 of the clamping mechanism 514 may be formed from an electrically conducting material, so that electrical conduits 518 can attach thereto and provide power to the light source 506 through the leads 508 after the leads 508 have been inserted into the clamping mechanism 514. Alternatively, the clamping mechanism 514 may direct the light source leads 508 into engagement with the electrical conduits 518 in the hat brim.

This configuration secures the light hood 500 to the brim 16 after it has been inserted. As shown in FIG. 25, in order to ease the insertion process, the module reception portion 510 may further include lead placement indicators 516 disposed above the clamping mechanism 514, so that the leads 508 can be easily inserted into the clamping mechanism 514. The brim 16 further includes electrical conduits 518 disposed underneath the module reception portions 510 (FIG. 24). The electrical conduits 518, which may be wires, traces, circuit boards, or the like, are configured to contact the leads 508 of the light sources 506 after they are received by the securing mechanism 514 to connect the leads with the power source 44, such as through the switch 42. The light modules 500 can further be connected with the power module 200 discussed above. As shown, the lighted hat 10 includes three module reception portions 510 disposed adjacent the edges 30, 32 of the brim 16; however, the lighted hat 10 can be configured to receive one of the light modules 500 anywhere it is desired, such as on the lower major surface 28 of the brim 16, on one of the edges 30, 32 of the brim 16, or on the crown 14 of the lighted hat 10.

Referring now to FIGS. 26, 26A, 27, 28, and 28A, an alternative lighted hat 10 is shown with another brim configuration. In this form, the lighted hat 10, and specifically the brim 16 of the lighted hat 10 includes one or more light sources 600 and a power source compartment 602 recessed in the brim 16 and spaced from the edges 30, 32 of the brim 16 and electrically connected to each other, as well as the switch 42, by wires 604 or the like. In this approach, the brim 16 further includes a hinge or fold 606 disposed laterally across the brim 16, such as in a direction generally transverse to the brim axis B, to create a two-portion brim having a pivotable forward portion 608 and a stationary rear portion 609 of the brim 16. The hinge 606 can be a two-compartment hinge, a living hinge, a fabric material, a weakened portion, a separate component, or the like. The hinge 606 may further include a locking mechanism, such as a stepped hinge, aligned hook-and-loop portions, a snap-fit mechanism, or the like so that the forward portion 608 can conveniently be held in the use configuration. The stationary rear portion 609 of the brim 16 can attach to the lower, forward edge 18 of the crown, as discussed above. So configured, the hinge 606 can be disposed closely adjacent the front edge 32 of the brim 16, or the forward portion 608 can include a forward fourth of the brim 16, a forward third of the brim 16, half of the brim 16, or the like.

Figure 26:
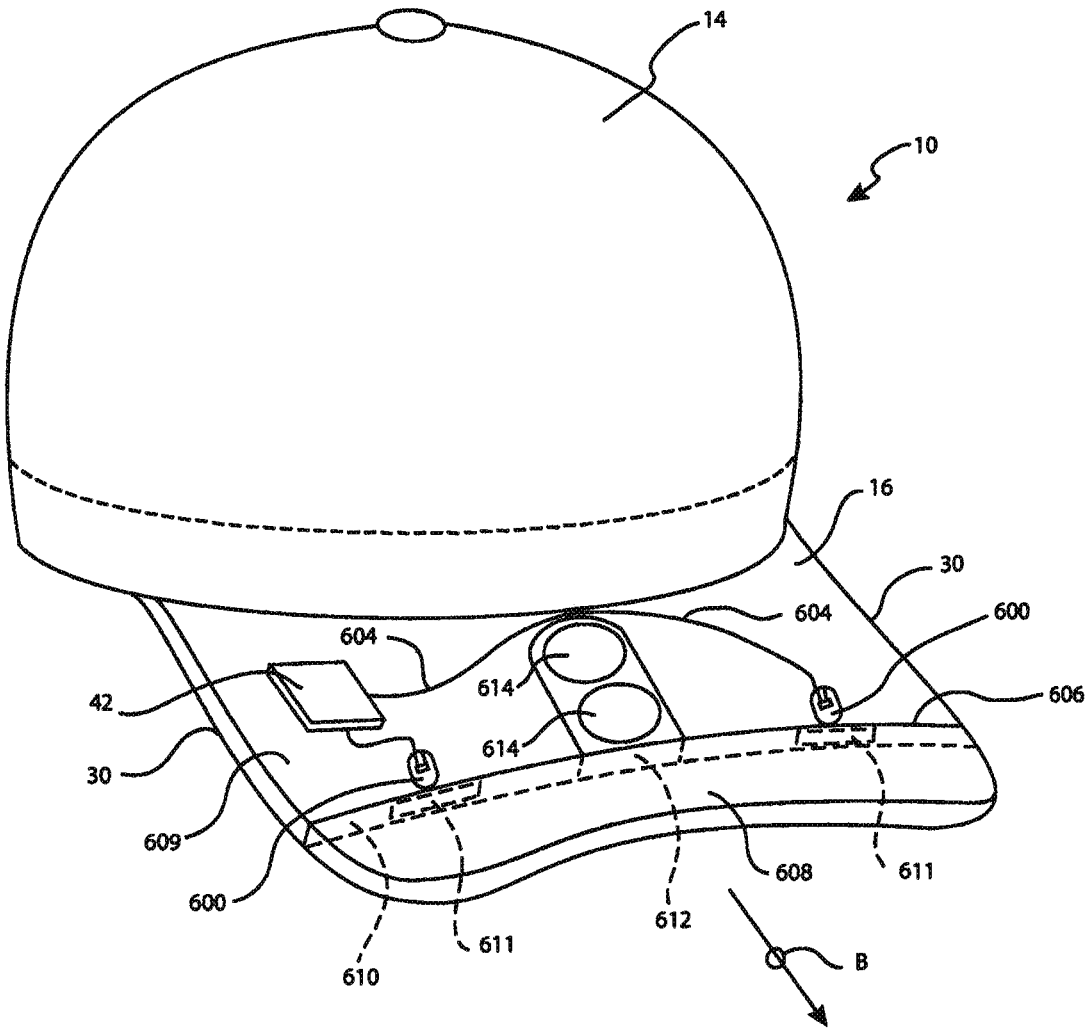
FIG. 26 is a perspective view of a lighted hat having a pair of light sources and a power source compartment recessed within a brim thereof adjacent a hinge configured to allow a forward portion of the brim to be pivoted.

The forward portion 608 can be pivotable upwards or downwards between a closed position where the brim 16 has a normal flat appearance (FIGS. 26 and 27) and a use position (FIGS. 26A, 26B, and 28) where the forward portion 608 is pivoted upward, such as between about 30 degrees and about 180 degrees, and preferably between about 90 degrees and 180 degrees. Preferably, the light sources 600 and the power source compartment 602 are disposed within the brim 16 between the upper and lower major surfaces 26, 28 adjacent to the hinge 606, so that pivoting the forward portion 608 to the use position reveals the light sources 600 and the power source compartment 602. In one approach and shown in FIG. 28, a forward facing portion 610 of the hinge 606 is transparent or translucent so that light emitted by the light sources 600 can shine therethrough to a position generally forward of the lighted hat 10 when the forward portion 608 is in the use position. Alternatively, the forward facing portion 610 can include openings 611 therein to allow the light sources 600 to direct light forwardly of the lighted hat 10 (see FIG. 28A). The forward facing portion 610 can additionally include an opening 612 therein to provide access to the power source compartment 602 to change batteries 614 stored within the power source compartment 602 (FIG. 26). The power source compartment 602 may be configured to receive the power source module 200 discussed above so that the module 200 can be inserted and removed when desired for maintenance, changing the batteries, or the like when the forward portion 208 is pivoted to the use configuration. By another approach, the power source compartment 602 can include a removable door disposed adjacent the upper or lower surface portions 26, 28 of the brim 16 along with a pivotable portion of the adjacent covering 34, 36. Alternatively, the light sources 600 and the switch 42 can be electrically connected to the power source 44 in the crown 14 of the lighted hat 10 or the power module 200 discussed above.

Figure 26A:
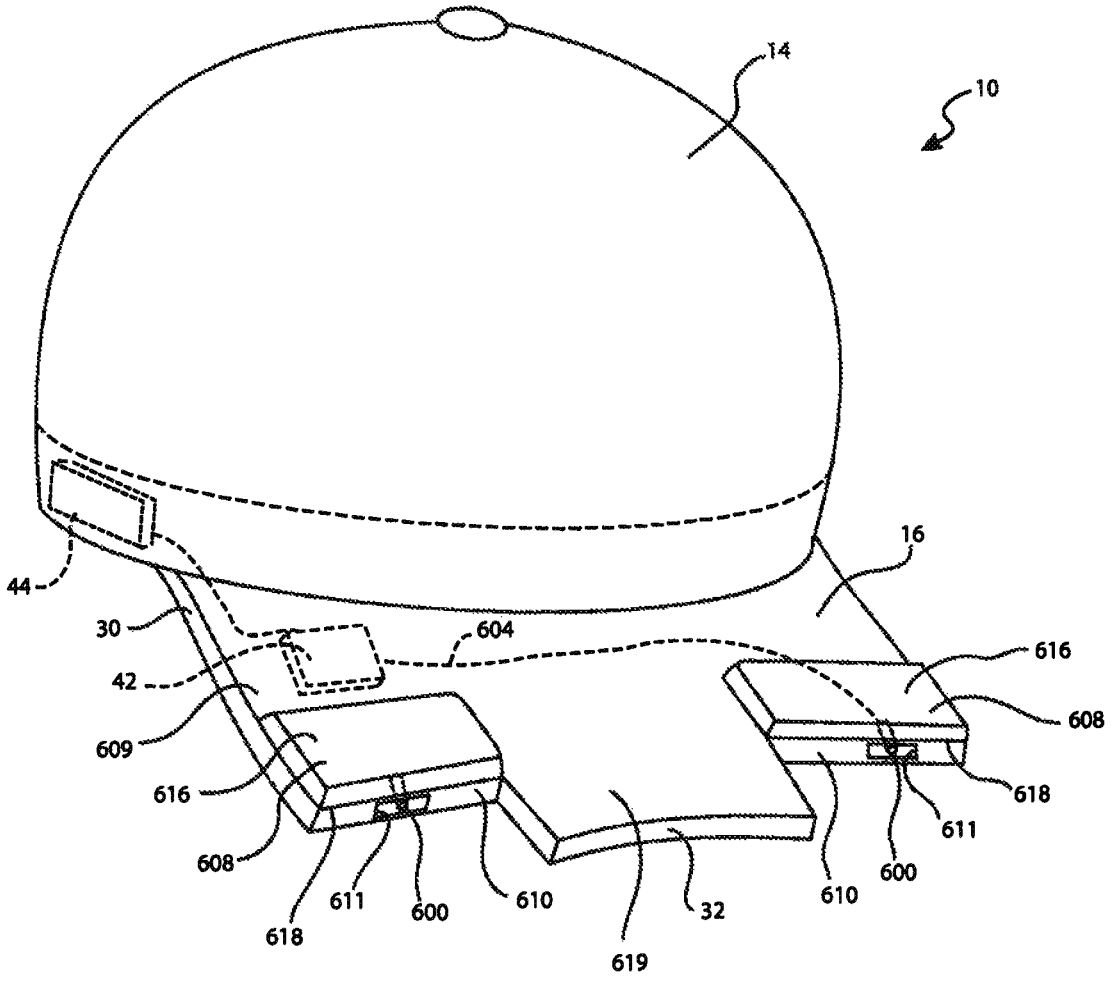
FIG. 26A is a perspective view of a lighted hat having a pair of light sources recessed within a brim thereof adjacent hinge portions configured to allow forward portions of the brim to be pivoted.

By another approach as shown in FIG. 26A, the brim 16 can include the hinge 606 in hinge portions 618 adjacent the side edges 30 of the brim 16 and forwardly of the light sources 600 breaking the forward portion 608 in two end sections 616. A non-hinged portion 619 is positioned intermediately or generally centrally between the two end sections 616. So configured, a user of the lighted hat 10 of this form can choose to pivot one or both of the end sections 616 of the forward portion 608 of the lighted hat 10 to expose the light sources 600. In this form, pivoting the end sections 616 reveals the forwardly facing surface 610 with the openings 611 defined therein for the light sources 600 to project through. Alternatively, the openings 611 can include a transparent or translucent material therein for the light sources 600 to project therethrough.

Figure 26B:
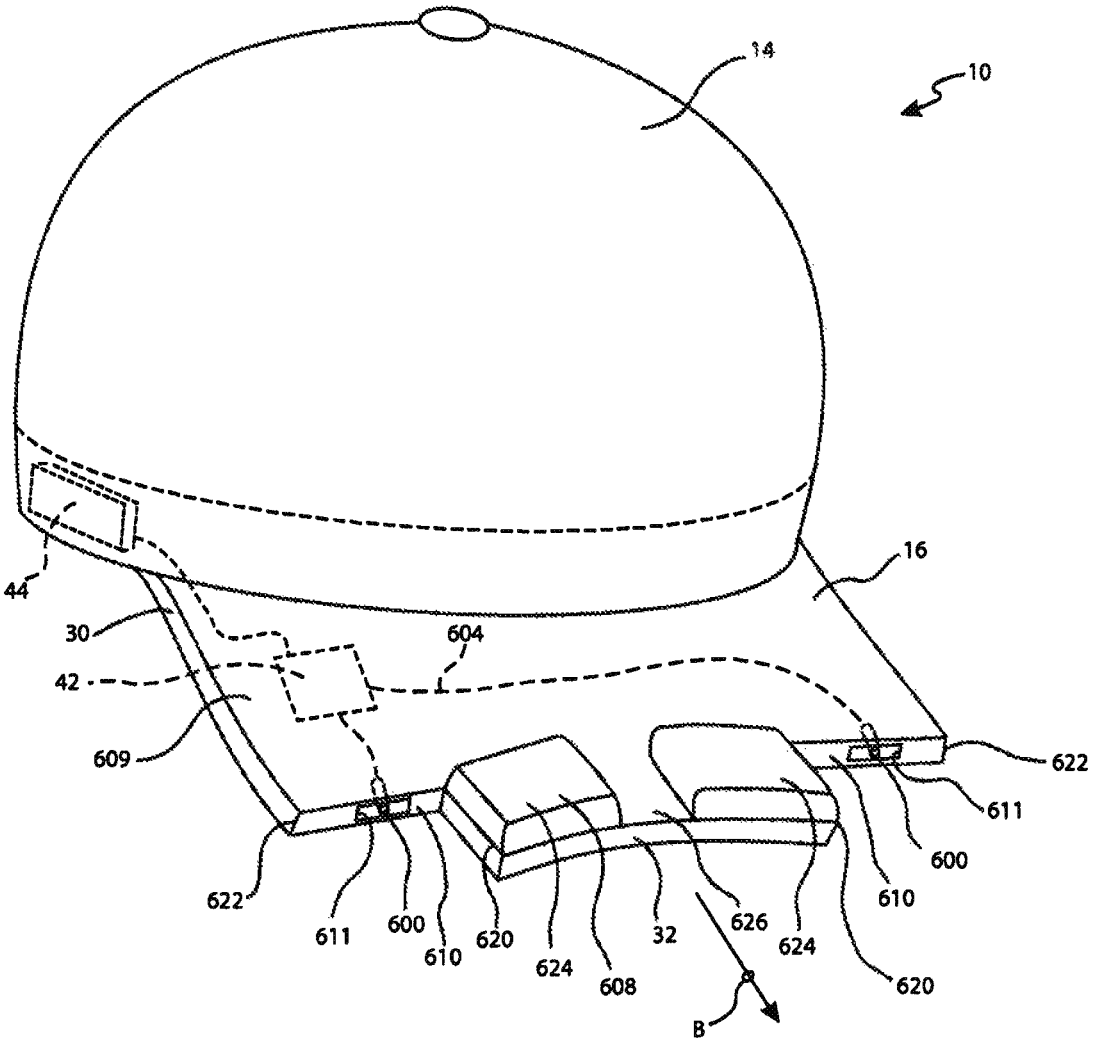
FIG. 26B is a perspective view of a lighted hat having a pair of light sources recessed within a brim thereof adjacent longitudinal hinge portions configured to allow forward portions of the brim to be pivoted.
Figure 27:
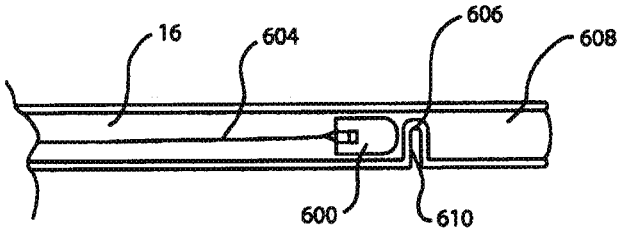
FIG. 27 is a cross-sectional side view of the brim of FIG. 26 showing the brim in a first position.
Figure 28:
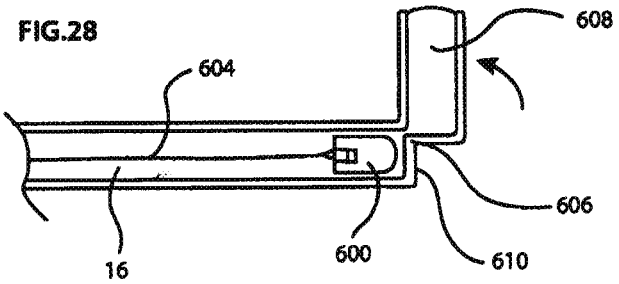
FIG. 28 is a cross-sectional side view of the brim of FIG. 26 showing the brim in a second or use position.
Figure 28A:
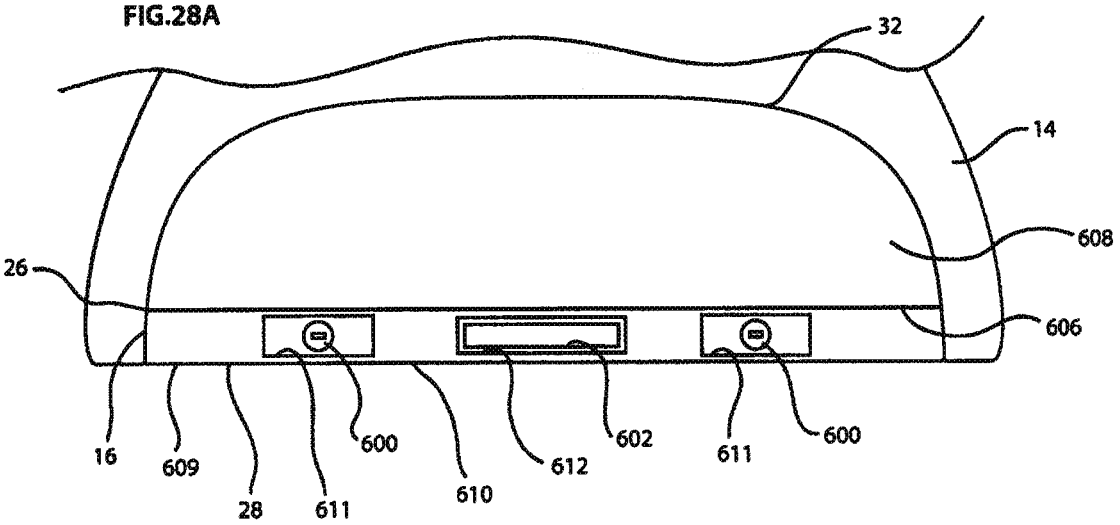
FIG. 28A is a front elevation view of the lighted hat of FIG. 26 showing the brim in the second or use position.

By yet another approach as shown in FIG. 26B, similar to the form described above with respect to FIG. 26A, the brim 16 can include longitudinally extending hinge portions 620, that are generally parallel to the brim axis B and the side edges 30 of the brim 16. The hinge portion 620 extends from the front edge 32 along the brim 16 to a position laterally adjacent the light sources 600. The brim further includes cuts or breaks 622 that extend from the brim side edge 30 closely forwardly of the light source 600 to the adjacent hinge portion 620 to form two pivotable end sections 624. A non-hinged portion 626 is positioned intermediately or generally centrally between the two end sections 624 and the end sections 624 can be pivoted to rest thereon as shown in FIG. 26B. So configured, a user of the lighted hat 10 of this form can choose to pivot one or both of the end sections 624 of the forward portion 608 of the lighted hat 10 to expose the light sources 600. In this form, pivoting the end sections 624 reveals the forwardly facing surface 610 with the openings 611 defined therein for the light sources 600 to project through. Alternatively, the openings 611 can include a transparent or translucent material therein for the light sources 600 to project therethrough.

Figure 29:
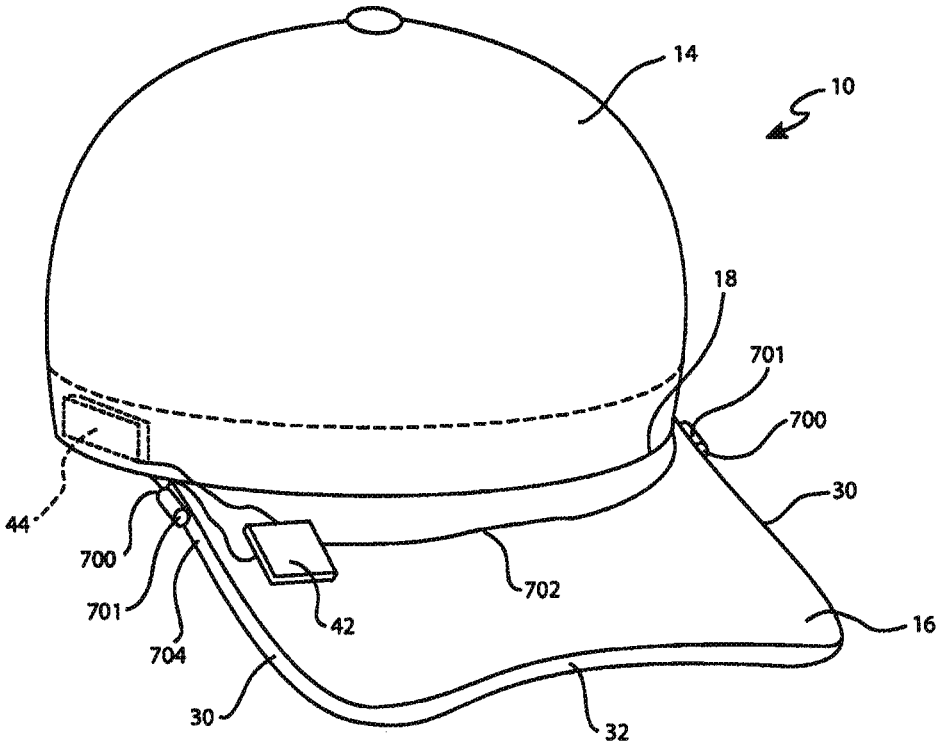
FIG. 29 is a perspective view of a lighted hat with a brim showing a pair of light sources mounted to side edges of the brim to provide illumination in a forward direction.
Figure 30:
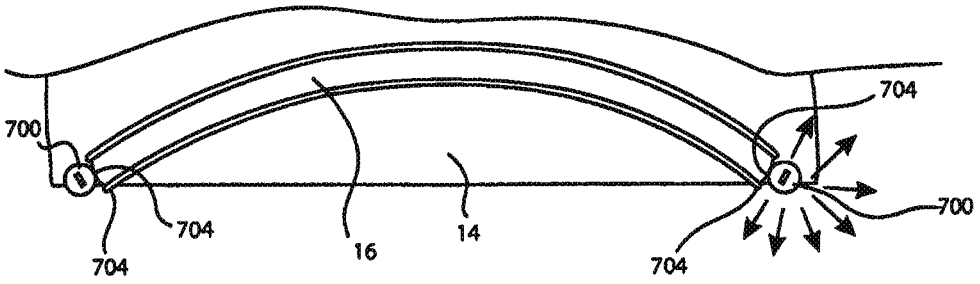
FIG. 30 is a front elevation view of the lighted hat of FIG. 29.

Turning now to FIGS. 29-32, lighted headgear are shown with example light configurations with side mounted LEDs. In one form, one or more light sources 700 are mounted to the side edges 30 of the brim 16 to shine light forwardly of the lighted hat 10. As shown in FIGS. 29 and 30, the light sources 700 are mounted to the side edges 30 of the brim 16 proximate to the crown 14; however, the light sources can be spaced from the crown 14, such as positioned intermediately or adjacent the front edge 32 of the brim 16. The light sources 700 can then be electrically connected to the switch 42 and the power source 44, such as by wires 702. Alternatively, the light sources 700 could be electrically connected to the power source module 200 discussed above. By another approach, the light sources 700 can be received within a hood, housing, or bezel 701. The housing 701 can provide protection for the light sources 700, as well as include a reflective interior surface to direct incident or stray light forwardly of the hat 10. In one form, the housing 701 can receive the light source 700 at a cant relative to the forward brim axis B. For example, the light source 700 can be directed inwardly toward the brim 16 and/or downwardly relative to the brim axis B to provide light inwardly and downwardly from the brim. This configuration directs light forwardly of a wearer of the lighted hat 10, while also utilizing the side edge 32 of the brim 16 as an opaque blinder surface 704 to at least partially block incident or stray light from projecting into the eyes or glasses of a wearer. The side edge 32 of the brim 16 advantageously project above and below the illumination chip of the LED 700 so that inwardly directed incident or stray light is blocked by the blinder surface 704.

Figure 31:
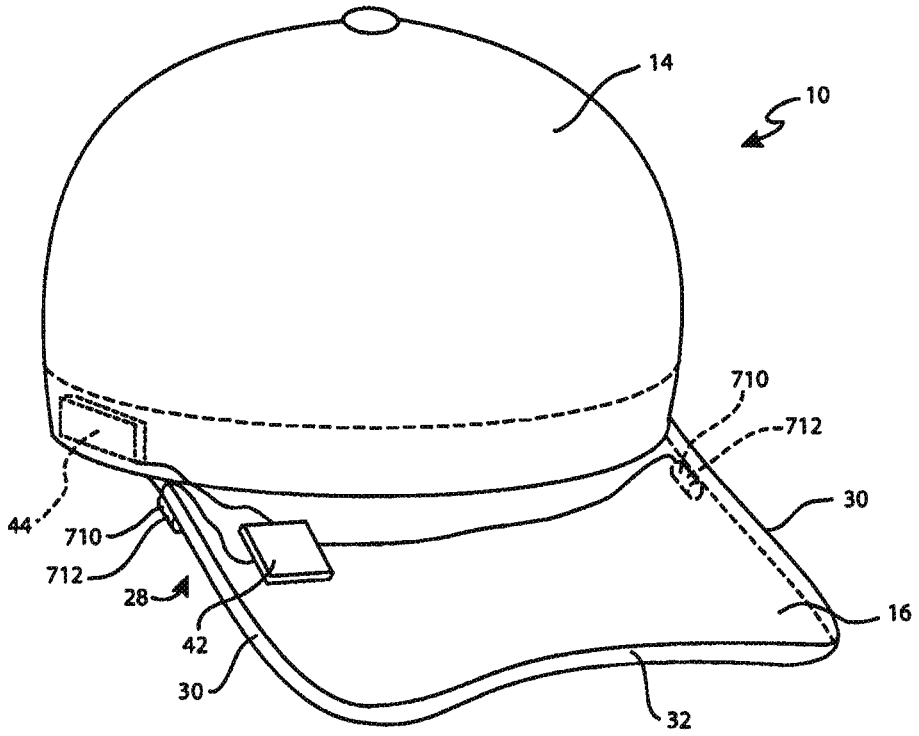
FIG. 31 is a perspective view of a lighted hat with a brim showing a pair of light sources mounted to a bottom surface of the brim adjacent side edges of the brim to provide illumination in a forward direction.
Figure 32:
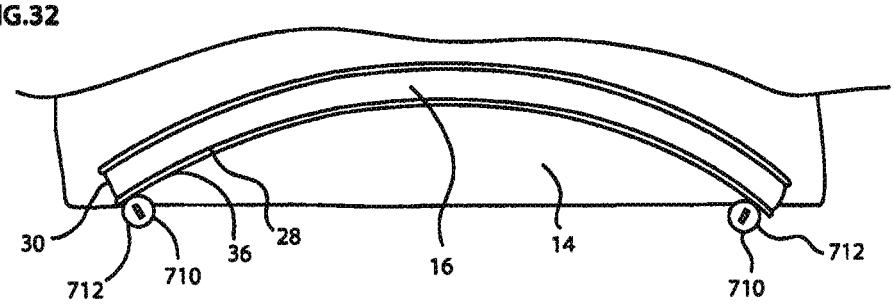
FIG. 32 is a front elevation view of the lighted hat of FIG. 31.

By another approach as shown in FIGS. 31 and 32, light sources 710 can be mounted to the lower major surface 28 of the brim 16 or to the lower covering 36 of the brim 16 at a position substantially adjacent to the side edges 30 of the brim 16. As discussed with respect to the lights sources 700 in the previous form above, the light sources 710 of this form may be received within a housing or bezel 712. An interior surface of the housing 712 can be utilized an opaque blinder surface to deflect light from shining into the eyes or glasses of a wearer of the lighted hat 10. By another approach, the housing 712 can cant the light source 710 inwardly and/or downwardly with respect to the brim axis B. As illustrated, the light sources 710 are mounted to the brim 16 proximate to the crown; however, the light sources 710 could be mounted proximate to the front edge 32 of the brim 16 or intermediate of the two. The light sources 710 are connected to the switch 42 and the power source 44/power source compartment 200 as discussed above.

Figure 33:
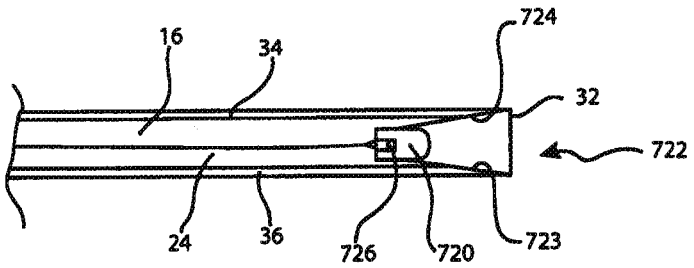
FIG. 33 is a cross-sectional side view of a brim for a lighted hat showing a light source recessed from an edge thereof with a reflector positioned forwardly of the light source.
Figure 34:
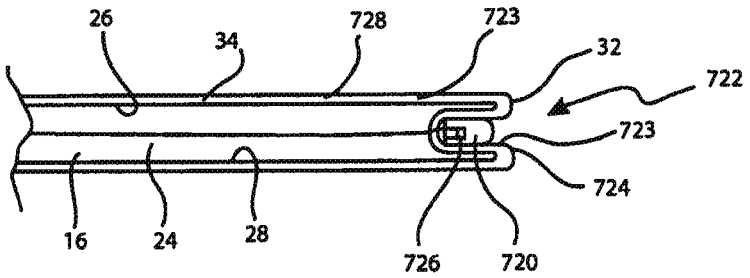
FIG. 34 is a cross-sectional side view of a brim for a lighted hat showing a light source recessed from an edge thereof with a reflector positioned forwardly of the light source and extending to a top and bottom surface thereof to also function as a heat sink.

In another form as shown in FIGS. 33-34, a light source 720 can be embedded in the brim 16 and recessed from the front edge 32 of the brim 16 to project light forwardly of the lighted hat 10 through an opening or other channel 722 extending through the brim 16 to the front edge 32. In this form, the upper and lower covering 34, 36 and/or the brim insert 24 extends beyond the light source 720 to form upper and lower flanges or extensions 726, 728. The flanges 726, 728 may include tapered interior surfaces 730 extending from the light source 720 to the front edge 32 of the brim 16. The interior surfaces 730 can then act as opaque blinder surfaces to block or deflect stray or incident light from shining above and/or below the brim, which can shine into a wearer's eyes or cause glare in a wearer's glasses. Accordingly, any light not projecting approximately forwardly through the opening 722 is absorbed or otherwise significantly reduced due to the opaque nature of the brim insert 24 and the coverings 34, 36. Alternatively, a reflector or cone 723 having a reflecting surface or material thereon 724 may also be disposed between the light source 720 and the opening 722 so that any light not directly projected through the opening 722 may be reflected out of the opening 722 to illuminate an area forward of the lighted hat 10. Preferably, the reflector 723 is disposed around the light source 720 in a position adjacent or behind an illumination chip 726 of the light source 720 to maximize the amount of light reflector forwardly by the reflector 723.

By another approach, as shown in FIG. 34, the reflector 723 may be extended around the front edge 32 of the brim 16 to cover at least a portion of the upper and/or lower major surface 26, 28 of the brim 16. In this form, the reflector 723 can be composed of a material that absorbs and dissipates heat generated by the light source 720 and other heat generating components mounted to the lighted hat 10. Thus, the reflector 723 may also function as a heat sink.

Referring now to FIGS. 35-38, various brim configurations are shown with drop down light features 800. These drop down light features 800 include a recess or cut-out portion 802 of the brim insert 24 into which one or more light sources 804 are received. Each light source 804 is configured to pivot from a first position generally aligned with the brim axis B and stored within the recess 802 to a second position at an angle θ1 to the brim axis B to direct light generally forwardly and downwardly of the lighted hat 10, such as to a viewing or working area where a wearer of the lighted hat 10 could hold a book, have an object on a work surface, or the like. A pivotable door 810 can then be provided to cover the recess 802 that is configured to rotate between a first position generally flush with the brim 16 and a second position at the angle θ1 to the brim axis B. The door 810 conceals the light source 804 in a closed position, but allows the light source 804 to move between the first and second positions.

Figure 35:
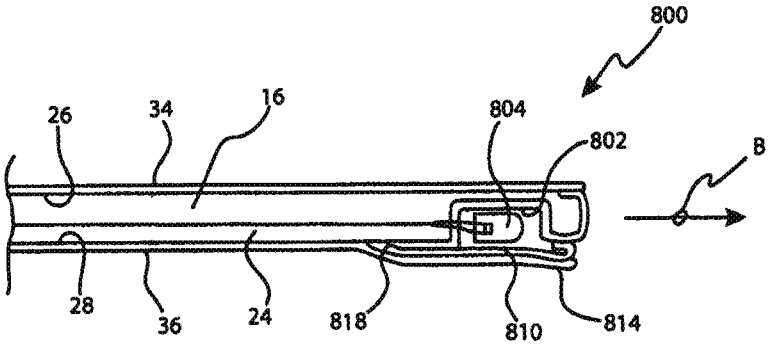
FIG. 35 is a cross-sectional side elevation view of a brim for a lighted hat in a first position or configuration showing a light source received within a recess in the hat with the recess covered by a movable door.
Figure 36:
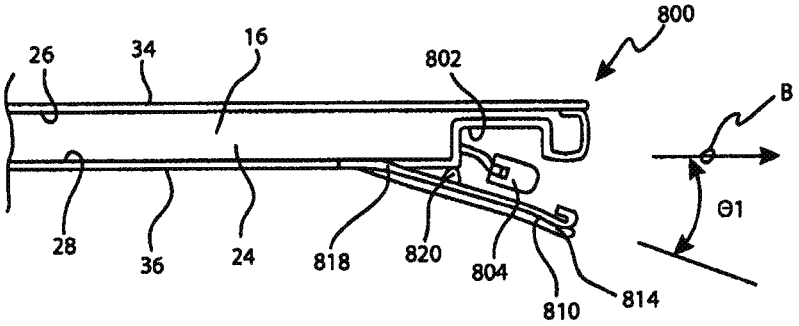
FIG. 36 is a cross-sectional side elevation view of the brim of FIG. 35 in a second position or configuration showing the light source and the movable door pivoted downward.
Figure 37:
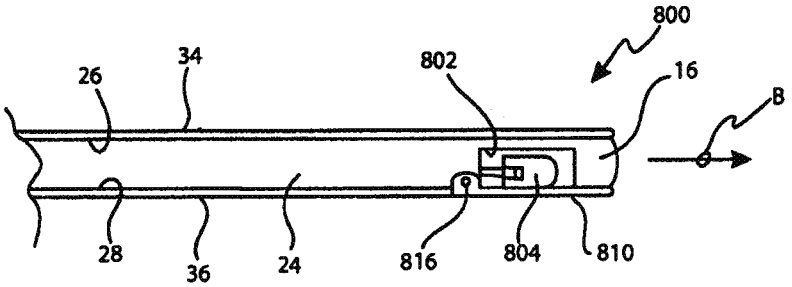
FIG. 37 is a cross-sectional side elevation view of a brim for a lighted hat in a first position or configuration showing a light source received within a recess in the hat with the recess covered by a movable door.
Figure 38:
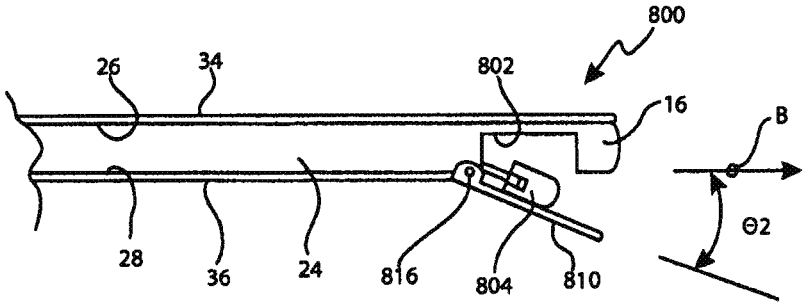
FIG. 38 is a cross-sectional side elevation view of the brim of FIG. 37 in a second position or configuration showing the light source and the movable door pivoted downward.

In one form, the pivotable door 810 includes one or more malleable segments 812, such as a wire or the like, disposed across the recess 802 generally in line with the bottom covering 36. Fabric 814 can then be disposed over the malleable segments 812 over the recess 802 to thereby substantially conceal the recess 802 and the light source 804 from view when the lighted hat 10 is in the first position (FIGS. 35 and 36). Being malleable, the segments 812 can be manipulated to bend at a rearward portion 818 thereof to the second position and hold the position until a wearer of the hat desires to bend the wire 812 back to the first position. By another approach, the door 810 can be connected to the brim 16 by a pivot point or hinge 816 (FIGS. 37 and 38). The hinge 816 can include a stop surface or rotation lock to prevent over opening of the door 810. The door 810 may further include a switch 820 configured to actuate when the door 810 is pivoted to the second position to thereby energize the light source 804.

Figure 39:
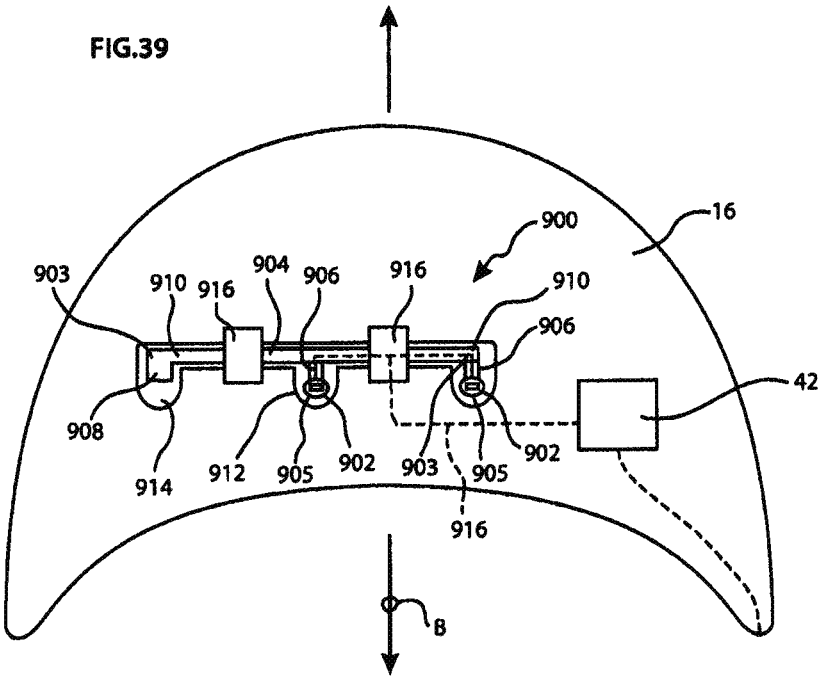
FIG. 39 is a bottom plan view of a brim for a lighted hat having a rotatable light mechanism received therein.
Figure 40:
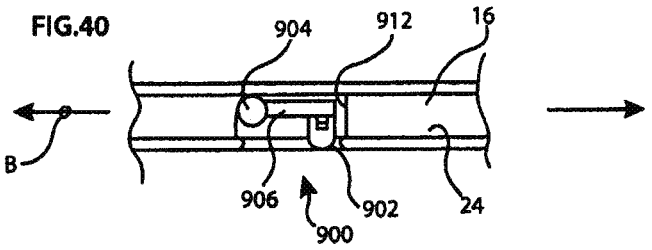
FIG. 40 is a cross-sectional side elevation view of the brim of FIG. 39 showing the light mechanism in a first or stowed position.
Figure 41:
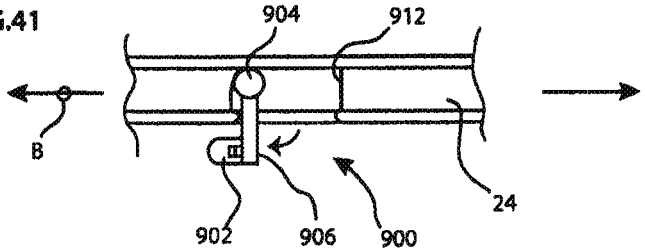
FIG. 41 is a cross-sectional side elevation view of the brim of FIG. 39 showing the light mechanism in a second or use position.

Turning now to FIGS. 39-41, the lighted hat 10 includes a rotatable light mechanism 900. The rotatable light mechanism 900 includes a pair of light sources 902 mounted to an elongate connecting rod 904. As shown, one of the light sources 902 is mounted to one end portion 910 of the connecting rod 904 and the other of the light sources 902 is mounted intermediate of rod ends 903. Additionally, the light sources 902 may be mounted to the connecting rod 904 by transverse spacer members 906. The light sources 902 may further be received in a housing, hood, or bezel 905 connected to the transverse spacer members 906. The housing 905 can provide an opaque blinder surface to deflect or block incident or stray light emitted by the light sources 902. This can advantageously prevent light from being emitted into a wearer's eyes or glasses. The connecting rod 904 can also include a handle 908 at the other end portion 910 thereof to provide a wearer of the lighted hat 10 a convenient grip to rotate or pivot the mechanism 900.

Preferably, the mechanism 900 is mounted to the brim 16 within a recess or cut-out portion 912 of the brim insert 24. As illustrated, the recess 912 is shaped to generally conform to the shape of the connecting rod 904, the spaces 906, and the light sources or bezels 902, 905. Additionally, the recess 912 may also include an access portion or cavity 914 adjacent the handle 908 to provide access room to the handle 908 for a user's finger. The mechanism 900 can be mounted within the recess 912 by a bracket or span of material 916 connected to the brim 16 by a suitable method, such as through the use of adhesive, hardware, ultrasonic welding, or the like. The connecting rod 904 is configured to pivot or be rotated within the recess 912 and can include a locking or latching mechanism to hold the connecting rod 904 at desired angles.

So configured, the mechanism 900 is configured to pivot between a stored configuration wherein the light sources are substantially aligned with the brim 16 and concealed within the brim 16 (FIG. 40) and a use configuration where the light sources are rotated out to direct light away from the brim (FIG. 41). The mechanism 900 can stay in the stored configuration by friction fit, a locking or latching mechanism, or the like. The mechanism 900 may further include less or more light sources 902, as desired. As shown, the light sources 902 can be connected to the switch 42, such as by including wires 916 extending from the light sources 902 at least partially down the connecting rod 904 and into the brim 16. The light sources 902 can then be electrically connected to the power source 44 in the crown 14 of the lighted hat 10 or the power source module 200 discussed above. Additionally, a switch 920 may be provided in the brim 16 adjacent or in the recess 912 to actuate when the connecting rod 904 and the light sources 902 are pivoted to the use configuration to thereby energize the light sources 902. The switch 920 can then further be configured to turn off the light sources 902 when the connecting rod 904 is pivoted to the stored configuration.

The elongate connecting rod 904 may alternatively be a self-contained lighting module including all components to energize the light source, such as batteries (coin-cell, cylindrical, or the like). In addition, the mechanism 900 may also include an auto switch so that when the rod 904 is pivoted to the use configuration, the lights 902 are automatically energized.

Figure 42:
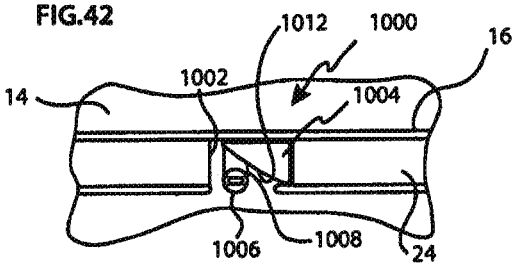
FIG. 42 is a cross-sectional side view of a brim for a lighted hat showing a slidable light module in a first position.
Figure 43:
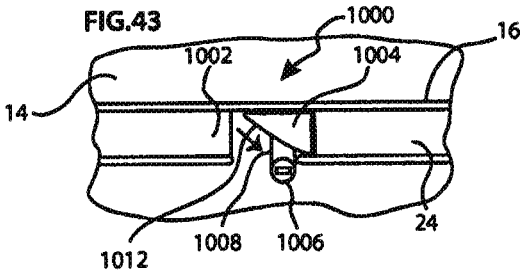
FIG. 43 is a cross-sectional side view of the brim of FIG. 42 showing the slidable light module in a second position.
Figure 44:
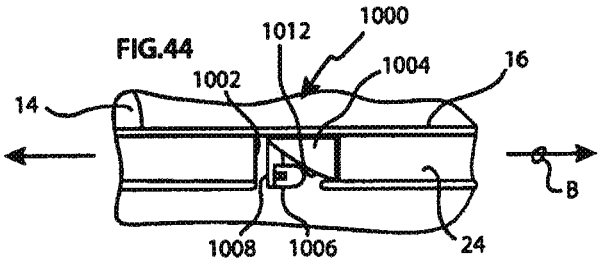
FIG. 44 is a cross-sectional side view of a brim for a lighted hat showing a slidable light module in a first position.
Figure 45:
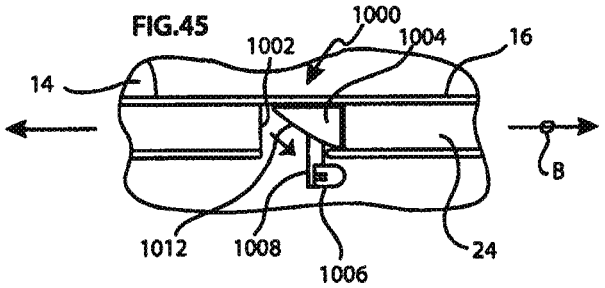
FIG. 45 is a cross-sectional side view of the brim of FIG. 44 showing the slidable light module in a second position.

Turning now to FIGS. 42-45, exemplary slide down mechanisms 1000 are illustrated. The slide-down mechanisms 1000 are mounted within a recess or cut-out portion 1002 of the brim 16, and specifically the brim insert 24. The mechanisms 1000 include a base portion 1004 mounted to the brim 16 and a light source 1006 slidably connected to the base portion 1004 by a spacer 1008. As shown, the base portion 1004 includes an angled or inclined surface 1010 to which the spacer 1008 is slidably attached by an inclined channel, track, tongue-and groove, or the like 1012. So configured, the light source 1006 can be manipulated between a stored configuration where the light source 1006 is substantially concealed and held within the brim 16 (FIGS. 42 and 44) and a use configuration where the light source 1006 is slid downwardly and hangs below the brim 16 to direct light forwardly of the lighted hat 10 (FIGS. 43 and 45), such as generally along the brim axis B. The light source 1006 can be mounted to the spacer 1008 so that the light source 1006 is translated downward in an inclined direction along the brim axis B away from the crown 14 of the lighted hat 10, as shown in FIGS. 44-45, or so that the light source 1006 is translated downward in a direction generally transverse to the brim axis B laterally parallel to the crown 14 of the lighted hat 10, as shown in FIGS. 42-43. The slide down mechanisms may also employ an automatic switch so that the light source 1006 is automatically energized when slid to the use position.

Figure 46:
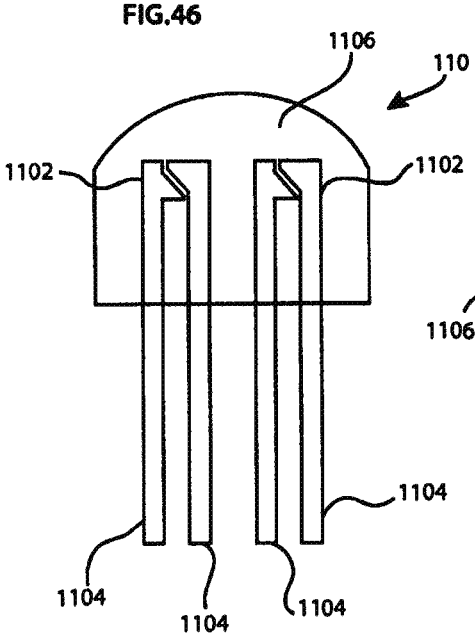
FIG. 46 is a front elevation view of a double LED having two illumination chips therein.
Figure 47:
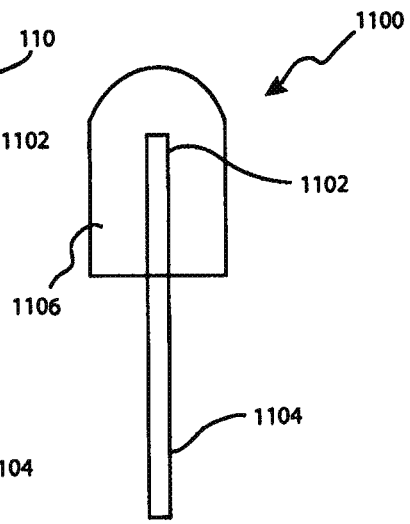
FIG. 47 is a side elevation view of the double LED of FIG. 46.

Referring now to FIGS. 46-47, a double LED 1100 is shown in a single lens envelope. The double LED 1100 has the depth of a regular LED, but has a width sized so that the LED includes two illumination chips 1102 and four leads 1104 projecting therefrom. The double LED 1100 provides the illumination of two LEDs with a single lens envelope 1106. The double LED 1100 can be utilized with any of the lighted headgear described herein. One example double LED 1100 has a depth of about 3 mm and a width of about 6 mm. As shown in FIG. 47, the double LED 1100 maintains the narrow depth of a traditional LED by aligning the illumination chips 1102 and the leads 1104 from the two illumination chips. This advantageously allows the double LED 1100 to be mounted to narrow depth areas, while still being able to provide twice the illumination.

Figure 48:
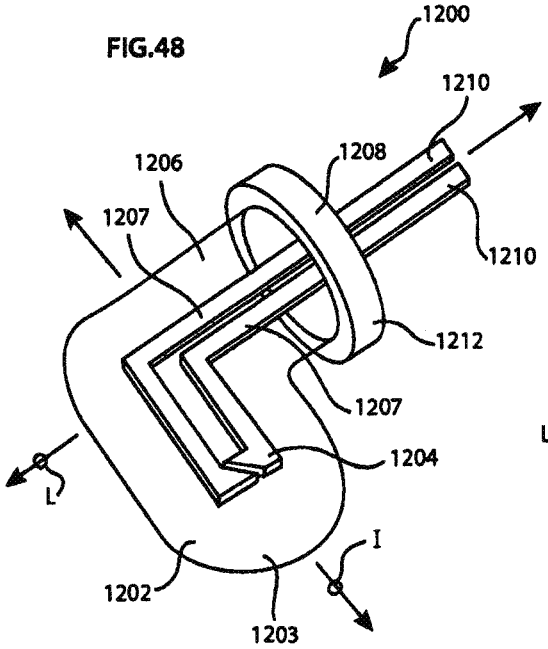
FIG. 48 is a perspective view of an inclined LED having an outwardly extending right-angle flange with leads extending therethrough.

As shown in FIGS. 48-71 various inclined or angled LEDs 1200 are illustrated, as well as various lighted hat 10 configurations utilizing the inclined LEDs 1200. As shown, the LEDs 1200 are configured to project illumination generally transverse or at an incline relative to a mounting base of the LED, but any angle of inclination may be used. A right angle may be preferred. The LED 1200 includes a base or rear portion 1206 with a base axis L extending therethrough. The base 1206 extends along the axis L to a forward lens portion 1202 including an LED or illumination chip 1204. The generally cylindrical forward lens portion 1202 has a dome or cap 1203 thereon that extends along an illumination axis I that is transverse to the base axis L. The forward lens portion 1202 has the illumination chip 1204 therein that also extends transverse to the base axis L along the illumination axis I to project light therealong. The forward lens portion 1202 connects to the rear lens portion 1206 that extends along the LED or base axis L and includes illumination connectors or wiring 1207 (connected to the chip 1204) therein that also travel along the LED axis L. So configured, the illumination axis I is inclined with respect to the LED axis L. This allows the inclined LED 1200 to project light at an angle to the axis L that the illumination connectors 1207 of the rear lens portion 1206 extends. In contrast, traditional LEDs extend along a single axis, which requires that the LEDs be mounted at an angle or an additional housing be provided to project light at an angle. The rear lens portion 1206 then connects to a base 1208. The illumination chip 1204 is electrically coupled to contacts or leads 1210 mounted to or extending through the base 1208 through the illumination connectors 1207. As shown in FIG. 48, the leads 1210 extend along the LED axis L. This configuration mounts the illumination chip 1204 generally transverse to the leads 1210.

In one form as shown in FIG. 48, the base 1208 includes a radially outwardly projecting flange 1212 through which the leads 1210 extend. In one example of an inclined LED, the illustrated LED projects light at a right angle to the base and the leads, the flange 1212 has a diameter of about 5 mm and height of about 1.5 mm, the rear lens portion 1206 has a diameter of about 3 mm and a height of about 2.5 mm; and the forward lens portion 1202 has a diameter in the range of about 3 mm to about 5 mm and a length of about 7 mm.

Figure 49:
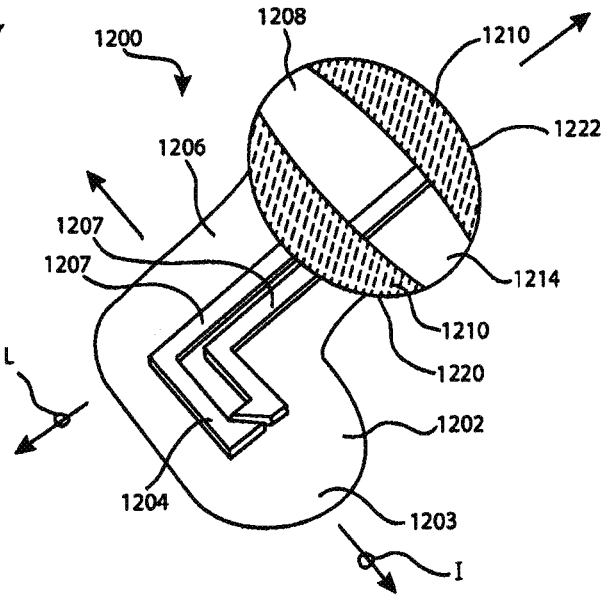
FIG. 49 is a perspective view of an inclined LED having a spherical base with electrical contacts on top and bottom surfaces of the base.
Figure 50:
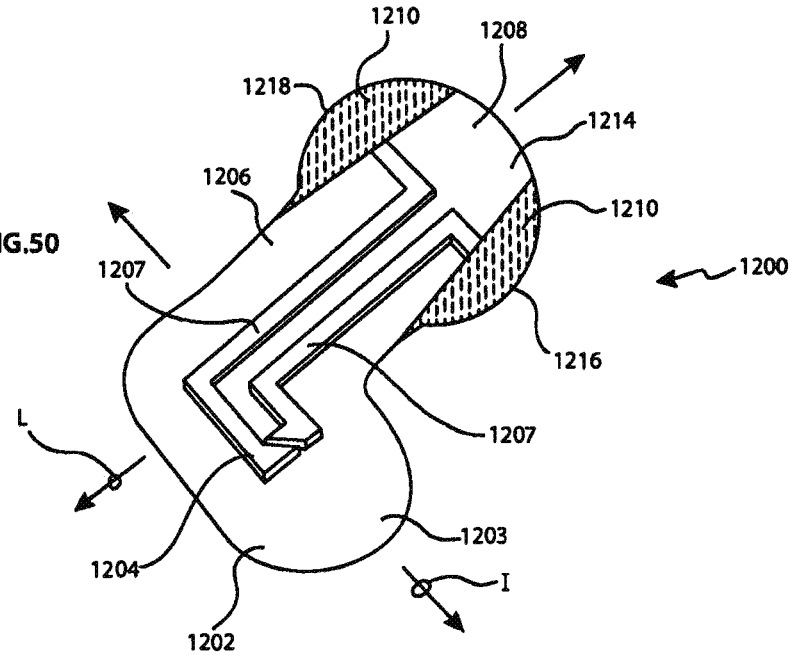
FIG. 50 is a perspective view of an inclined LED having a spherical base with electrical contacts on side surfaces of the base.

In another form as shown in FIGS. 49-50, the base 1208 includes a generally spherical or otherwise rounded portion 1214, which provides pivoting or rotation capabilities for the LED 1200. By one approach, the electrical LED contacts 1210 are in the form of electrically conducting material, such as a metalized coating, disposed on forward and rearward surfaces 1216, 1218 of the rounded portion 1214 as shown in FIG. 50, on side surfaces of the spherical portion 1214, or on top and bottom surfaces 1220, 1222 of the spherical portion 1214 as shown in FIG. 49. As illustrated, the illumination connectors 1207 extend from the rear lens portion 1206 and angle to extend to the contacts 1210 disposed on the surface of the base 1208. The leads 1210 then electrically couple to the conducting material of the contacts 1210. Use of the coating 1210 eliminates the traditional extending or protruding leads.

Figure 51:
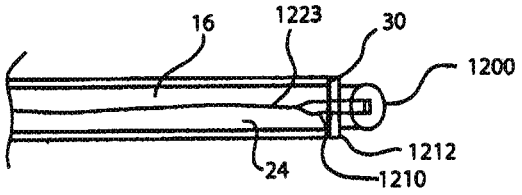
FIG. 51 is a cross-sectional front elevation view of a brim for a lighted hat having the LED of FIG. 48 mounted to an edge thereof.
Figure 52:
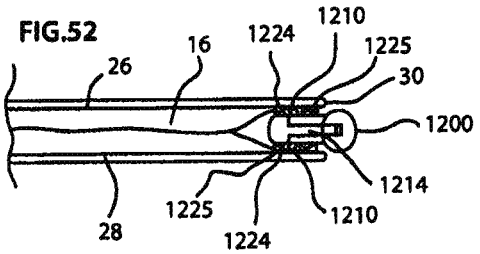
FIG. 52 is a cross-sectional front elevation view of a brim for a lighted hat having the LED of FIG. 50 mounted to an edge thereof.
Figure 53:
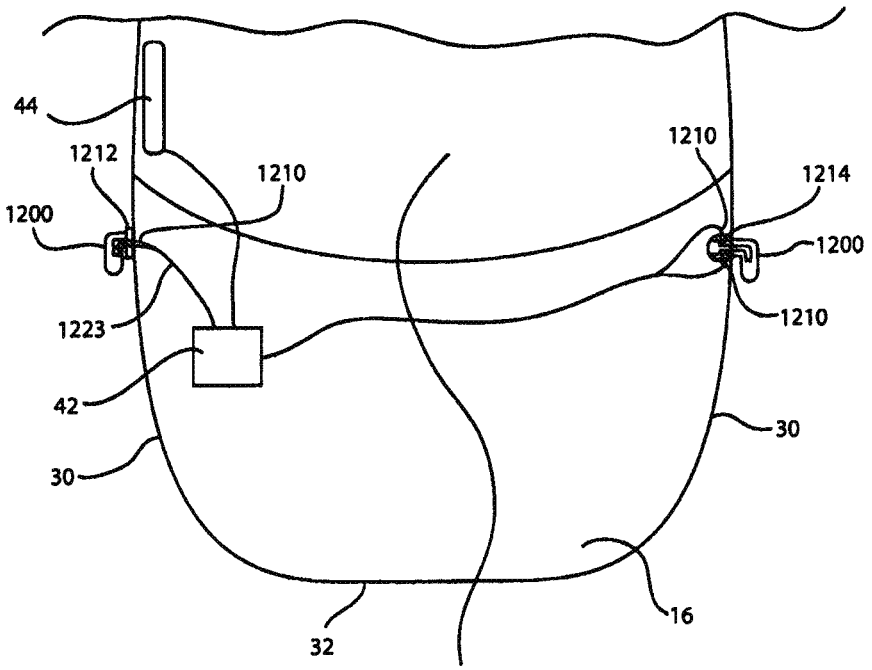
FIG. 53 is a top plan view of the brims of FIGS. 51 and 52 showing the LEDs connected to a switch in the brim.

The various forms of the inclined LED 1200 can then be mounted to headgear, such as to the side edge 30 or the front edge 32 of the brim 16 to project light forwardly of the lighted hat 10. As shown in FIGS. 51-53 the LED 1200 is mounted to the side edge 30, but it also may depend below or above the brim major surfaces 26, 28 in a similar manner. In the form having the flange 1212 (FIG. 48), the inclined LED 1200 can simply be inserted into the brim 16 by inserting the leads 1210 that extend generally perpendicularly from the flange 1212 through the piping 40 of the edge 30, 32 of the brim 16 into the brim insert 24. An example is shown on the left side of the hat brim in FIG. 53 and FIG. 51. Electrical connections 1223 can then be provided in the brim 16 adjacent the edge 30, 32 to electrically couple the leads 1210 to the switch 42 and power source 44. In this form, the brim 16 can include the module reception portion 510 and the clamping mechanism 514 as described above with respect to the light hood 500 in FIGS. 24 and 25. By another approach, the inclined LED 1200 with the flange 1212 can be wired directly into the lighted hat 10, such as to the switch 42 and the power source 44 (FIG. 53). Alternatively, the LED 1200 could be electrically coupled to the power source module 200 as described above with reference to FIGS. 4-10.

The inclined LED 1200 having the spherical base 1214 (FIGS. 49 and 50) may be mounted partially within the brim 16, as shown on the right side of the hat brim in FIG. 53 and FIG. 52 (it will be appreciated that FIG. 53 is only intended as an example and may include the same type of LED on both sides, which may be any of the inclined LED types set forth herein). In this form, the brim 16 includes a recess or socket 1224 disposed between or adjacent the upper and lower major surface portions 26, 28 configured to receive the base 1214 of the LED 1200 therein (FIG. 53). The socket 1224 can include electrical contact portions 1225 about a periphery thereof composed of an electrically conductive material, such as a metalized coating, that are configured to electrically couple with the contacts 1210 of the electrically conducting material on the LED 1200. The contact portions 1225 of the socket 1224 can be disposed on upper or lower surfaces or forward and backward surfaces of the socket 1224 to permit electrical communication with the LED 1200 even when pivoted to various configurations of the light. If desired, the contact portions 1225 may be disposed on limited portion of the periphery of the socket 1224, such as portions that align the LED 1200 in a desired direction when electrically coupled to the contact portions 1225. In this configuration, a wearer could then rotate or pivot the LED 1200 in the socket 1224 to break the electrical connection and de-energize the LED 1200. The inclined LEDs can also be electrically coupled to the switch 42 to be controlled thereby and the power source 44 to be powered thereby (FIG. 53). Alternatively, the LED 1200 could be coupled to the power source module 200 as described with reference to FIGS. 4-10 above to be powered thereby.

Figure 57:
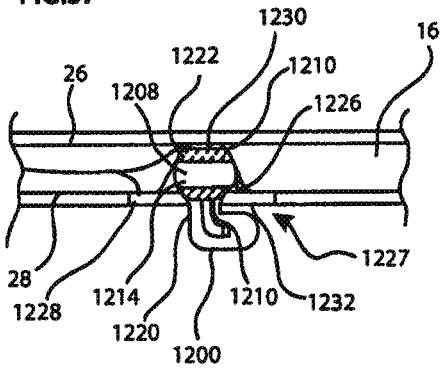
FIG. 57 is a cross-sectional side elevation view of a brim for a lighted hat having the LED of FIG. 49 mounted thereto to extend through a bottom surface thereof.

Turning to FIG. 57, the inclined LED 1200 with the spherical base portion 1214 having contacts on the top and bottom surfaces 1220, 1222 thereof (i.e. FIG. 49) can also be mounted adjacent or through the lower major surfaces 28 of the brim 16 (a similar configuration could be utilized to mount the LED 1200 adjacent or through the upper major surface 26 of the brim 16). In this form, a recess or cut-out portion 1226 is provided in the lower surface 28 of the brim insert 24, which forms an opening 1227 in the lower major surface 28 of the brim 16. As illustrated, the recess 1226 includes inclined or tapered side walls 1229 that extend outwardly from the upper major surface 26 to the lower maj or surface 26 or adjacent thereto. Alternatively, a rounded recess or socket could be utilized to receive the base 1208 therein. A first contact 1228 is mounted to the brim 16 adjacent the lower major surface 28 thereof to partially span the opening 1227. The first contact 1228 is sized to allow the rear base portion 1206 of the LED 1200 to pass therethrough, but engage or abut the top surface 1220 of the base 1208. Advantageously, the first contact 1228 is made of electrically conductive material and electrically couples with the contact 1210 of conductive material provided on the top surface 1220 of the base 1208. A second contact 1230 is provided adjacent the upper major surface 26 of the brim on a bottom portion 1229 of the recess 1226. So configured, the second contact 1230 receives and engage the bottom surface 1222 of the base 1208. The second contact 1230 can be composed of an electrically conductive material and can then electrically couple to the contact 1210 of electrically conductive material on the bottom surface 1222 of the base 1208 of the inclined LED 1200. As desired, the contacts 1210 of the LED can be extended entirely around the circumference of the top and bottom surfaces 1220, 1222 of the base 1208, which would allow the LED 1200 to be rotated 360 degrees while remaining in an energized state. Alternatively, the contacts 1210 could be disposed on portions of the top and bottom surfaces 1220, 1222 so that the LED 1200 is aligned in a desired direction when energized and de-energized when rotated away from the desired orientation, such as by about 20 degrees in either direction.

Figure 54:
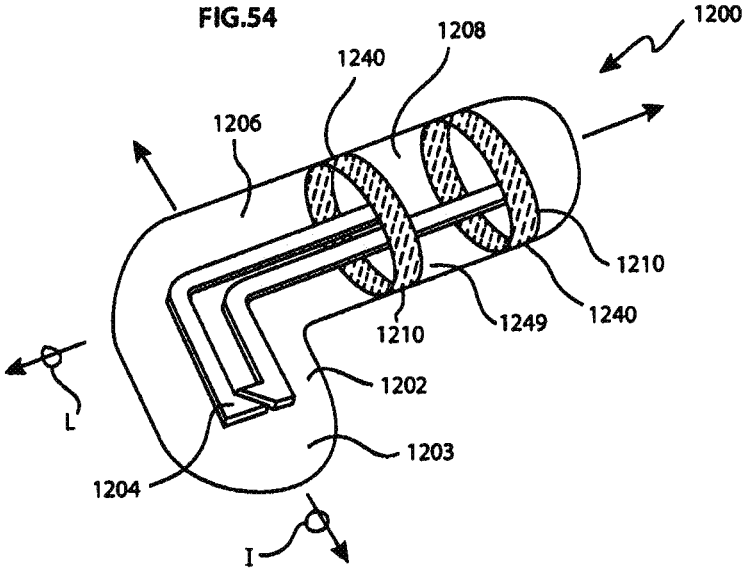
FIG. 54 is a perspective view of an inclined LED having a cylindrical base with electrical contacts therearound.

Another form of the inclined LED 1200 is illustrated in FIG. 54. This LED is similar to the LED of FIG. 48 except for a modified base portion 1208. In this form, the LED 1200 includes a base 1208 that is a generally cylindrical member 1249 and extends along the LED axis L with a generally constant diameter therealong with the rear lens portion 1206. The base 1208 includes first and second circumferential electrical contacts 1210 thereround in the form of strips of electrically conductive material that form generally circumferential contacts 1240 disposed on an outer surface of the base 1208. The contacts 1240 couple to the illumination connectors 1207 that extend from the rear lens portion 1206 along the LED axis L, which are electrically coupled to the illumination chip 1204, which extends along the illumination axis I.

Figure 55:
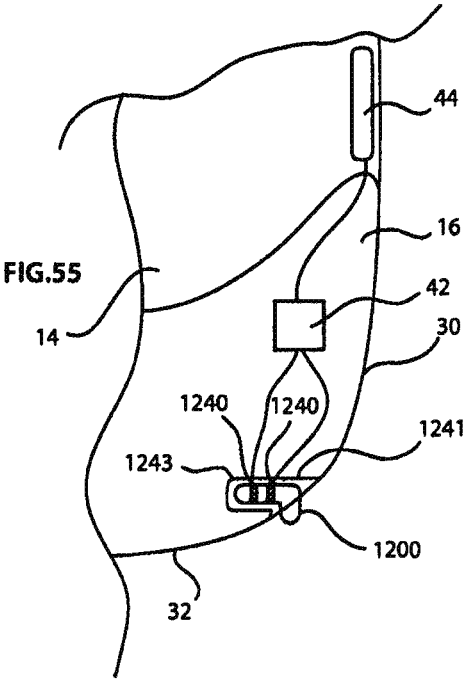
FIG. 55 is a sectional top plan view of a brim for a lighted hat having the inclined LED of FIG. 54 mounted at an edge thereof and connected to a switch.
Figure 56:
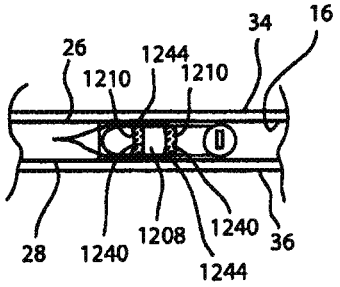
FIG. 56 is a cross-sectional side elevation view of the brim of FIG. 55.

The inclined LED 1200 of FIG. 54 can be mounted within a recess or cut-out portion 1241 provided in the brim 16 as shown in FIGS. 55-56 to direct light forwardly of the lighted hat 10. Due to the configuration of the contacts 1240 extending around the entire perimeter of the base 1208, electrical contacts 1244 mounted in the brim 16 can be disposed adjacent the upper and/or lower major surfaces 26, 28. By one approach, the recess 1241 is generally cylindrical along an interior portion 1243 thereof and includes generally cylindrical contacts 1244 therein positioned to electrically couple with the contacts 1210 of the LED 1200 when the LED 1200 is inserted in the recess 1241. The contacts 1244 then electrically couple with the switch 42 and power source 44 to be controlled thereby. The LED 1200 of this form may be held in the recess 1241 by a clamping mechanism, a clip mechanism, biased member, or the like 1242 (FIG. 58) configured to engage the base 1208 of the LED 1200 or the like. Alternatively, a latch or the like can be provided adjacent to the edge 30, 32 of the brim 16 outwardly of the forward lens portion 1202 of the LED 1200. So positioned, the latch can releasably hold the LED 1200 in the recess 1241.

Figure 58:
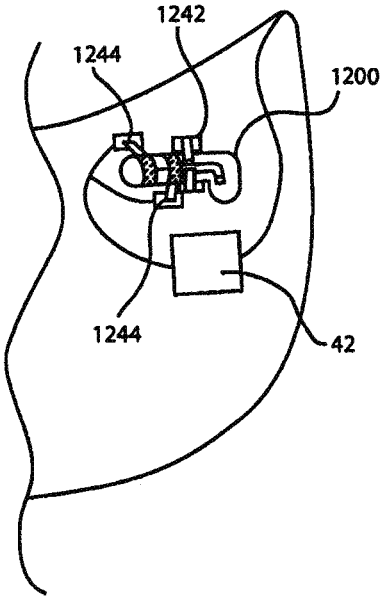
FIG. 58 is a bottom plan view of a brim for a lighted hat having the LED of FIG. 54 mounted thereto and connected to a switch.
Figure 59:
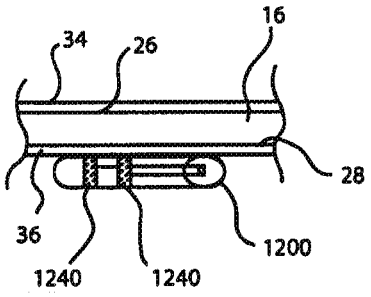
FIG. 59 is a sectional side elevation view of the brim of FIG. 58.

By another approach, the inclined LED 1200 of FIG. 54 can be mounted to the upper or lower major surface 26, 28 or to the upper or lower covering 34, 36 of the brim 16, as shown in FIGS. 58-59. A clamp mechanism 1242 can be secured to the upper or lower surface 26, 28 of the brim 16 as desired to receive and secure the base 1208 of the LED 1200 to the brim 16. Brim contacts 1244 can then be mounted to the brim 16 adjacent to the clamping mechanism 1242 and positioned to electrically contact and couple to the contacts 1240 of the LED 1200. Preferably, the brim contacts 1244 extend downwardly from the brim along sides of the LED 1200 along the perimeter of the base 1208 to ensure electrical engagement with the electrical contacts 1240 on the LED 1200. As shown in FIG. 58, the LED 1200 can electrically couple to the brim contacts 1244 which are electrically coupled to the switch 42 and power source 44. Alternatively, the power source module 200 discussed above with respect to FIGS. 4-10 could electrically couple to the brim contacts 1244.

Figure 60:
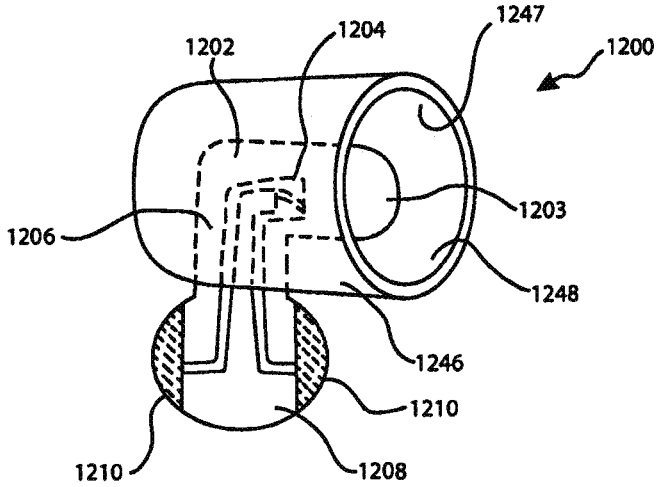
FIG. 60 is a perspective view of the LED of FIG. 50 having a hood therearound.

FIG. 60 illustrates the inclined LED 1200 of FIG. 50 having the spherical portion 1214 for the base 1208 mounted to a hood, bezel, or other housing 1246 disposed therearound. It will be appreciated that any of the LEDs described herein may be mounted to the hood 1246. That is, the LED of FIG. 50 with the spherical portion 1214 is shown, but the hood 1246 can be utilized with any base 1208 configuration. In the illustrated form, the hood 1246 is disposed around the forward and rear lens portions 1202, 1206. By another approach, the hood 1246 could extend around the forward lens portion 1202 alone, or could extend around portions of the base 1208 as well. The hood 1246 extends from a position rearward of the illumination chip 1204 to a position forwardly of the illumination chip 1204 to function as an opaque blinder surface to deflect or block incident or stray light. That may shine downwardly with respect to a lighted hat on which the LED 1200 is mounted that can shine into a wearer's eyes, cause a glare in a wearer's glasses, or the like. By one approach, the hood 1246 is opaque to block the stray or incident light. By another approach, the hood 1246 can include a reflective layer or coating 1247 on an inner surface 1248 thereof configured to reflect the stray or incident light generally forwardly of the lighted hat 10.

Figure 60A:
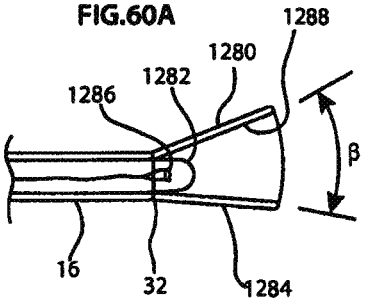
FIG. 60A is a cross-sectional side elevation view of a brim for a lighted hat having a light source and an associated light altering cone mounted thereto.

FIG. 60A illustrates a hood, cone, or reflector member 1280 mounted to one of the edges 30, 32 of the brim 16 of the lighted hat 10, such as adjacent to or forwardly of a light source 1282. The reflector member 1280 may be mounted within the brim 16 to extend through one of the edges 30, 32 of the brim 16. Alternatively, the reflector member 1280 may be mounted to one of the edges 30, 32 to extend away therefrom. Preferably, the reflector member 1280 extends away from a position rearwardly of an illumination chip 1286 within the light source 1282 to a position forwardly of the illumination chip 1286. An interior surface 1288 of the reflector member 1280 may include a light altering coating thereon, such as a reflective coating (i.e. a metalized material or the like) or an opaque coating. As illustrated, the reflector member 1280 includes an outwardly tapering sidewall 1284 forming a generally frusto-conical shape. By one approach, the angle of the frusto-conical shape can generally coincide or match a cone of illumination β emitted from the light source 1282. So configured, the cone of the illumination β is not interfered with by the reflector member 1280, but the reflector member 1280 is advantageously positioned to block or reflect incident or stray light outside of the angle of the cone of illumination β. As illustrated, the reflector member 1280 extends a distance generally twice a length of the light source 1282 or more; however, the reflector member 1280 can be shorter as desired.

Figure 61:
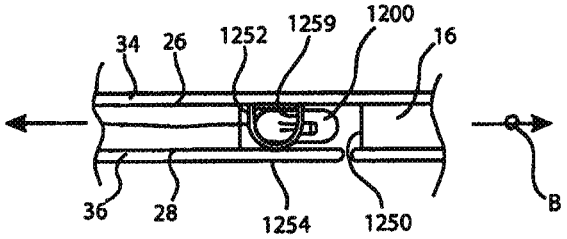
FIG. 61 is a cross-sectional side elevation view of a brim for a lighted hat in a first or stored position showing an inclined LED mounted to the brim in a recess covered by a door.
Figure 62:
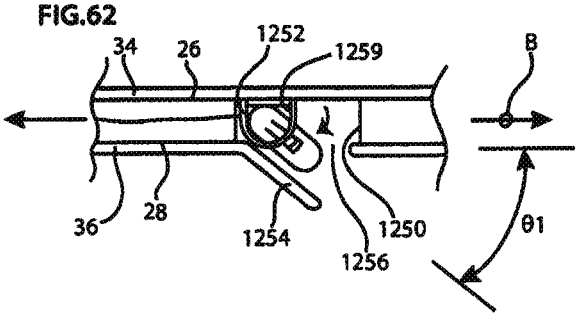
FIG. 62 is a cross-sectional side elevation view of the brim of FIG. 61 in a second or use position showing the inclined LED and the door pivoted to a downward orientation.

In another form as shown in FIGS. 61-62, the inclined LED 1200 can be rotatably secured within a recess or cut-out portion 1250 formed in the brim 16. A clamping mechanism, a biased member, a clip, or the like 1252 is provided in the recess 1250 adjacent or mounted to the upper major surface 34 of the brim 16 to rotatably receive and secure the LED 1200 within the recess 1250. The LED 1200 can utilize a variety of shapes for the base 1208 thereof, as has been described herein. For example, the spherical portion 1214 or the cylindrical base 1249 can be rotatably secured within the recess 1250 with the clamping mechanism 1252. The clamping mechanism 1252 can be a socket, d-ring, or the like. The recess 1250 forms an opening 1256 (FIG. 62) in the lower major surface 28 through which the LED 1200 can be inserted. Advantageously, an electrically conductive material forming electrical contacts 1259 can be provided on the socket 1252 to electrically engage the contacts 1210 disposed on the base 1208 of the LED 1200. A pivotable or shiftable door 1254 may be provided to span the opening 1256 to substantially conceal the inclined LED 1200 and the recess 1250 when the lighted hat 10 is in the stored configuration with the inclined LED 1200 directed generally along the brim axis B and the door 1254 generally flush with the lower major surface 28 of the brim 16 or the lower covering 36 (FIG. 61). Then, as desired, the inclined LED 1200 can be manipulated or rotated within the socket 1252 from the stored position generally aligned with the brim axis B to a position generally transverse or at the angle θ1 to the brim axis B to direct light to the viewing or working area discussed above (FIG. 62). The angle θ1 can range from about 1 degree to about 25 degrees, and preferably between about 10 degrees to about 20 degrees. The door 1254 can include malleable cross or support structure with fabric disposed thereon, a pivot point or hinge, or the like to be rotatable between the stored configuration and the use configuration. A switch, such as a pushbutton switch, slide switch, or the like can be provided adjacent the door 1254 to automatically energize the LED 1200 when the door is pivoted to the use configuration and de-energize the LED 1200 when the door is pivoted to the stored configuration. Additionally, the LED 1200 may be electrically coupled to other hat components as described herein to control and power the LED 1200. A configuration through the lower major surface 28 of the brim 16 is illustrated, but the LED 1200 could also be mounted to or through the upper major surface 26 using similar structure.

Another form of the inclined LED 1200 is shown in FIGS. 63-67. In this form, the base 1208 of the LED 1200 extends generally transversely to the LED axis L of the rear lens portion 1206. In the illustrated form, the base 1208 further extends generally transversely to the illumination axis I of the forwardly lens portion 1202 and to the LED axis L of the rear lens portion 1206 along a transverse axis T. As shown, the base 1208 is generally T-shaped 1261 with two outwardly protruding ends 1260. By one approach, the ends 1260 include radially outwardly facing flat portions 1262 positioned circumferentially around the ends 1260 to form a nut shaped profile with a plurality of adjacent flat portions about the circumference of the ends 1260.

Figure 63:
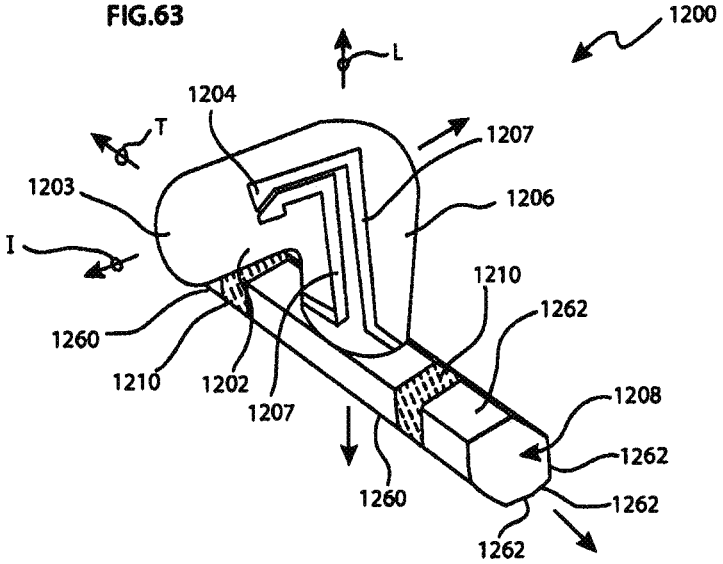
FIG. 63 is a perspective view of an inclined LED having a base with outwardly protruding ends having radially flat portions therearound.
Figure 64:
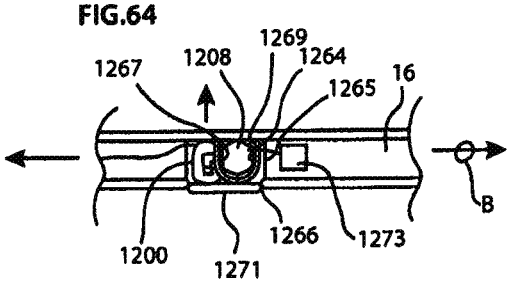
FIG. 64 is a cross-sectional side elevation view of the LED of FIG. 63 in a first or stored position.
Figure 65:
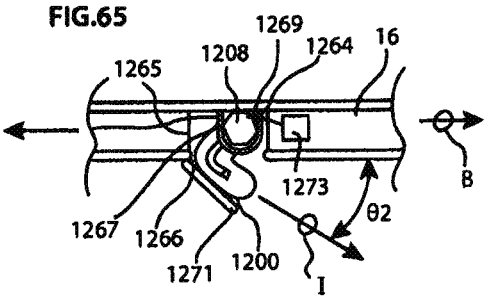
FIG. 65 is a cross-sectional side elevation view of the LED of FIG. 63 in a second or inclined use position.
Figure 66:
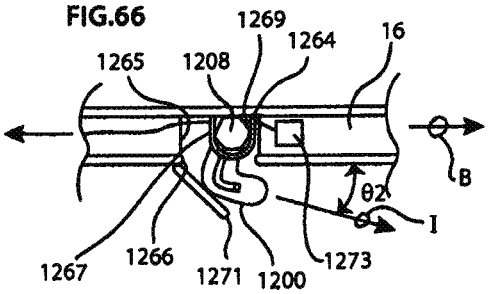
FIG. 66 is a cross-sectional side elevation view of the LED of FIG. 63 in a third or intermediate inclined use position.
Figure 67:
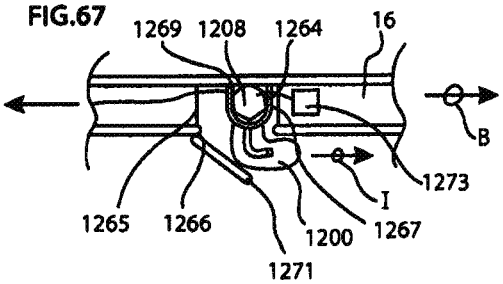
FIG. 67 is a cross-sectional side elevation view of the LED of FIG. 63 in a fourth or forwardly oriented use position.

Turning now to FIGS. 64-67, the LED 1200 of FIG. 63 can be mounted in a recess or cut-out portion 1265 provided in the brim 16, such as adjacent an opening 1266 provided in the lower major surface 28 of the brim 16. A socket, d-ring, clamp, or the like 1264 may be provided in the recess 1265 adjacent the upper major surface 26 of the brim 16 to rotatably secure the LED 1200 in the recess 1265. Advantageously, the socket 1264 can include flat portions 1267 that are configured to engage the flat portions 1262 of the LED 1200 to hold the inclined LED 1200 of FIG. 63 at a desired orientation when the flat portions of the hat and the flat portions of the LED cooperate and engage each other. Specifically, as the LED 1200 of FIG. 63 is manipulated or rotated within the socket 1264, the flat portions 1262 of the LED 1200 can sequentially engage the socket 1264 to hold the inclined LED 1200 at set angles θ2 with respect to the brim axis B. In the illustrated form, the inclined LED 1200 of this type is configured such that the flat portions 1262 hold the LED at angles θ2 of about 90 degrees, 30 degrees, about 15 degrees, and about 0 degrees from the brim axis B, as shown in FIGS. 64-67. Other angles could be could also be utilized. So configured, the inclined LED 1200 of FIG. 63 can be rotated or pivoted from a stored configuration where the illumination axis I of the LED 1200 is generally perpendicular to the brim axis B through the opening 1266 in the brim 16 by a wearer of the lighted hat 10 (FIG. 64) to a use configuration where the illumination axis I is at the set angles θ2 to the brim axis B (FIGS. 65-67).

Turning back to FIG. 63, the ends 1260 of the base 1208 can further include the electrical contacts 1210 therearound. The contacts 1210 of this form extend circumferentially around the perimeter of the ends 1260 and are electrically coupled to the illumination chip 1204 through the illumination connectors 1207 as described above with the other exemplary LEDs. As shown in FIG. 64-67, the socket 1264 can include corresponding electrical brim contacts 1269 on interior surfaces thereof formed of electrically conductive material configured to engage and electrically couple with the contacts 1210 of the LED. The brim contacts 1269 can then be electrically coupled to various other light components as described herein, such as the switch 42, the power source 44, the power source module 200, or the like. A configuration through the lower major surface 28 of the brim 16 is illustrated, but the LED 1200 could also be mounted to or through the upper major surface 26 using similar structure.

As shown in FIG. 64-67, the brim 16 of this form can also include a pivotable or rotatable door 1271 to span the opening 1266 to substantially conceal the LED 1200 and the recess 1265 when the LED 1200 is in a stored configuration (FIG. 64). When closed, the illumination axis I is generally perpendicular to the brim axis B, such that the door 1271 is generally flush with the lower major surface 28 of the brim 16 or the lower covering 36. The door 1271 can then be pivoted downwardly to a use configuration to accommodate the various angles θ2 of the LED 1200 (FIGS. 65-67).

By another approach, a switch 1273, such as a pushbutton switch, a slide switch, or the like, can be provided adjacent the LED 1200 to automatically energize the LED 1200 when the LED 1200 is pivoted to the use configuration at the various angles θ2 described above and de-energize the LED 1200 when the LED 1200 is pivoted to the stored configuration. The switch 1273 can be configured to engage or interact with the LED 1200 or the door 1271 as desired.

Figure 68:
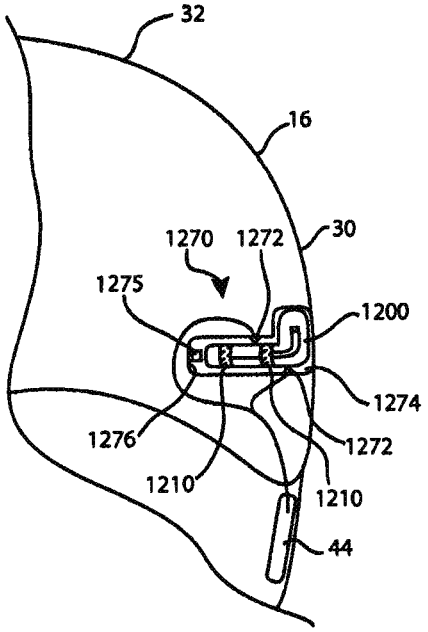
FIG. 68 is a sectional top plan view of a brim for a lighted hat having an inclined LED pushbutton mechanism therein showing the pushbutton mechanism in a first or stowed position.
Figure 69:
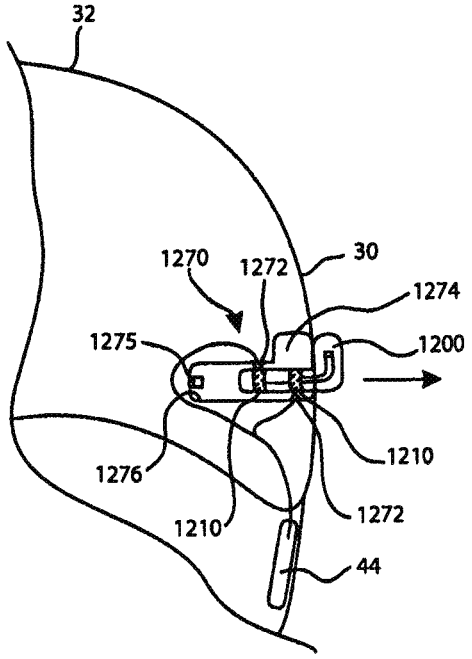
FIG. 69 is a sectional top plan view of the brim of FIG. 68 showing the pushbutton mechanism in a second or use position.

Referring now to FIGS. 68-71, any of the previously described inclined LEDs 1200 can be utilized along with a pushbutton mechanism 1270 including an actuation portion 1275 that can be actuated to translate or slide the LED 1200 between a stored configuration where the LED 1200 is generally concealed within the brim 16 and de-energized (i.e. FIG. 68) to a use configuration where the illumination chip 1204 of the LED is spaced outwardly of the edge 30, 32 or major surface 34, 36 of the brim 16 and energized (i.e. FIG. 69). As illustrated, the LED 1200 is received within a recess or cut-out portion 1274 of the brim 16 that, by one approach, generally conforms to the shape of the LED 1200 being utilized. Brim electrical contacts 1272 formed of an electrically conducting material are mounted to an interior surface 1276 of the recess 1274. Advantageously, the contacts 1272 are positioned within the recess 1274 such that the contacts 1210 of the LED 1200 electrically couple with the contacts 1272 when the LED 1200 is translated to the use configuration (FIG. 69). The contacts 1272 couple to the power source 44 provided in the crown 14 or can alternatively be coupled to the power source module 200 described herein with references to FIGS. 4-10.

Figure 70:
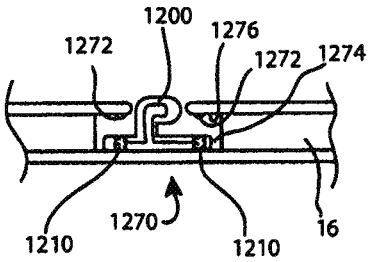
FIG. 70 is a cross-sectional side elevation view of a brim for a lighted hat having an inclined LED pushbutton mechanism in a top surface thereof showing the pushbutton mechanism in a first or stowed position.
Figure 71:
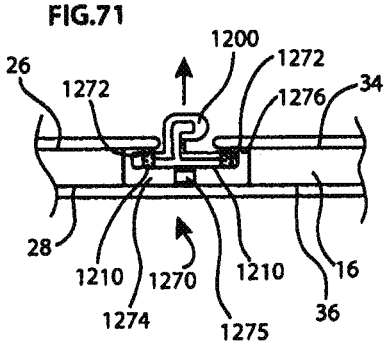
FIG. 71 is a cross-sectional side-elevation view of the brim of FIG. 70 showing the pushbutton mechanism in a second or use position.

So configured, a wearer of the lighted hat 10 can actuate the inclined LED 1200 to enable the pushbutton mechanism 1270 so that the inclined LED 1200 is shifted outward to the use configuration from the stored configuration. When the wearer has finished using the inclined LED 1200, the wearer can simply shift the inclined LED 1200 back to the stored configuration, such as by pushing the LED into the recess 1274, which breaks the circuit with the contacts 1272 in the brim 16. The pushbutton mechanism 1270 can be utilized to shift the inclined LED 1200 to the use configuration through the upper or lower major surface 26, 28; upper or lower covering 34, 36 of the brim 16 as shown in FIGS. 70-71; or through the edges 30, 32 of the brim 16 as shown in FIGS. 68-69.

Figure 72:
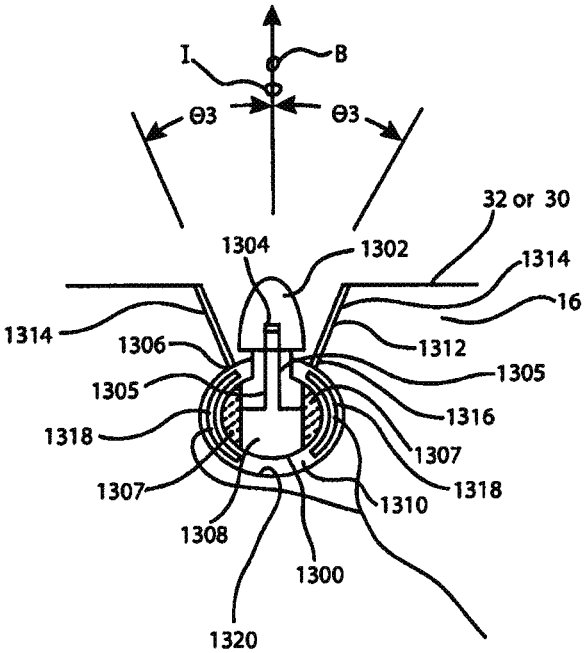
FIG. 72 is a cross-sectional top plan view of a brim for a lighted hat having a pivotable LED mounted to a brim edge thereof.

Referring now to FIG. 72, pivoting LED 1300 is illustrated mounted to one of the edges 30, 32 of the lighted hat 10 to project light forwardly thereof. In the illustrated form, the LED 1300 includes a lens portion 1302 having an illumination chip 1304 therein. A stem 1306 connects the lens portion 1302 to a spherical or otherwise rounded base 1308. As shown, the illumination axis I of the LED extends the length of the LED 1300. Illumination connectors 1305 extend between the illumination chip 1304 and contact portions 1307 provided on the base 1308 of the LED 1300. The electrical contact portions 1307 may include an electrically conductive material, such as a metalized coating or other application, and are disposed or applied on surface portions of the base 1308 to electrically couple the LED 1300 to other components of the light hat 10.

As shown, the base 1308 of the LED 1300 is received within a spherical or rounded recess or socket 1310 in the brim 16 sized to be generally complementary to the shape of the LED base 1308 so that the LED base 1308 can rotate or pivot relative thereto. Electrical brim contacts 1318 are provided on a periphery 1320 of the recess 1310 to electrically couple with the electrical contact portions 1307 of the LED 1300. The brim contacts 1318 can then electrically couple with other lighted hat 10 components as described herein. The lens portion 1302 extends forwardly of the base 1308 and is in turn received within a generally frusto-conical shaped recess 1312 in the brim 16, such as extending through the brim edge 30, 32, positioned forwardly of the rounded brim recess 1310. Sides 1314 of the frusto-conical recess 1312 taper inwardly as they extend from the edge 30, 32 of the brim 16. Preferably, an interior portion 1316 of the frusto-conical recess 1312 is slightly larger than or otherwise spaced from the lens portion 1302 or the stem 1306 of the LED 1300 so that the base 1308 can rotate or pivot back and forth within the spherical recess 1310 within the brim 16 at an angle θ3 from the brim axis B in any direction, such as between 0 and about 30 degrees, and preferably about 15 degrees depending on how the LED 1300 is mounted in the brim 16, it can pivot left, right, up, and/or down as needed to direct illumination. Advantageously, the contacts 1307, 1318 of the LED 1300 and the brim 16 (respectively) are sized to stay electrically coupled through the pivoting range of the LED 1300. For example, the brim electrical contacts 1318 may be generally arcuate and complementary to the arcuate contacts 1307 on the base 1308 as shown FIG. 72. So configured, the LED 1300 can be manipulated or pivoted by a wearer of the lighted hat 10 to direct light to a desired area forwardly of the hat 10. In another approach, the electrical contacts 1307 on the LED may only span partially circumferentially about the LED base 1308, such as on opposite sides thereof. By this approach, the LED may also function as a switch where turning of the LED can selectively electronically connect the brim and hat contacts. For example, turning the LED 1300 can space the LED contacts 1307 from the hat contacts 1318 to turn off the light.

Figure 73:
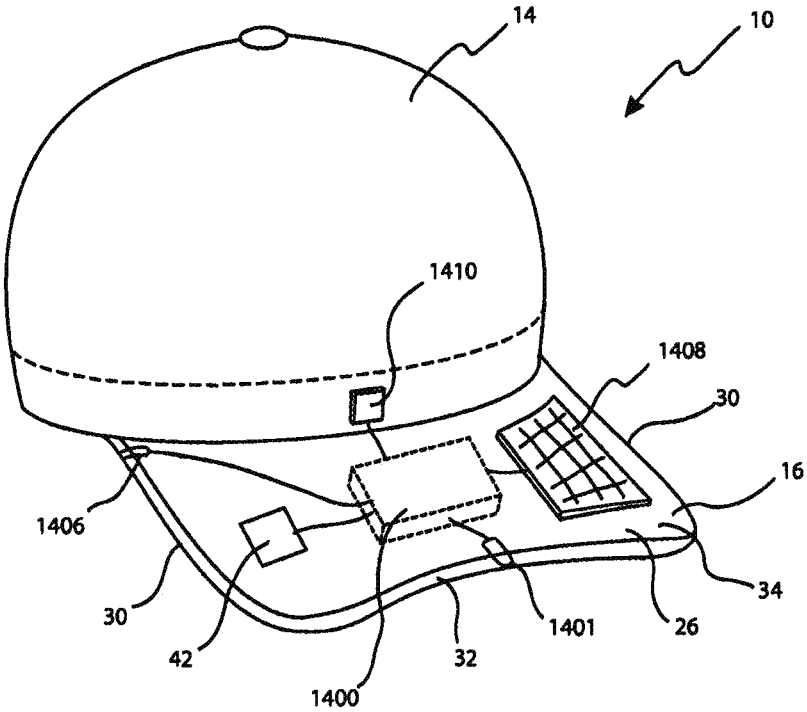
FIG. 73 is a perspective view of a lighted hat having a rechargeable battery in a brim thereof.
Figure 74:
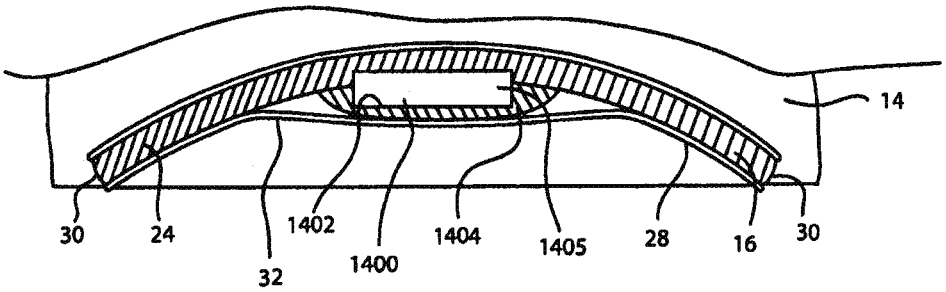
FIG. 74 is a sectional front elevation view of the lighted hat of FIG. 73.

Turning now to FIGS. 73-74, the hat 10 includes a battery 1400 at least partially disposed within the brim 16, such as within a recess or cut-out portion 1402 disposed adjacent the lower major surface 28 of the brim 16. For example, the battery 1400 can be mounted in a cavity formed between the shape-retentive brim 24 and the material 36 covering the lower surface 28 of the brim 16. After the battery 1400 is inserted or disposed into the recess 1402, a battery cap 1404, formed of a suitable resilient material such as plastic, metal, or the like, may be mounted over the battery 1400 to secure the battery 1400 at least partially within the brim 16. The battery cap 1404 can be attached to the brim insert 24 by a heat seal, a suitable adhesive, ultrasonic welding, hardware, or the like. The recess 1402 combines with the battery cap 1404 to provide a narrow battery compartment 1405 while preserving the integrity of the brim 16. As shown, the lower covering 32 is disposed below the battery cap 1404 so that the lower covering 32 substantially conceals the battery 1400 and the battery cap 1404 from view. Additionally, a natural concave curvature of the brim 16, as illustrated, may in some instances contribute to concealing the battery 1400 from outward view by people viewing the hat and preserving the traditional streamlined appearance of the hat because the battery 1400 or the battery cap 1404 do not project downwardly past the side edges 30 of the brim 16. The battery 1400 can be electrically coupled to one or more light sources 1401 mounted to the brim 16, such as has been described herein and may further be electrically coupled to the switch 42 to control power flow to the one or more light sources 1401.

By one approach, the battery 1400 may be rechargeable, such as a lithium ion battery, lead acid, nickel cadmium, nickel metal hydride, lithium ion polymer, or the like. The rechargeable battery 1400 can be recharged by a variety of recharging devices or mechanisms. For example, the lighted hat 10 can include a port 1406 configured to receive a plug that is in turn attached to an electrical supply, such as an outlet or car power port. This allows the rechargeable battery 1400 to be charged conventionally by a standard outlet. Alternatively, or in addition to the port 1406, the lighted hat 10 may include one or more solar panels 1408 configured to convert energy from the sun into electrical energy to charge the battery 1400. The solar panel 1408 can be mounted to the upper major surface 26 or upper covering 34 of the brim 16, to the crown 14, or both. The solar panel 1408 can then electrically couple to the rechargeable battery 1400 to recharge the same. By another approach, a kinetic or wind powered recharging device could be attached to the lighted hat 10 to recharge the battery 1400, such as those described in U.S. patent application Ser. No. 11/941,558, filed Nov. 16, 2007 and entitled "Hands-Free Lighting Devices," which is hereby incorporated by reference herein in its entirety.

One problem that can result during charging is that a battery can overheat or receive an overly high voltage which can compromise the integrity of the battery. Advantageously, in order to avoid such an event from occurring while the lighted hat 10 is being worn, a safety switch 1410, such as a pushbutton or the like, can be provided on the lighted hat 10, such as in the sweatband 20 of the crown 14. The safety switch 1410 is configured to decouple the battery 1400 from the various recharging sources while the hat 10 is being worn. For example, the safety switch 1410 provided in the sweatband 20 of the crown 14 is depressed by a wearer's head when the lighted hat 10 is being worn to thereby avoid charging the battery 1400 for the duration that the lighted hat 10 is worn. This prevents the rechargeable battery 1400 from overcharging or being compromised while the lighted hat 10 is being worn, while still providing a convenient and easy to use lighted hat 10 with the rechargeable battery 1400 to avoid battery changes and the like.

Figure 75:
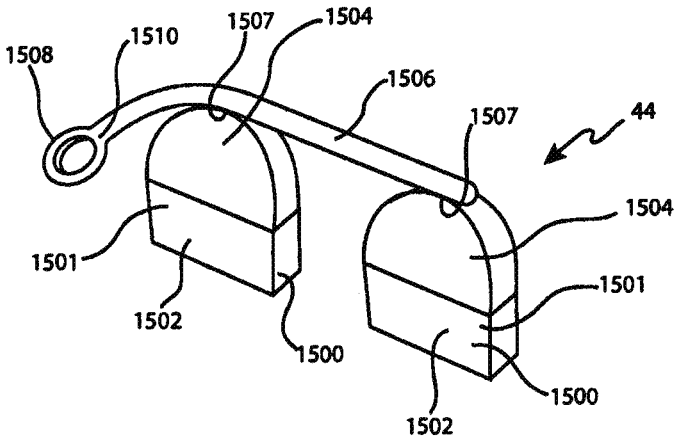
FIG. 75 is a perspective view of a power source compartment having a tether to connect power source compartments thereof.
Figure 76:
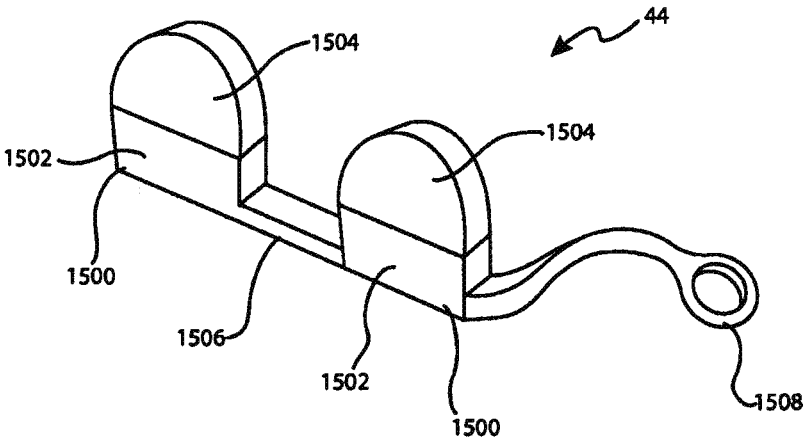
FIG. 76 is a perspective view of a power source compartment having a tether to connect power source compartments thereof.

Housing 1500 configurations for the power source 44 are shown in FIGS. 75-76. By one approach, the power source 44 includes two battery compartments 1501 that each include a base 1502 and a cover 1504. Although two compartments 1501 are shown, additional compartments could be added as desired. In the illustrated form, the base 1502 is generally rectangular and narrowly sized to receive a battery, such as a coin-cell battery, therein while also preserving a narrow depth so that the housing 1500 can be disposed in the lighted hat 10 without being conspicuous or uncomfortable. By one approach, the base 1502 is configured to rest on the connection seam between the crown 14 and the sweatband 20 of the lighted hat 10 to thereby conceal the housing 1500 from view, while the narrow depth minimizes discomfort against a wearer's head and outward bulging of the crown 14. The cover 1504 releasably secures to the base 1502 and is generally complementary to the shape of the battery for which the housing 1500 is designed. In the illustrated form, each compartment 1501 is configured to hold a single coin cell battery and accordingly the cover 1504 has a half circle configuration with a narrow depth. The compartment 1501 could alternatively include an expanded depth to house a pair of coin cell batteries in an overlapping stacked relation.

By one approach, the compartments 1501 are attached by a connecting segment or tether 1506. This provides a construction that is more flexible than a one piece compartment, which can allow the housing 1500 to generally conform to the head of a wearer. In one form, the covers 1504 of the compartments 1501 are attached by the tether 1506, such as across top surfaces 1507 thereof as shown in FIG. 75. In another form, the bases 1502 are connected by the tether 1506 as shown in FIG. 76. The tether segment 1506 can then extend outwardly from the compartments 1501 and include a loop 1508 at a distal end 1510 thereof. The loop 1508 can be secured to the lighted hat 10 to prevent accidental loss of the covers 1504. In another form, the bases 1502 are attached by the connecting segment 1506, which then again includes the loop 1508. In this form, the bases 1502 are protected against accidental loss.

Figure 77:
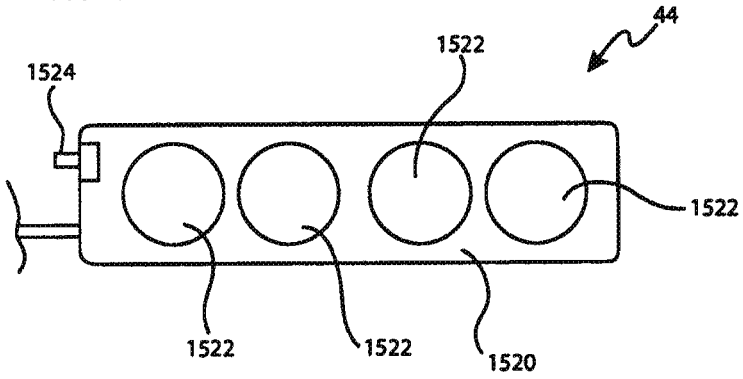
FIG. 77 is a side elevation view of a power source compartment having a master switch therein.

In another form, the power source 44 can include a single housing 1520 as shown in FIG. 77. In the illustrated form, the housing 1520 includes four coin cell batteries 1522 in a side-by-side longitudinal relation; however, the housing 1520 could be contracted or expanded to house any desired number of batteries in side-by-side, overlapping, and/or stacked configurations. The housing 1520 further includes a master power switch 1524, which can be a pushbutton switch, a slide switch, a rotary switch, or the like. The master switch 1524 is configured to control the power released by the batteries 1522 from the housing 1520. The master switch 1524 is configured to work in conjunction with a switch provided elsewhere on the lighted hat 10, such as the switch 42 discussed above mounted to the brim 16. The master switch 1524 provides a user of the lighted hat 10 the option to deactivate the ability of other switches disposed on the hat 10 to energize light sources or other components disposed on the hat 10. This feature can advantageously be utilized in situations where the other switches can inadvertently be actuated, such as when the lighted hat 10 is transported, stored, or the like, which wastes power and can shorten the life of the lighted hat components. So configured, the master switch 1524 can be left on during normal operation, but when the lighted hat 10 is stored, transported, or the like, the master switch 1524 can be turned off to prevent unintentional actuation of the switch 42 and thus preserve battery power and life.

Turning now to FIGS. 78, 79A, 79B, and 79C, a switch device 1600 having a main body portion 1601 and an upstanding actuator 1602 is shown. By one approach, the actuator 1602 is a push-button actuator having a plunger 1616 that is depressed toward the main body 1601 to actuate the switch device between on and off conditions. Once the plunger actuator is depressed a first time, the switch device will remain continuously in the "on condition" until a user again depresses the plunger actuator causing the plunger actuator to change the switch device to the "off condition." Other types of actuators may also be used.

Figure 78:
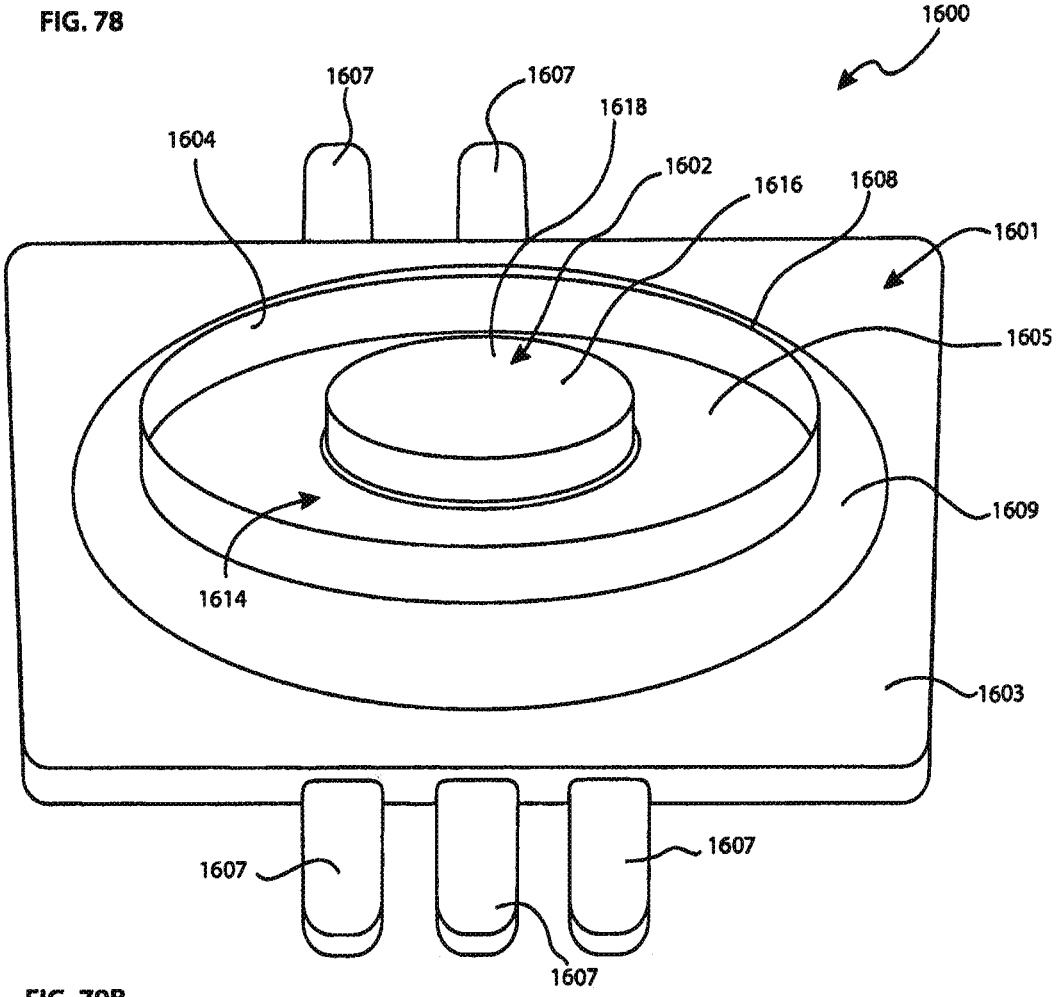
FIG. 78 is a perspective view of a switch having a guard covering wall adjacent an actuator thereof.

The switch device 1600 includes an integrally formed and upstanding flange or guard wall 1604 adjacent the actuator 1602 to provide a barrier to hinder or prevent inadvertent actuation of the actuator 1602. The main body 1601 of the switch device 1600 can have a single piece or unitary molded construction with the wall 1604, or the wall 1604 can be attached thereto after formation of the body. As illustrated, the base 1601 may also include a raised portion 1605 that extends upwardly from a lower base platform 1603 by an inclined wall 1609. The wall 1604 may be disposed on the raised portion 1605 of the switch body 1601. Alternatively, the wall 1604 may also extend upwardly from the lower platform 1603 without including the raised portion 1605. Electrical contacts 1607 extend from the switch 1600 and are configured to electrically couple with other lighted hat components, such as the power source 44, the power source module 200, the various light sources/LEDs, and/or other electrical components. By one approach, the main body portion 1601 may include a lower module portion 1610 that extends below the lower platform 1603, from which the electrical contacts 1607 extend. The contacts 1607 may extend along a lower surface of the platform 1603 and/or be received in channels or cutouts therein as best shown in FIG. 78. The lower module portion 1610 may include the various electrical and other components of the switch device 1600.

As shown in FIG. 78, the guard wall 1604 may be an upstanding annular flange that encircles the plunger portion 1616 of the switch actuator 1602, but at the same time provides a switch opening 1614 over the plunger thereby providing direct access for intentional actuation of the switch actuator 1602. The guard wall 1604 may also only partially encircle the actuator 1602 or the plunger 1616 thereof, include a plurality of spaced wall segments adjacent to or around the actuator 1602, or include wall segments on opposite sides of the actuator 1602 (such as two wall segments on opposite sides of the actuator). While the guard wall 1604 is shown having a circular shape about the actuator 1602, the wall 1604 may also have other shapes and sizes relative to the actuator 1602 so long as it functions to prevent inadvertent actuation thereof.

The guard wall 1604 provides a barrier or hard stop for the inadvertent actuation of the switch actuator 1602 by maintaining a gap between the plunger 1616 (or an actuation point 1606 of the plunger) and a distal end 1608 of the guard wall 1604. By one approach as illustrated in FIG. 79A, the guard wall 1604 extends beyond a top end 1618 of the plunger 1616 so that the upper edge 1608 of the guard wall 1604 extends further from the lower platform 1603 than the top end 1618 of the plunger 1616. Thus, to actuate the switch device 1600, a user's finger needs to be inserted through the switch opening 1614 formed by the wall 1604 and inwardly past the wall upper edge 1608 to engage the top end 1618 of the plunger 1616, which can then be depressed toward the main body platform 1603. As discussed in more detail below, surfaces or objects larger than the switch opening 1614 will generally not be able to extend therethrough to engage the plunger 1616 or other portions of the actuator 1602.

Figure 79B:
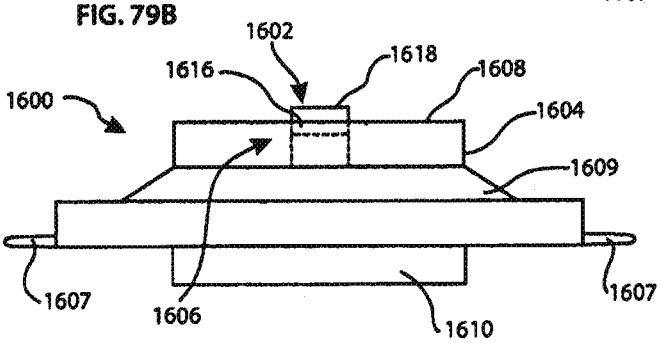
FIG. 79B is a front elevation view of an alternative arrangement of the switch of FIG. 78 showing the position of an upper edge of an actuator positioned above an upper edge of a guard wall with an actuation point below the guard wall upper edge.
Figure 79A:
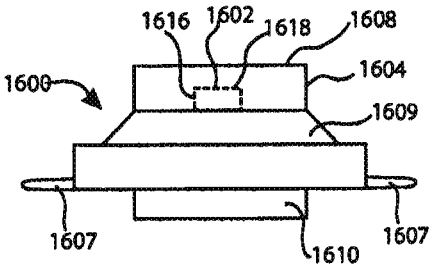
FIG. 79A is a front elevation view of the switch of FIG. 78 showing the positioning of an upper end of an actuator below an upper edge of the guard wall.

In another approach as illustrated in FIG. 79B, the top end 1618 of the plunger 1616 may extend slightly beyond the upper edge 1608 of the wall 1604, but the actuation point 1606 of the switch device 1600 (that is, the point that the switch device is triggered between its on and off conditions, for example) is recessed below the upper edge 1608 of the guard wall 1604. Thus, while the top end 1618 of the plunger 1616 can protrude beyond the upper edge 1608 of the guard wall 1604, the switch device 1600 in this approach will not be actuated until the plunger 1616 is purposely pushed through the switch opening 1614 and past the wall upper edge 1608 to reach the actuation point 1606 below the wall upper edge 1608. In some cases, an audible click or other audible indication will signal that the plunger 1616 has reached the actuation point 1606. In other words, the switch 1600 and plunger actuator 1602 thereof have some play, where the plunger 1616 may be depressed slightly without activating the switch device 1600 between its on and off conditions. As the actuation point 1606 is below the upper edge 1608 of the guard wall 1604, a user's finger must depress the actuator 1602 past the upper edge 1608 of the guard wall 1604 a small distance in order to activate the switch. This approach is advantageous because with the actuator top end 1618 protruding slightly beyond the wall upper edge 1608, the exposed upper end 1618 of the plunger 1616 provides a tactile reference for a user to find the actuator portion 1602.

Accordingly, if the switch device 1600 is pressed against an adjacent surface (such as a shelf or multiple hats stacked together), the actuator 1602 of FIG. 79B will depress slightly, such as to a position generally even with the upper edge 1608 of the guard wall 1604, but the guard wall 1604 will prevent further actuation beyond the wall's upper edge 1608 towards the actuation point 1606. With the version of FIG. 79A, an adjacent surface will not even be able to inadvertently engage the plunger actuator 1602. Thus, the wall 1604 substantially minimizes inadvertent actuation of the switch.

When mounted to the lighted hat 10 (for example as the previously described switch 42) the switch 1600 enables a power source or other battery to be installed in the lighted hat 10 during manufacture so that the hat 10 can be shipped, stored, and displayed without the risk of the installed power source being drained by inadvertent actuation of the switch 1600 due to an adjacent hat, a nested hat, a store self, or the like accidentally engaging and actuating the switch. The switch opening 1614 of the guard wall 1604 is sized so that direct actuation of the switch 1600 can still be easily achieved with a finger or the like when the actuator 1602 is depressed below the top edge 1608 of the covering wall 1604. While the switch 1600 is described with respect to the lighted hat 10, the switch 1600 could be utilized to prevent inadvertent actuation of any electronic device, such as cameras, speakers, radios, MP3 players, or the like.

Figure 79C:
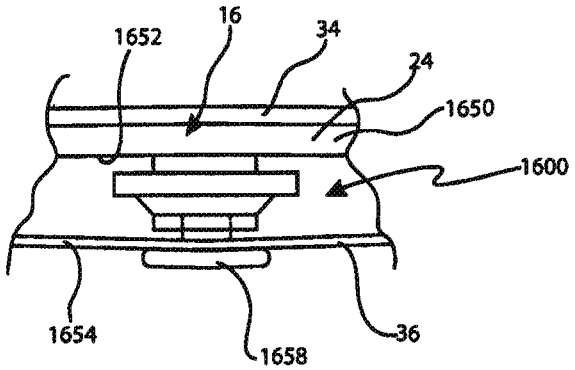
FIG. 79C is a cross-sectional side elevation view of the switch of FIG. 78 mounted to a brim of a hat and covered by brim covering material having a locator portion thereon.

Turning to FIG. 79C, one exemplary use of the switch device 1600 is shown mounted to the underside of the hat brim 16. It will be appreciated that the switch device 1600 could also be located on other portions of headgear as needed for a particular application. Preferably, the switch device is mounted to a shape retentive brim insert 1650, and particularly, to an underside 1652 of the shape retentive insert 1650. The switch device 1600 may be secured to the insert 1650 by screws, pins, adhesive, glue, Velcro, tape, and/or other suitable fasteners as needed for a particular application. Additionally, the brim insert 1650 may also include a depression, cut-out, or pocket (not shown) sized to receive the lower module portion 1610 so that lower switch device platform 1603 can be received relatively flush against the brim insert 1650 to minimize the profile thereof.

By one approach, the entire switch device 1600 is preferably covered by a lower covering material 1654 (such as a fabric layer) that extends across the lower major surface 1652 of the brim. This configuration enables the switch device 1600 to be substantially concealed from view, but also provide the integral switch guard discussed above at the same time. Alternatively, the lower covering material 1654 may include an aperture or other opening (not shown) through which the guard wall 1604 and actuator 1602 extend through to be exposed on the lower surface of the brim. So configured, external switch guarding devices, packaging protective portions covering the switch, battery interrupts, and/or the like are generally not needed on headgear using the switch device 1600 because the integral guard wall 1604 thereof provides a built-in switch protector as described above.

As the switch device 1600 is mounted to the brim insert 1650 under the lower brim covering material 1652 (which may be a fabric covering), the lower surface of the brim may also include an optional switch reference portion 1658 to help aid the user in locating the switch. By one approach, the switch reference portion 1658 may be an embroidered patch, a thickened fabric portion, multiple layers of fabric, other tactile references (bumps, ridges, or the like), and/or other suitable referencing features.

A "Try Me" feature is one method utilized to show consumers how a product will work after purchase. For the lighted hat 10, this involves allowing a consumer to turn on the light source(s) while the hat is still on a store shelf in the original packaging. One problem that can result from this, however, is that a consumer can leave the light sources turned on, which depletes the batteries in the lighted hat and denies a subsequent purchaser or potential purchaser of the lighted hat of working batteries to energize the light sources. Accordingly, example "try me" features 1700 are illustrated in FIGS. 80-84 that include momentary switch features that allow momentary activation of a hat's light sources, but prevent continuous activation of a hat's light source.

Figure 80:
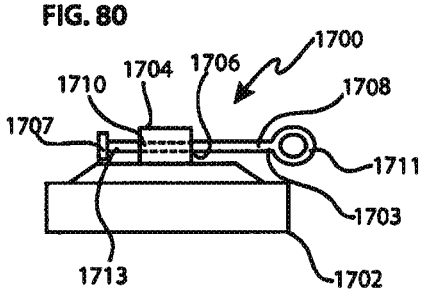
FIG. 80 is a front elevation view of a switch having a pin inserted therethrough to provide a stop surface for an actuator of the switch.
Figure 81:
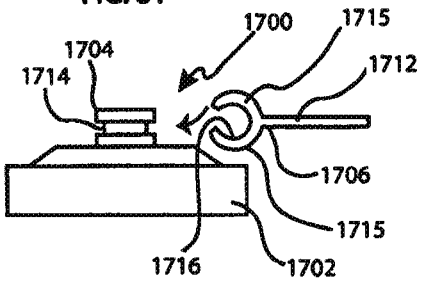
FIG. 81 is a front elevation view of a switch with a clip configured to attach to a groove in an actuator of the switch to provide a stop surface for the actuator.

By one approach as illustrated in FIGS. 80 and 81, the try me feature 1700 includes a push button switch 1702. In this form, the push button switch 1702 includes a dual-mode actuator 1704 in the form of a plunger that can be depressed to activate the switch. In the first mode, if the actuator 1704 is depressed less than a full actuation or full stroke, the switch 1702 acts as a momentary switch. Accordingly, the switch 1702 completes the circuit, such as to energize an electrically coupled light source, as long as the actuator 1704 is held in the slightly depressed mode. In the second mode, the actuator 1704 can be fully depressed to continuously complete the circuit until a subsequent actuation of the actuator 1704. Accordingly, the momentary switch attributes of the switch 1702 can be utilized to provide a consumer with the try me feature 1700 without risking that the consumer will leave the switch 1702 actuated in a continuously on mode.

To configure the switch 1702 only in the first or momentary mode the try me feature 1700 may include a removable stop member 1706 that is configured to keep the actuator 1704 from being fully depressed. In one form, the stop member 1706 is removably coupled to the plunger to prevent or hinder full switch actuation while still allowing a sufficient actuation to enable the momentary switch capabilities. As illustrated in FIG. 80, the stop member 1706 is in the form of an elongate pin 1708 inserted through a bore or opening 1710 in the actuator 1704. The pin 1708 can include a radially protruding flange or wall 1709 on one end 1713 thereof configured to prevent removal of the pin 1708 prior to purchase of the lighted hat 10. A purchaser of the hat 10 can subsequently remove the pin 1708 by severing or otherwise cutting the pin 1708 to achieve the full capabilities of the lighted hat 10. A grip or loop 1711 can be provided on the other end 1713 of the pin 1708 to provide a convenient grip for a user of the switch 1702. When the pin 1708 is inserted through the actuator bore 1710, it prevents full actuation of the actuator because pushing the actuator plunger is blocked by the pin 1708 hitting the switch body; thus, the plunger may only be partially depressed. When the pin is removed by the consumer, the switch can be fully activated in the continuous mode.

By another approach as illustrated in FIG. 81, the stop 1706 is in the form of a clip or clamp 1712, such as the illustrated c-clip, sized to removably be seated in a groove or depression 1714 provided around the actuator 1704. The clamp 1712 includes two arcuate segments 1715 forming an interior surface 1716 sized to fit within the groove 1714 but smaller than adjacent portions of the actuator 1704. Preferably, the interior surface 1716 extends around a sufficient circumference of the actuator 1704 to secure the clamp 1712 to the actuator 1704. As illustrated, the groove 1714 extends around the entire periphery of the actuator 1704, so that the clamp 1712 can be inserted into the groove 1714 and attached to the actuator 1704 from any lateral position. As with the pin 1708, when the clamp 1712 is received around or in the groove 1714 of the actuator, it blocks or hinders full actuation of the switch by abutting the switch body prior to the actuator being fully depressed, but allows partial actuation thereof as a momentary switch. Once removed, in other words, the plunger can be fully depressed to the continuous on position.

Figure 82:
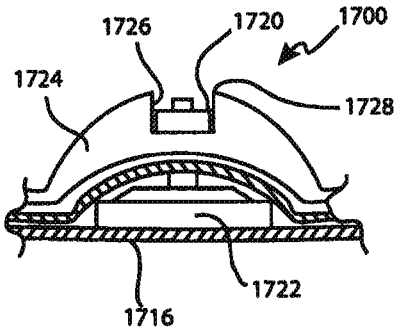
FIG. 82 is a cross-sectional front elevation view of a temporary switch received within a recess in a dome covering a second switch.
Figure 83:
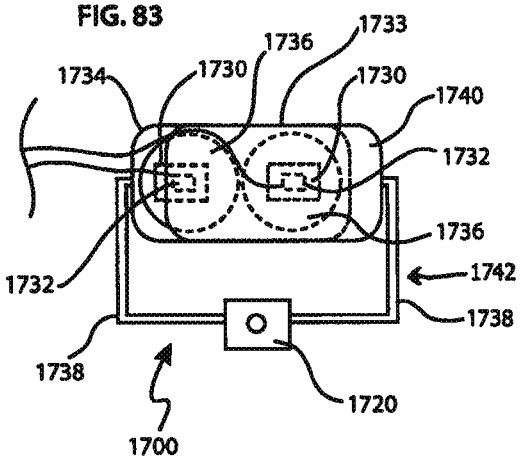
FIG. 83 is a schematic diagram showing a temporary momentary switch using battery interrupts within a power source compartment.

By another approach as shown in FIGS. 82-83, the try me feature 1700 includes a temporary or secondary momentary switch 1720, such as a double pole momentary switch. The temporary momentary switch 1720 may be a temporary a pushbutton switch, a temporary slide switch, a temporary rotary switch, or the like. In this form, the lighted hat 10 includes a main or primary switch 1722 mounted thereto, such as to a brim 16. The switch 1722 is a regular on/off switch that can be actuated to complete a circuit continuously until a subsequent actuation. The main and secondary switches 1722 and 1720 are coupled to a power source and light sources, such as those described herein, to control operation of the light sources. In this approach, the secondary switch 1720 is provided as a substitute to the main switch 1722 so that continuous activation of the light sources cannot be achieved and thus the battery life of the hat is preserved. In the illustrated approach, a temporary block surface, such as a dome or a bubble device 1724 covers or otherwise conceals the main or primary switch 1722 to deny access to the main or primary switch 1722. By one approach, the dome or bubble device 1724 can be included as part of the product packaging, such as a sleeve that is configured to fit over the hat brim with the dome 1724 an integral portion thereof or connected thereto. An example of such product packaging is disclosed is U.S. patent application Ser. No. 12/829,786, filed Jul. 2, 2010, which is hereby incorporated herein by reference in its entirety. The dome or bubble device 1724 is preferably sufficiently resilient to minimize or prevent deformation that would actuate the main switch 1722 disposed either within or under the dome or bubble.

As shown, the temporary momentary switch 1720 can be received and secured within a recess 1726 provided in a top portion 1727 of the dome 1724. A top edge 1728 of the dome 1724 is preferably positioned to extend above or outwardly beyond the temporary momentary switch 1720, and specifically the actuator thereof, so that if the hat 10 rests against another surface (such as a store shelf or another hat in a box) the dome top edge 1728 abuts the surface and prevents the temporary momentary switch 1720 from being actuated inadvertently. After the hat is purchased by the end user, the temporary or secondary momentary switch 1720 and the dome or bubble device 1724 can be removed to expose the main or primary switch 1722.

Figure 83A:
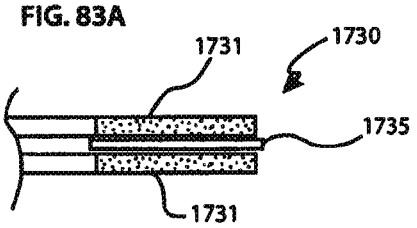
FIG. 83A is a side elevation view of an interrupt having a pair of wires spaced by an insulator.

As shown in the diagram provided in FIG. 83, the try me feature 1700 may further include one or more battery interrupts 1730 positioned between one or more electrical contacts 1732 in a housing 1733 of a power source compartment 1734 (such as the power source 44 discussed herein), and batteries 1736 housed in the power source compartment 1734. In one form, the interrupts 1730 are printed circuit boards, such as double-sided flexible printed circuit board or the like, connected to the temporary momentary switch 1720 by wires 1738, such as magnet wires or other suitable materials. An example interrupt 1730 is shown in FIG. 83A and includes a pair of wires 1731 separated by an insulator 1735. Preferably, the wires 1731 and insulator 1735 have a narrow configuration to fit within the power source compartment 1734 without needing excess space or the like. As shown, this configuration can be achieved by slightly opening a door 1740 of the power source compartment 1734 to provide access to the batteries 1736 and the contacts 1732. The interrupts 1730 can be inserted between the contacts 1732 and the batteries 1736 and then optional shrink wrap or the like can be applied or disposed over the power source compartment 1734 to prevent the configuration from being disturbed, as well as to prevent the door 1740 from opening further and allowing the batteries 1736 to shift or fall out. The temporary momentary switch 1720 is wired to the battery interrupts and to the light sources, as described herein, to form a temporary circuit 1742 that can be easily removed by a subsequent purchaser of the hat 10. The interrupts 1730 can further include printing or a label thereon instructing a subsequent purchaser to remove the interrupts 1730 prior to use.

So configured, the lighted hat 10 with the secondary momentary switch of FIGS. 82 and 83 is packaged for display including the try me feature 1700. If a user desires to test light sources provided on the hat 10, the user can actuate and hold the temporary momentary switch 1720 to view the energized light sources. When the switch 1720 is released, however, the light sources are de-energized and battery life is preserved. When a user subsequently purchases the hat 10, the packaging including the dome or bubble device 1724 and the temporary switch 1720 can be removed along with the battery interrupts 1730, which provides the user with a fully functioning hat utilizing the main or primary switch 1722 with a maximized battery life.

Figure 84:
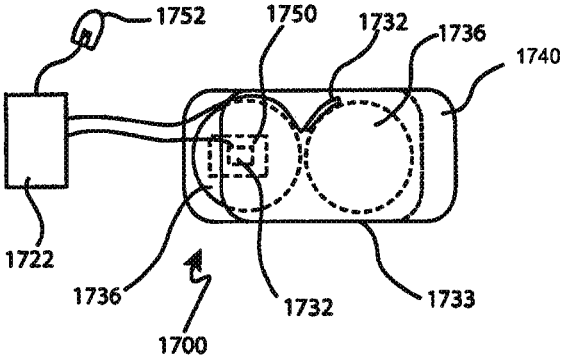
FIG. 84 is a schematic diagram showing a circuit board interrupt with a timer mounted to a power source compartment.

By yet another approach as shown in FIG. 84, a time-out interrupt 1750 can be utilized with the switch 1722, as described above, that will turn off the switch if it happens to be left or stuck in an "on" condition. Similar to the previous battery interrupt 1730, the interrupt 1750 is inserted between one of the battery contacts 1732 in the housing 1733 and its associated battery 1736. Accordingly, a switch (such as the switch 42, switch 1722, switch 1720 or other switch) can be actuated to energize one or more light sources 1752 electrically coupled to the switch and the power source 1736. In this form, however, the interrupt 1750 includes a circuit board or chip that is configured to turn off light source 1752 after a predetermined time period has passed after actuation of the switch, such as 30 seconds, 1 minute, or other desired times. For example, the interrupt 1750 begins a timer set for the predetermined time period (minutes or seconds) when it senses a current running through the circuit upon actuation of the switch 1722. Once the predetermined time period has expired, the interrupt 1750 opens the circuit to turn off the light source 1752. The interrupt 1750 then monitors for a state change of the switch 1722 indicating a new actuation. At this point, the interrupt 1750 resets, completes the circuit, and starts the timer again.

The time-out interrupt 1750 can alternatively be a motion device or coupled to a motion device, which will turn off the switch after a period of without detection of motion if it happens to be left or stuck in an "on" condition.

As shown in FIG. 84, this configuration can be achieved by slightly opening the door 1740 of the power source compartment 1734 to provide access to the batteries 1736 and the contacts 1732. The interrupt 1750 can then be inserted and then optional shrink wrap or the like can be applied or disposed over the power source compartment 1734 to prevent the configuration from being disturbed, as well as to prevent the door 1740 from opening further and allowing the batteries 1736 to shift or fall out. The interrupts 1730 can further include printing or a label thereon instructing a subsequent purchaser to remove the interrupts 1730 prior to use. If a user desires to test the light source 1752 provided on the hat 10, the user can actuate the switch 1722 to view the energized light sources. When the predetermined time has passed, the interrupt 1730 opens the circuit to de-energize the light source 1752 to preserve battery life. When a user subsequently purchases the hat 10, the interrupt 1730 can be removed, which provides the user with a fully functioning hat with a maximized battery life.

Figure 85:
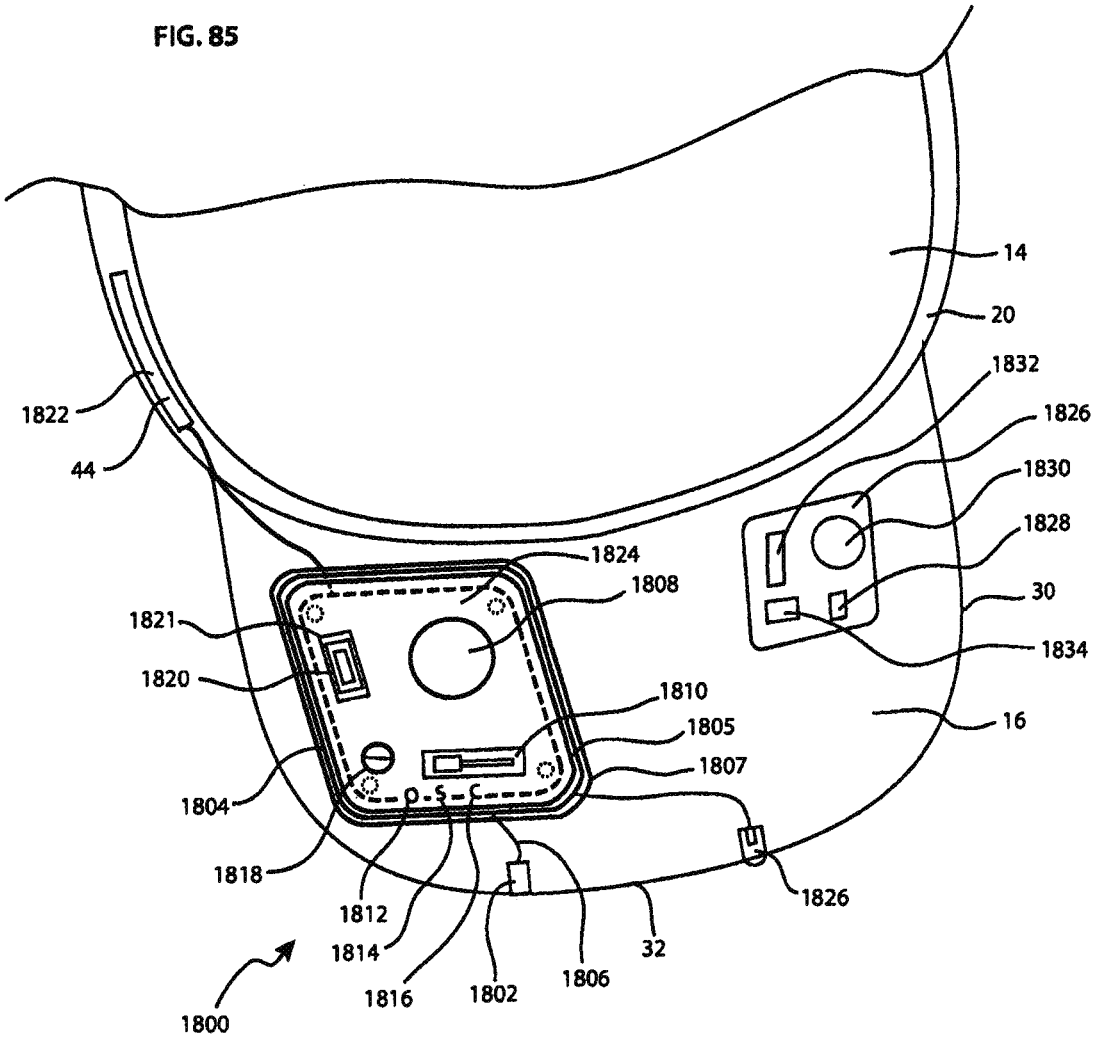
FIG. 85 is a bottom plan view of a camera hat having a control panel mounted to a bottom surface of a brim and a camera mounted to an edge of the brim.
Figure 86:
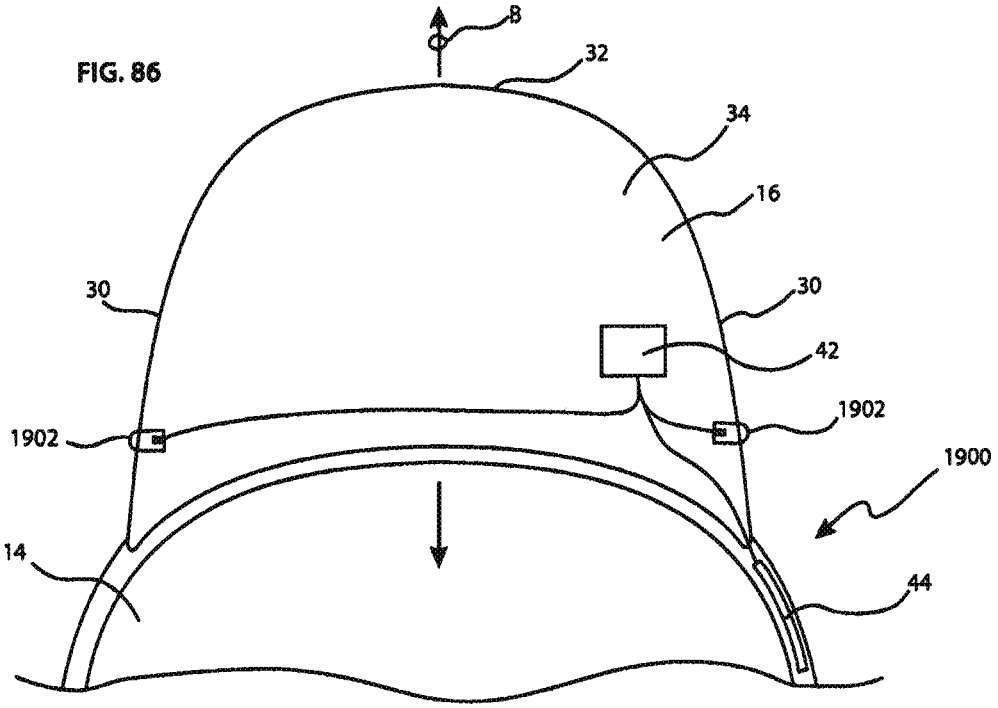
FIG. 86 is a sectional top plan view of a hat having light sources mounted to side edges of a brim.

An exemplary camera hat 1800 is shown in FIG. 85. The camera hat 1800 includes a camera 1802 disposed or mounted to an edge 30, 32 of the brim 16 (or other portion of the hat) connected to a control panel 1804 by electrical connections 1806, such as wiring or printed circuit boards. The camera 1802 could alternatively be mounted to the upper or lower major surfaces 26, 28 of the brim 16, or the crown 14 as desired. As shown, the control panel 1804 is mounted to the lower major surface 26 or the lower covering 36 of the brim 16, but could also be mounted to the upper major surface 28 of the brim 16 or the crown 14 as desired. In the illustrated form, the control panel 1804 is attached to the lower covering 36 of the brim 16, such as by stitching, staples, adhesive, welding, or the like. To this end, the control panel 1804 may include a groove or channel 1805 adjacent a perimeter edge 1807 of the control panel 1804. The groove 1805 advantageously provides a thinner cross section through which a needle or staple may pass to secure the holder to the brim or, alternatively, substantially conceals threading, staples, or other mechanical fastening element from view because such fastener is received within the groove 1805.

In the illustrated form, the control panel 1804 includes a switch 1808, such as a push button switch, slide switch, or the like, configured to send a control signal to the camera 1802. The control panel 1804 further includes a setting switch 1810 configured to set the operation settings of the camera 1802. As illustrated, the setting switch 1810 allows a user to select between a first position 1812 to turn off the camera 1802, a second position 1814 to take single snapshots or photos with the camera 1802 upon actuation of the switch 1808, and a third position 1816 to take a continuous video with the camera 1802 upon actuation of the switch 1808. The control panel 1804 can also include a status indicator 1818, in this form an LED. The LED 1818 can utilize color, blinking, or the like to indicate whether the camera 1802 is on, recording video, taking a photo, or the like. The control panel 1802 can also include a USB port 1820 or other connection device, such as utilizing other connecting heads, wireless connection methods such as Bluetooth, infrared, Wi-Fi or the like. The USB port 1820 can be utilized by a user to download photos or video and can also be utilized to charge a power source 1822 configured to provide power to the control panel 1804 and the camera 1802. The USB port 1820 may further include a cover 1821 configured to tightly fit thereon to protect the USB port 1820, as well as prevent foreign matter from entering the port 1820. By one approach, the cover 1821 may be formed from a flexible material, such as rubber, flexible plastic, or the like. By another approach, the cover 1821 may be hingedly attached to the control panel 1804, such as to pivot or flip off of the USB port 1820, so that the cover 1821 can be removed from the USB port 1820 without being removed from the control panel 1804 because such completely removable covers are easily lost. As shown, the control panel 1804 is attached to a circuit board 1824, such as by snap-fit, hardware, ultrasonic welding, adhesive, or the like. The control panel 1804 and the circuit board 1824 can be attached to the brim 16 by a clamping mechanism, stitching, adhesive, hardware, or the like. Preferably, the circuit board 1824 is a printed circuit board and is positioned above the lower major covering 36 of the brim 16. The control panel 1804 can then be provided below the lower major covering 36 of the brim 16 and attached to the circuit board 1824 to sandwich the lower major covering 36 therebetween.

By another approach, the camera hat 1800 can include sound system 1826, including various sound system components, such as a microphone 1828, one or more speakers 1830, volume control 1832 in the form of push buttons, a rotary switch, or other suitable actuating mechanisms, or the like along with a memory 1834 to further be configured to record sound, which can also be utilized in conjunction with the video feature of the camera hat 1800. As shown, the sound system 1826 is entirely disposed on the brim 16, such as to the upper or lower major surfaces 26, 28 thereof; however, the components can be separated and/or distributed to other portions of the hat 1800.

The camera hat 1800 may further include a light source 1826, such as disposed in the front edge 32 of the brim 16 as shown, or mounted elsewhere on the hat 1800 as described herein. The light source 1826 can provide a flash for a photograph, a continuous stream of light for a video, or the like. So configured, the necessary controls are provided on the control panel 1804 that is substantially concealed on the lower major surface 32 of the brim 16. This preserves the aesthetics of the hat 10, as well as provides an apparatus to take stealthy video and photos. PCT/US2008/087542, filed Dec. 18, 2008 and entitled "Hands-Free Lighting Devices" describes a hat having a camera mounted thereto and is hereby incorporated herein by reference in its entirety.

Various features for a hat 1900 which can be utilizing when running or exercising, for example, are illustrated in FIGS. 86-93. By one approach, a pair of light sources 1902 are disposed in or mounted to the side edge portions 30 of the brim 16. The light sources 1902 can be mounted to the brim insert 24 and disposed between the upper and lower coverings 34, 36 of the brim 16 and electrically connected to the switch 42 and the power source 44, as described above. By being mounted between the upper and lower coverings 34, 36, the upper and lower coverings 34, 36 can act as an opaque blinder surface to obstruct or deflect light emitted downwardly or upwardly. The blinder surface can therefore prevent stray or incident light from emitting below the brim 16 such as into the eyes of a wearer or into the glasses of a wearer to cause a glare thereon. These sideward oriented light sources 1902 are configured to project light laterally to the sides of the brim 16 and therefore laterally to the side of a wearer of the hat 1900 (that is, generally transverse to the brim axis B) to thereby provide an indicator of the location of the wearer. The light sources 1902 are preferably LEDs that include a dome lens portion. As such, the LED dome lens portion can project at least slightly outwardly of the side edge portion 30 of the brim 16 so that the LEDs are at least partially visible from a position forwardly and/or rearwardly of the hat 1900. Accordingly, the lights 1902 can act as safety indicators that locate the presence of a wearer of the hat 1900 to people alongside of the wearer, or forward/rearward thereof, such as people operating motor vehicles, riding bicycles, or the like. The lights sources 1902 can further be configured to blink, shine continuously, utilize several colors or the like to be utilized in different situations or to provide greater eye-catching capabilities.

Figure 87:
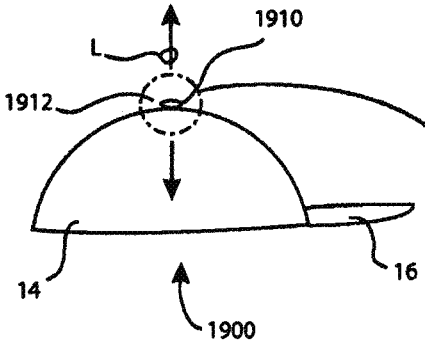
FIG. 87 is a side elevation view of a hat having an LED attached to a top of a crown thereof.
Figure 88:
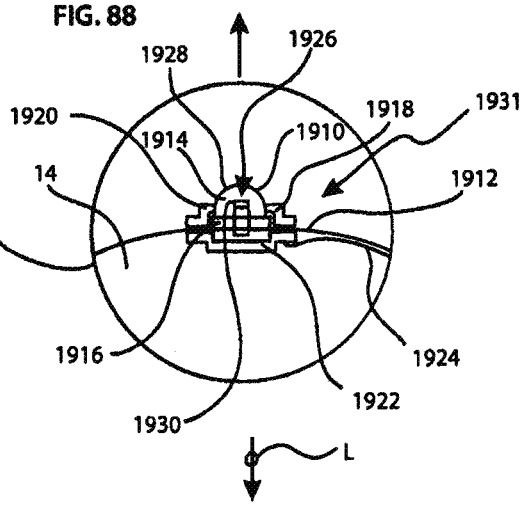
FIG. 88 is a cross-sectional side elevation view of the hat of FIG. 87 showing the top of the crown.
Figure 89:
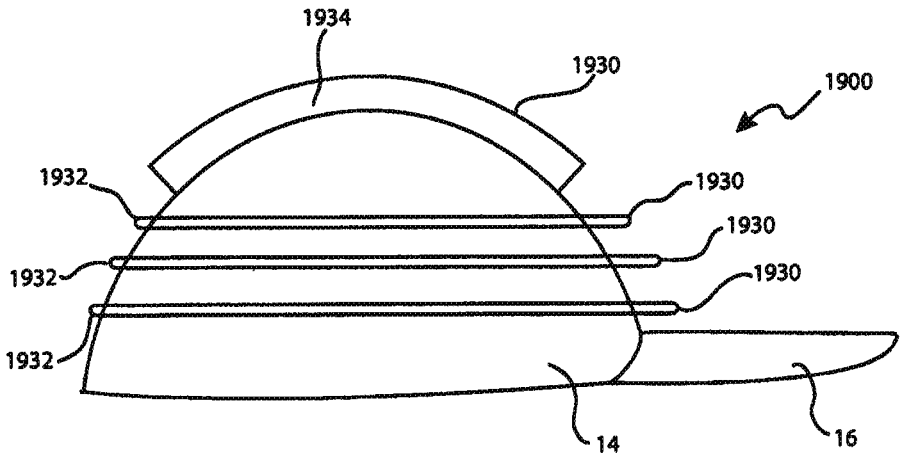
FIG. 89 is a side elevation view of a hat having cooling fins protruding from a crown thereof.
Figure 90:
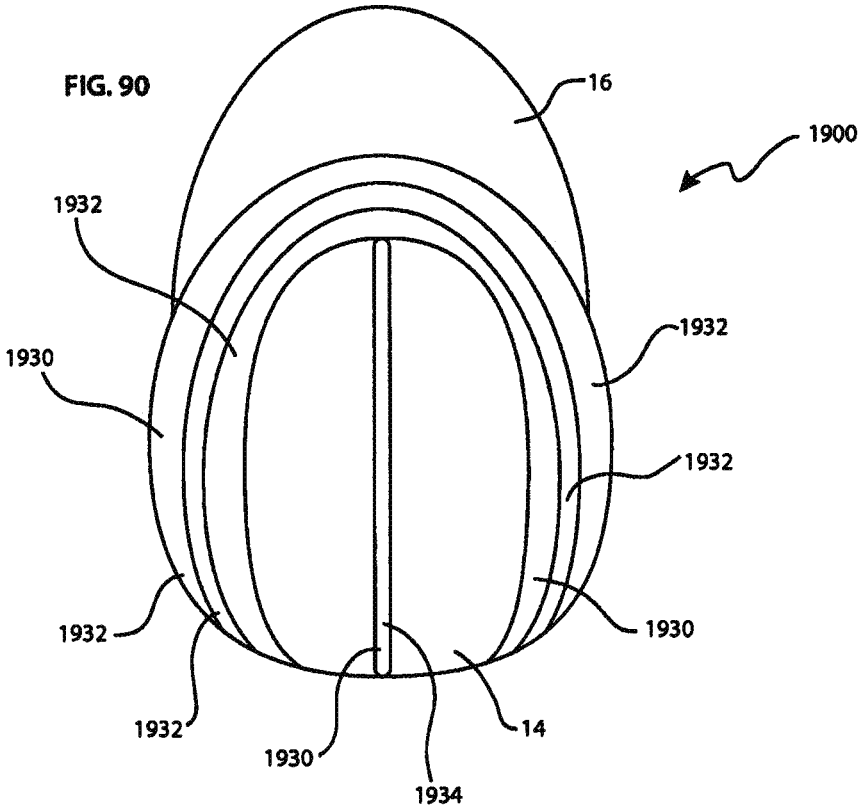
FIG. 90 is a top plan view of the hat of FIG. 89.

The hat 1900 may further or alternatively include a button LED 1910 configured to be mounted to an apex or top 1912 of the crown 14 as shown in FIGS. 87 and 88. The button LED 1910 is configured to project light radially outward therefrom at a variety of angles (such as up to a full 360° of illumination) to shine light radially around the hat 1900. By one approach, the LED 1910 can include a prism or reflector 1926 adjacent a top portion 1928 of the LED 1910 that is configured to direct light emitted from one or more illumination chips 1930 in the LED 1910 generally outwardly. By another approach, the one or more illumination chips 1930 can be oriented transverse to the LED axis L to directly emit light outwardly of the hat 1900. As shown in FIG. 88, the button LED 1910 includes a lens portion 1914 connected to a base 1931 having an outwardly projecting flange 1916. A top securing member 1918 is configured to engage a top surface 1920 of the base flange 1916 to hold the button LED 1910 against the crown 14. A bottom securing member 1922 is positioned below the top securing member 1918 on the other side of the crown 14. The bottom securing member 1922 attaches to the top securing member 1918 by a clamping mechanism, stitching, adhesive, snap-fit, or the like. As shown, leads 1924 projecting from the flange 1916 of the button LED 1910 pass through the crown 14 and the bottom securing member 1922 to attach to the switch 42 and the power source 44.

In another form as shown in FIGS. 89-92, the hat 1900 may include a plurality of cooling devices 1930, such as elongate fins or extensions protruding outwardly from the crown 14. In the illustrated form, the hat 1900 includes three horizontally oriented cooling fins 1932 and one vertically oriented cooling fin 1934; however, other configurations could also be utilized. As shown, the horizontally oriented fins 1932 extend around a majority of the hat 1900; however, the fins 1932 could extend around the entire circumference of the hat 1900 or portions thereof as desired. The fins 1930 act to provide a greater area from which to dissipate heat contained within the hat 1900 and thereby cool a wearer's head better than conventional headwear.

Figure 91:
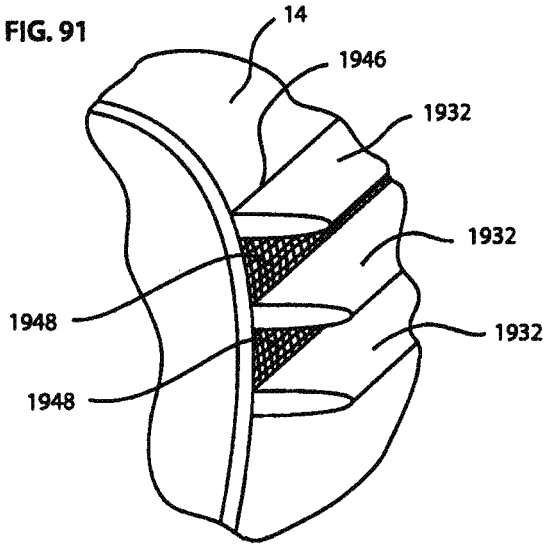
FIG. 91 is a cross-sectional perspective view of the hat of FIG. 89 showing the cooling fins in a first position.
Figure 92:
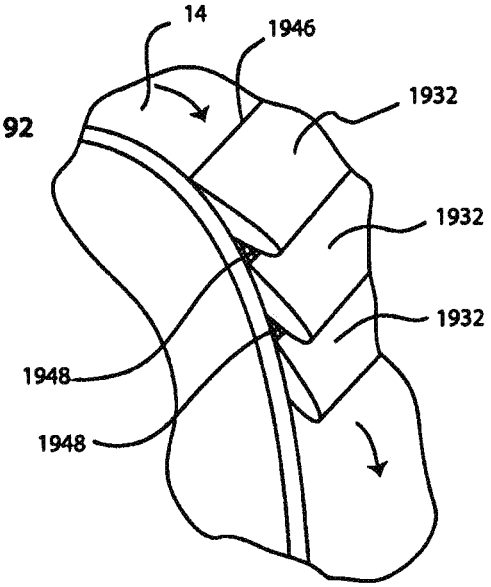
FIG. 92 is a cross-sectional perspective view of the hat of FIG. 89 showing the cooling fins in a second position.

By one approach, the horizontally protruding cooling fins 1932 can shift between a first position as shown in FIG. 91 where the fins 1932 extend generally horizontally to a second position as shown in FIG. 92 where the fins 1932 are folded downward about a hinge or fold 1946 to generally rest against or adjacent the crown 14. The fins 1932 can be shifted or pivoted between the positions as needed to provide more cooling (as with the open condition of FIG. 91) or less cooling (as with the closed condition of FIG. 92) or any position therebetween. The fins 1932 can further include a mesh or other porous breathable material 1948 therebetween. So configured, when the fins 1932 are in the first position, the mesh material 1948 is exposed to further cool a wearer's head by providing ventilation along with the increased hat surface area provided by the fins 1932 to provide heat dissipation. If a wearer instead desires less cooling properties, the fins 1932 can be pivoted about the hinge 1946 to generally cover the mesh material 1948.

Figure 93:
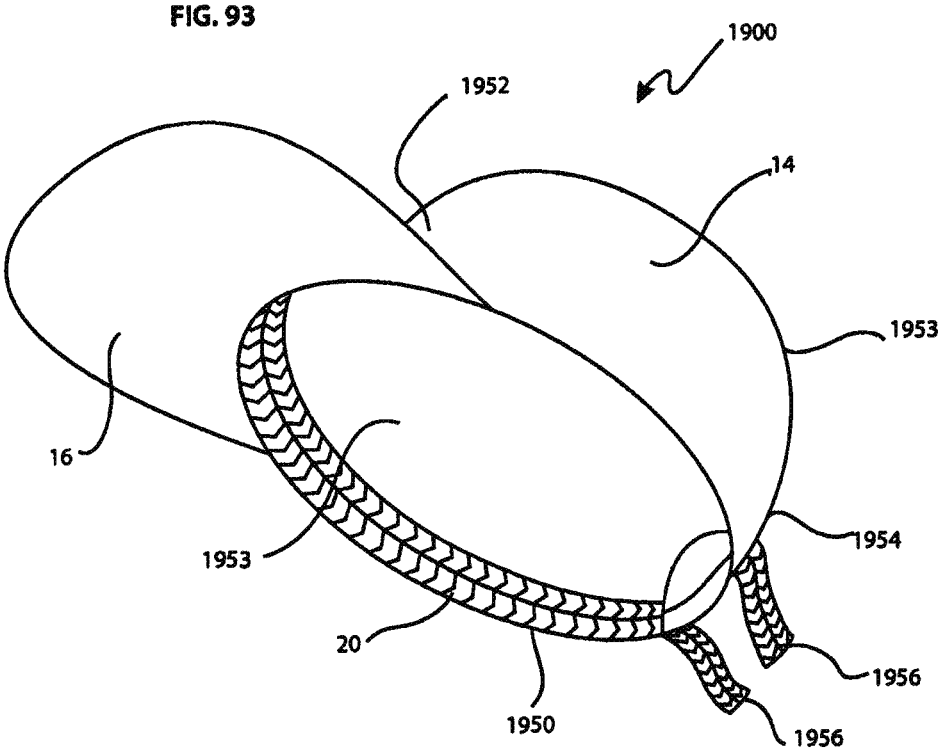
FIG. 93 is a bottom perspective view of a hat having a wicking sweatband attached to an bottom interior portion of a crown.

Referring now to FIG. 93, the hat 1900 can further include a wicking sweatband 1950. The wicking sweatband 1950 is configured to absorb moisture, such as sweat or rain, and wick it along its length away from a forward portion 1952 and side portions 1953 of the crown rather than drain onto the face of a wearer of the hat 1900 like traditional headgear. The wicking sweatband 1950 can extend along the entire interior perimeter of the crown 14 and extend out of a back portion 1954 to form drainage portions or extensions 1956. So configured, the wicking sweatband 1950 can wick moisture collected in the hat 1900 away from the front portion 1952 of the crown 14 to drain out of the drainage portions 1956 extending or hanging along the back of a wearer. The wicking sweatband 1950 can further include elastic properties to conform to a head of a wearer.

Figure 94:
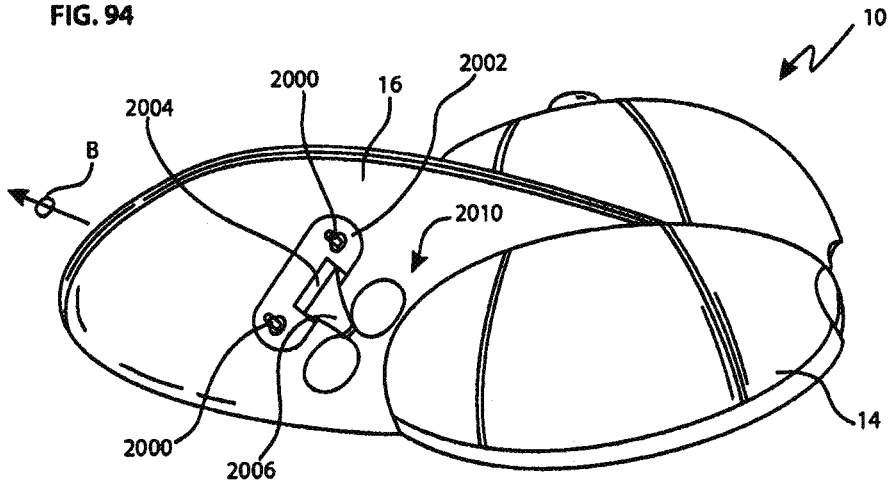
FIG. 94 is a bottom perspective view of a lighted hat having a pair of light sources mounted to a bottom surface of a brim and a pair of glasses pivotably mounted to the bottom surface of a brim adjacent to the pair of light sources.
Figure 95:
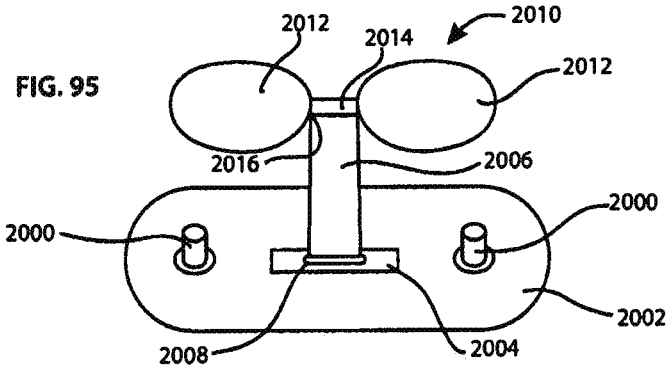
FIG. 95 is a top plan view of the pair of glasses and light sources of FIG. 94.
Figure 96:
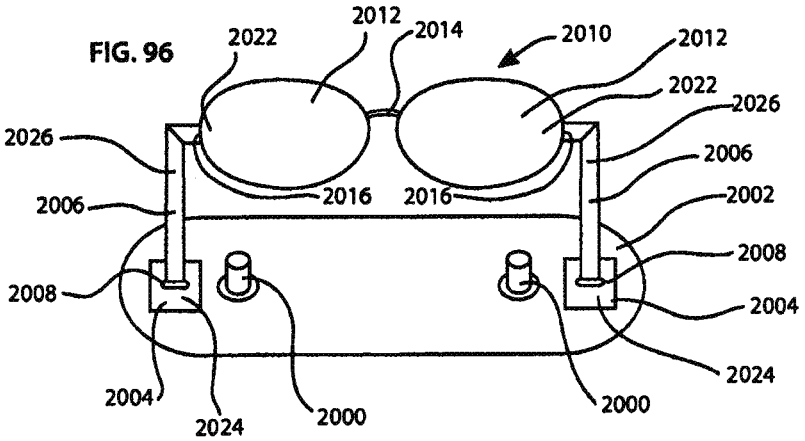
FIG. 96 is atop plan view of a pair of glasses configured to be mounted to the lighted hat of FIG. 94.

Referring now to FIGS. 94-96, hat 10 is configured to provide lighted vision correction. In this form, the hat includes one or more light sources 2000 to project light forwardly and downwardly of the brim 16 provided in a concealed lighting module as described in co-pending U.S. application Ser. No. 12/714,403, filed Feb. 26, 2010 and entitled "Lighted Hat," which is hereby incorporated herein in its entirety. The light sources 2000 project through a mounting patch or from an external light holder 2002. As shown, a base 2004 is disposed on the mounting patch 2002. Alternatively, the base 2004 can be disposed on other portions of the brim, such as the lower covering material or the brim insert. A connecting member 2006 pivotably attaches to the base 2004 by a hinge or pivot 2008. A pair of eyeglasses 2010 are provided with a pair of lenses 2012 therein, such as refractive or non-refractive lenses, connected by a bridge portion 2014. Alternatively, a single elongate lens can be utilized. The connecting member 2006 extends from the base 2004 and can be fixed to the glasses or pivotably coupled to the bridge portion 2014 of the glasses 2010 or to the lenses 2012 by a hinge or pivot 2016. If a pivot connection is provided at both ends of the pivot connecting member, the eyeglasses 2010 have two degrees of freedom generally perpendicular to the brim axis B so that the eyeglass 2010 and be pivoted or rotated toward the face of a wearer of the hat 10 over the base hinge 2008 and then the eyeglasses can be pivoted or rotated over the eyeglass hinge 2016 to be vertically oriented as desired. Advantageously, if two light sources 2000 are utilized, such as shown in the figures, each light source can be configured to be generally vertically aligned with a corresponding lens.

The eyeglasses 2010 can be pivoted between a stored or folded configuration where the eyeglasses 2010 extend generally adjacent to and/or along the brim axis B where they are stored adjacent the lower major surface 36 of the brim 16 to an unfolded or use configuration where the eyeglasses 2010 are pivoted about the hinges 2008 to a position where a wearer of the lighted hat 10 can see through the eyeglasses 2010, such as to a viewing or reading area. The glasses 2010 can be utilized along with the light sources 2000 which are configured to direct light to the viewing or reading area to provide hands-free lighted glasses.

By another approach as shown in FIG. 96, the base 2004 can be separated into two separate base portions 2024 positioned generally outwardly of the light sources 2000 on the mounting patch 2002. The connecting member 2006 is similarly divided into a pair of connecting members 2026 that extend from the base portions 2024 and are pivotably connected to the base portions by hinges 2008. The connecting members 2026 pivotably attach to outer portions 2022 of the lenses 2012 by hinges 2016. The eyeglasses 2010 of this form are shown with the bridge portion 2014, but the eyeglasses 2010 could simply include the lenses 2012 attached to the connecting members 2006. By another approach, the lenses 2012 can include frame portions at least partially therearound. In this approach, the connecting members 2026 could pivotably couple to the frame.

Figure 97:
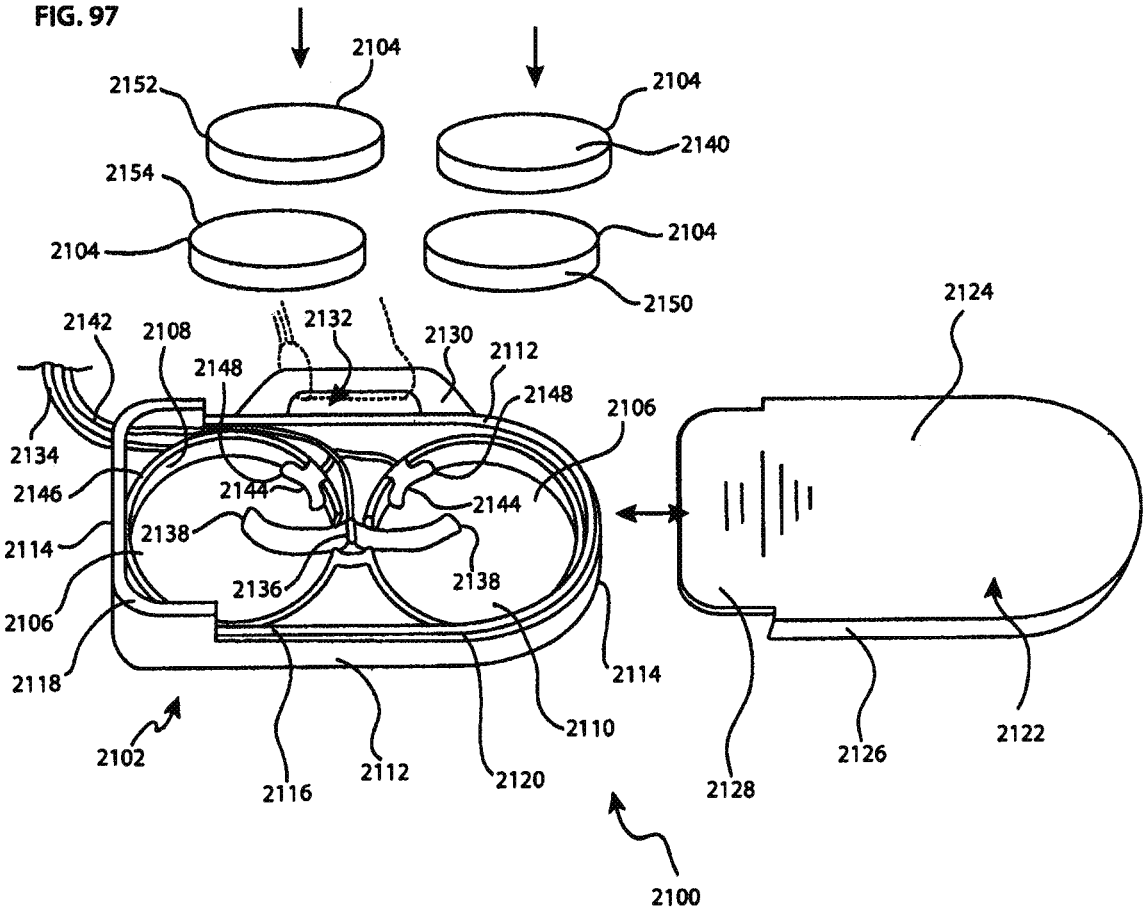
FIG. 97 is an exploded perspective view of a battery case for a lighted hat showing four batteries, associated bays for the batteries, and a removable cover.
Figure 98:
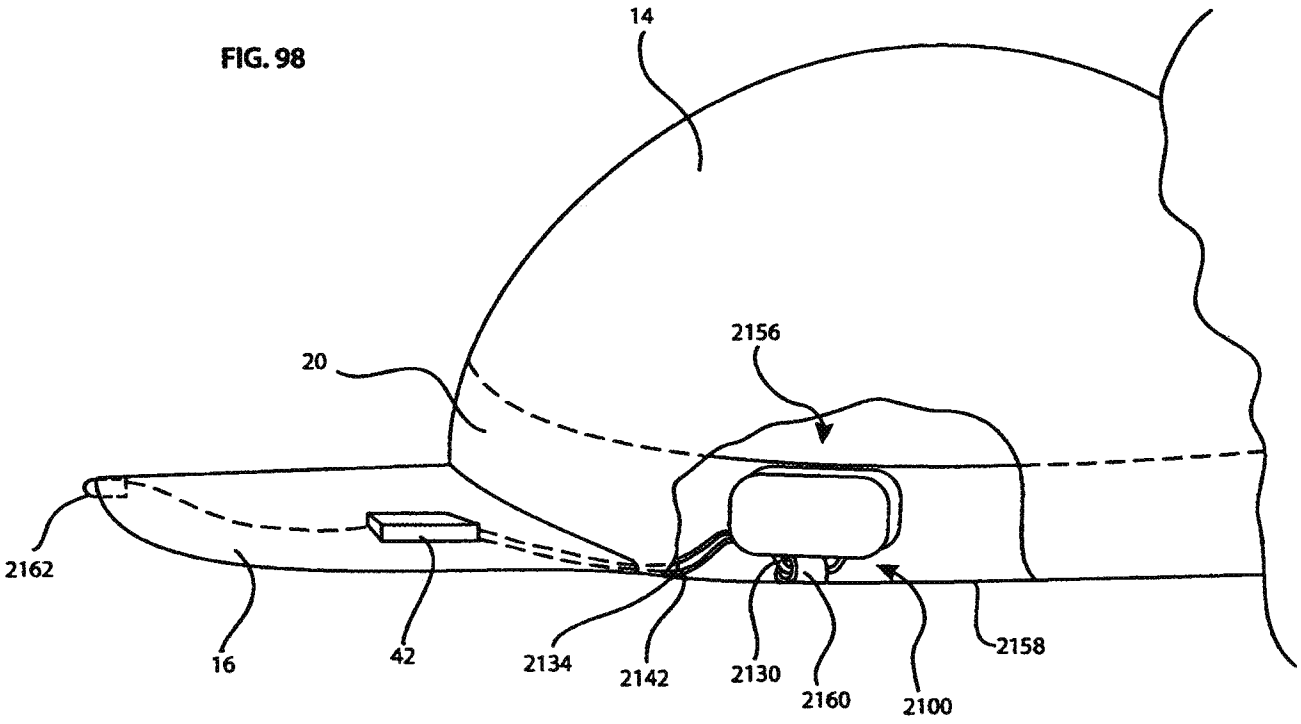
FIG. 98 is a side elevation view of a lighted hat with a cut-out portion showing the battery case of FIG. 97 mounted between a sweatband and a crown portion of the hat.

A battery compartment 2100 is illustrated in FIGS. 97-98. In the illustrated form, the battery compartment 2100 includes a housing 2102 sized to fit four batteries 2104 therein in stacked side-by-side orientations; however other numbers of batteries could also be utilized and the batteries can be oriented in longitudinal side-by-side relation, overlapping relation, or the like. The battery compartment 2100 is sized to be mounted to the lighted hat 10 as a power source therefor (such as the power source 44 described above) to energize light sources and/or other electrical components in the hat.

Turning now to details of the battery compartment 2100 as illustrated in FIG. 97. The housing 2102 includes two bays or recesses 2106 therein defined by walls 2108 extending away from a bottom wall 2110 of the housing 2102. Side walls 2112 and end walls 2114 extend generally upwardly away from the bottom wall 2110 to form an upwardly facing edge or shoulder 2116 about the housing. The shoulder 2116 may include an offset end portion 2118 that is raised with respect to the remaining portions of the shoulder 2116. By one approach, an upper edge of the sidewalls 2112 may include a groove or channel 2120 longitudinally therealong closely adjacent the shoulder 2116.

The battery compartment 2100 further includes a removable cover 2122 having a top wall 2124 and downwardly depending edges 2126 therearound except for an end portion 2128 that corresponds to the offset end portion 2118 of the housing 2102. By this approach, the edges 2126 preferably include inwardly directed structure or tracks configured to seat or be received in the groove 2120 of the housing 2102. As the cover 2122 is slid along the groove 2120, the end portion 2128 of the cover 2122 secures to the housing 2102, such as by a snap-fit mechanism or the like.

Figure 99:
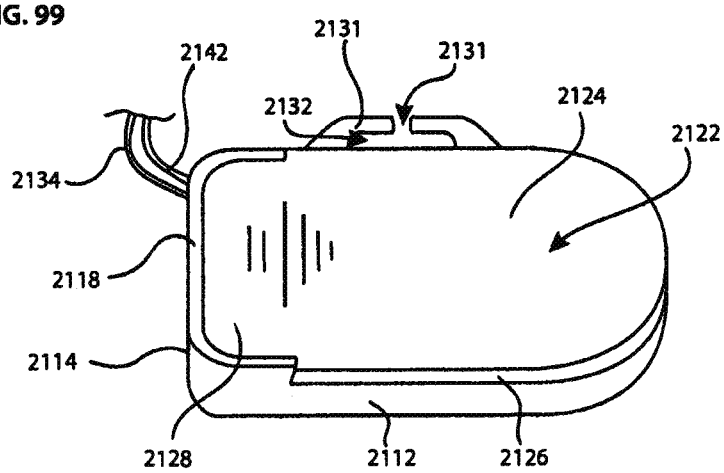
FIG. 99 is a perspective view of a battery case for a lighted hat having a removable cover and a handle with a slit therein.

The housing 2102 can further include a handle or retention member 2130 protruding therefrom. As illustrated, the handle 2130 extends away from one of the side walls 2112 of the housing 1202 and includes an opening 2132 therein, such as an elongate slot. The handle 2130 could alternatively extend from one of the end walls 2114. The handle 2130 may further include a slit or break 2131 therein as shown in FIG. 99. The slit 2131 is preferably positioned intermediately in an outward portion 2133 of the handle 2130.

Electrical connections 2134 are received in or mounted to the housing 2102 to electrically connect the batteries 2104 to the various electrical components in the hat 10. The electrical connections 2134 include a one-piece face contact mechanism 2136 including two outwardly depending electrical face contacts 2138. The electrical face contacts 2138 could also be separate components. The electrical face contacts 2138 are positioned adjacent the bottom wall 2110 in the bay 2106 of the housing 2102 so that when one of the batteries 2104 is inserted into the bay 2106, a face 2140 of the battery 2104 seats upon and/or electrically communicates or engages with the electrical face contact 2138. As shown, the electrical face contacts 2138 can be upwardly biased, such as with a general curvature, so that the electrical face contacts 2138 extend vertically within the bays 2106 to further ensure electrical contact or communication with the face 2140 of the battery 2104. Wires or electrical conduits 2142 extend away from the face contact mechanism 2136 out of the housing 2102 to other portions of the lighted hat 10.

The electrical connections 2134 can further include a pair of electrical side contacts 2144 positioned or seated on or adjacent a top surface 2146 of the bays 2106. Each electrical side contact 2144 include a pair of outwardly projecting arms or members 2148 configured to extend around a portion of and electrically engage or communicate with a sidewall 2150 of one of the batteries 2104. Preferably and as illustrated in FIG. 97, the arms 2148 of the electrical side contacts 2144 are biased inwardly into the bays 2106, so that, as discussed above with respect to the electrical face contacts 2138, the electrical side contacts 2144 are further ensured of electrically contacting or communicating with the sidewall 2140 of the battery 2104. The wires or electrical conduits 2142 also extend away from the electrical side contacts 2144 out of the housing 2102 to other portions of the lighted hat 10.

By one approach, the electrical side contacts 2144 have a depth/sized or are positioned to contact only a top battery 2152 of a pair of stacked batteries 2104 and the electrical face contact 2138 only contacts the face 2140 of a bottom battery 2154 of the pair of stacked batteries 2104. This configuration provides easier insertion or entrance of the batteries 2104 in the housing 2102 by ensuring electrical contact with the face 2140 of the first inserted battery 2104 and visibly showing contact with the sidewall 2150 of the top battery 2152. So configured, the power source compartment 2100 can provide the narrow depth housing 2102 while receiving four batteries 2104 therein.

As shown in FIG. 98, the power source compartment 2100 can be mounted or secured to the lighted hat 10 to provide power thereto. Preferably, the compartment 2100 is received in a space or pocket 2156 formed by the inwardly turned hat band 20, the crown 14, and a bottom connection 2158 of the two, such as stitching, a fold, or the like. Additionally, a loop or segment 2160 of material can loop or secure around the handle 2130 projecting from the sidewall 2112. As illustrated, the handle 2130 is positioned adjacent the bottom connection 2158 between the hat band 20 and the crown 14 and the loop 2160 secures within the bottom connection 2158, such as by stitching or the like. By another approach, the loop 2160 can be secured to the crown 14 by stitching, adhesive, or the like. By yet another approach, the loop 2160 can be secured directly to the hat band 20. If the loop 2160 is used to secure the battery compartment 2100 as illustrated in FIG. 99, the battery compartment 2100 can be detached from the hat band 20 by manipulating the loop 2160 through the slit 2131. So configured, the loop 2160 secures the battery compartment 2100 to the crown 14 in a position to be substantially concealed in the pocket 2156 between the hat band 20 and the crown 14 to provide power to electrical components in the lighted hat 10, such as the switch 42, a light source 2162, and/or any other components as described herein, and/or other electrical components for a particular application.

It will be understood that various changes in the details, materials, and arrangements of the parts and components that have been described and illustrated in order to explain the nature of the lighted headgear may be made by those skilled in the art within the principle and scope as described herein.

The invention claimed is:

1. Lighted headgear comprising:

a cap configured to be worn by a user; and a self-contained light module removably securable to the cap, the self-contained light module including a housing having a plurality of light sources and a rechargeable power source disposed within the housing;

wherein the self-contained light module is slidable in a first direction to form a friction-fit engagement between the housing and the cap to secure the self-contained light module to the cap, and is slidable in a second direction opposite the first direction to remove the self-contained light module from the cap, wherein the self-contained light module is removably securable to the cap in a first forward-facing orientation, and is removably securable to the cap in a second forward-facing orientation that is rotated 180 degrees from the first forward-facing orientation, wherein the housing includes opposite first and second cap-engaging walls each configured for engagement with the cap when the self-contained light module is secured to the cap.

2. The lighted headgear of claim 1 wherein the housing is configured to form the friction-fit engagement in both of the first and second forward-facing orientations.

3. The lighted headgear of claim 1 wherein the self-contained light module includes a pushbutton switch configured to control power to the plurality of light sources from the rechargeable power source.

4. The lighted headgear of claim 1 wherein the opposite first and second cap-engaging walls of the housing comprise a protruding engagement portion that forms the friction-fit engagement with the cap.

5. The lighted headgear of claim 1 wherein the first and second cap-engaging walls extend along a cavity of the housing.

6. The lighted headgear of claim 1 wherein in the first forward-facing orientation, the first cap-engaging wall engages an upper mounting surface of the cap and the second cap-engaging walls engages a lower mounting surface of the cap, and in the second forward-facing orientation, the first cap-engaging walls engages the lower mounting surface of the cap and the second cap-engaging wall engages the upper mounting surface of the cap.

* * * * *